US007922167B2

(12) United States Patent
Kajiyama et al.

(10) Patent No.: US 7,922,167 B2
(45) Date of Patent: Apr. 12, 2011

(54) SHEET CONVEYING DEVICE, AND IMAGE FORMING APPARATUS INCLUDING SAME

(75) Inventors: Hiroshi Kajiyama, Kanagawa (JP); Hiroyuki Watase, Kanagawa (JP); Masayuki Ueda, Tokyo (JP); Tadashi Kusumi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 822 days.

(21) Appl. No.: 11/905,676

(22) Filed: Oct. 3, 2007

(65) Prior Publication Data

US 2008/0085140 A1 Apr. 10, 2008

(30) Foreign Application Priority Data

Oct. 4, 2006 (JP) ..... 2006-273391
Oct. 25, 2006 (JP) ..... 2006-290216

(51) Int. Cl.
*B65H 5/22* (2006.01)

(52) U.S. Cl. ..... 271/4.01; 271/10.01; 271/9.11

(58) Field of Classification Search ..... 271/4.01, 271/10.01, 9.11

See application file for complete search history.

(56) References Cited

U.S. PATENT DOCUMENTS

| | | | | |
|---|---|---|---|---|
| 4,518,158 | A | 5/1985 | Goi | |
| 5,499,806 | A | 3/1996 | Bourg | |
| 7,621,519 | B2 * | 11/2009 | Sagawa et al. | 271/4.01 |
| 2007/0057444 | A1 | 3/2007 | Sagawa et al. | |

FOREIGN PATENT DOCUMENTS

| | | |
|---|---|---|
| EP | 1 847 493 | 10/2007 |
| JP | 02-248962 | 10/1990 |
| JP | 10-129883 | 5/1998 |
| JP | 10-265070 | 10/1998 |
| JP | 2002-274702 | 9/2002 |
| JP | 2004-338923 | 12/2004 |
| JP | 2005-001771 | 1/2005 |
| JP | 2005-089008 | 4/2005 |
| JP | 2007-127675 | 5/2007 |
| JP | 2007-145600 | 6/2007 |

OTHER PUBLICATIONS

Chinese Office Action dated Aug. 28, 2009.
European Office Action.

* cited by examiner

*Primary Examiner* — David H Bollinger
(74) *Attorney, Agent, or Firm* — Harness, Dickey & Pierce, P.L.C.

(57) ABSTRACT

A sheet conveying device, that can be included in an image forming apparatus, includes first and second conveying units configured to hold and convey a sheet, a first sheet conveying path between the first and second conveying units, and a registration unit to change a positional condition of the sheet conveyed by the second conveying unit. In at least one embodiment, the second conveying unit includes a moving and guiding unit and a rotary conveyance unit facing each other and forming a sheet holding section therebetween to hold and convey the sheet, and the moving and guiding unit and the rotary conveyance unit are disposed in the vicinity of the first conveying unit so that a distance between the second conveying unit and the registration unit is relatively increased.

12 Claims, 30 Drawing Sheets

FIG. 26

| HARDNESS (DEGREES) | | 40 | | | | | | | | | | | | |
|---|---|---|---|---|---|---|---|---|---|---|---|---|---|---|
| THICKNESS (mm) | | 1.5 | 1.6 | 1.7 | 1.8 | 1.9 | 2.0 | 2.1 | 2.2 | 2.3 | 2.4 | 2.5 | 2.6 | 2.7 |
| EXTENSION (%) | 10 | ○ | × | × | × | × | × | × | × | × | × | × | × | × |
| | 9 | ○ | ○ | ○ | × | × | × | × | × | × | × | × | × | × |
| | 8 | ○ | ○ | ○ | ○ | ○ | × | × | × | × | × | × | × | × |
| | 7 | ○ | ○ | ○ | ○ | ○ | ○ | ○ | ○ | × | × | × | × | × |
| | 6 | ○ | ○ | ○ | ○ | ○ | ○ | ○ | ○ | ○ | ○ | ○ | ○ | × |
| | 5 | ○ | ○ | ○ | ○ | ○ | ○ | ○ | ○ | ○ | ○ | ○ | ○ | ○ |
| | 4 | △ | △ | △ | △ | △ | △ | △ | △ | △ | △ | △ | △ | △ |

| HARDNESS (DEGREES) | | 40 | | | | | | | | | | | | |
|---|---|---|---|---|---|---|---|---|---|---|---|---|---|---|
| THICKNESS (mm) | | 2.8 | 2.9 | 3.0 | 3.1 | 3.2 | 3.3 | 3.4 | 3.5 | 3.6 | 3.7 | 3.8 | 3.9 | 4.0 |
| EXTENSION (%) | 10 | × | × | × | × | × | × | × | × | × | × | × | × | × |
| | 9 | × | × | × | × | × | × | × | × | × | × | × | × | × |
| | 8 | × | × | × | × | × | × | × | × | × | × | × | × | × |
| | 7 | × | × | × | × | × | × | × | × | × | × | × | × | × |
| | 6 | × | × | × | × | × | × | × | × | × | × | × | × | × |
| | 5 | ○ | ○ | ○ | ○ | × | × | × | × | × | × | × | × | × |
| | 4 | △ | △ | △ | △ | △ | △ | △ | △ | △ | △ | △ | △ | × |

FIG. 27

| HARDNESS (DEGREES) | | 50 | | | | | | | | | | | |
|---|---|---|---|---|---|---|---|---|---|---|---|---|---|
| THICKNESS (mm) | | 1.5 | 1.6 | 1.7 | 1.8 | 1.9 | 2.0 | 2.1 | 2.2 | 2.3 | 2.4 | 2.5 | 2.6 |
| EXTENSION (%) | 10 | × | × | × | × | × | × | × | × | × | × | × | × |
| | 9 | ○ | × | × | × | × | × | × | × | × | × | × | × |
| | 8 | ○ | ○ | ○ | × | × | × | × | × | × | × | × | × |
| | 7 | ○ | ○ | ○ | ○ | ○ | × | × | × | × | × | × | × |
| | 6 | ○ | ○ | ○ | ○ | ○ | ○ | ○ | ○ | ○ | × | × | × |
| | 5 | ○ | ○ | ○ | ○ | ○ | ○ | ○ | ○ | ○ | ○ | ○ | ○ |
| | 4 | △ | △ | △ | △ | △ | △ | △ | △ | △ | △ | △ | △ |

| HARDNESS (DEGREES) | | 50 | | | | | | | | |
|---|---|---|---|---|---|---|---|---|---|---|
| THICKNESS (mm) | | 2.7 | 2.8 | 2.9 | 3.0 | 3.1 | 3.2 | 3.3 | 3.4 | 3.5 |
| EXTENSION (%) | 10 | × | × | × | × | × | × | × | × | × |
| | 9 | × | × | × | × | × | × | × | × | × |
| | 8 | × | × | × | × | × | × | × | × | × |
| | 7 | × | × | × | × | × | × | × | × | × |
| | 6 | × | × | × | × | × | × | × | × | × |
| | 5 | ○ | × | × | × | × | × | × | × | × |
| | 4 | △ | △ | △ | △ | △ | △ | △ | △ | × |

FIG. 28

| HARDNESS (DEGREES) | | 60 | | | | | | | | | | | |
|---|---|---|---|---|---|---|---|---|---|---|---|---|---|
| THICKNESS (mm) | | 1.5 | 1.6 | 1.7 | 1.8 | 1.9 | 2.0 | 2.1 | 2.2 | 2.3 | 2.4 | 2.5 | 2.6 |
| EXTENSION (%) | 10 | × | × | × | × | × | × | × | × | × | × | × | × |
| | 9 | × | × | × | × | × | × | × | × | × | × | × | × |
| | 8 | × | × | × | × | × | × | × | × | × | × | × | × |
| | 7 | ○ | ○ | ○ | × | × | × | × | × | × | × | × | × |
| | 6 | ○ | ○ | ○ | ○ | ○ | × | × | × | × | × | × | × |
| | 5 | ○ | ○ | ○ | ○ | ○ | ○ | ○ | ○ | ○ | × | × | × |
| | 4 | △ | △ | △ | △ | △ | △ | △ | △ | △ | △ | △ | △ |

| HARDNESS (DEGREES) | | 60 | | | | | |
|---|---|---|---|---|---|---|---|
| THICKNESS (mm) | | 2.7 | 2.8 | 2.9 | 3.0 | 3.1 | 3.2 |
| EXTENSION (%) | 10 | × | × | × | × | × | × |
| | 9 | × | × | × | × | × | × |
| | 8 | × | × | × | × | × | × |
| | 7 | × | × | × | × | × | × |
| | 6 | × | × | × | × | × | × |
| | 5 | × | × | × | × | × | × |
| | 4 | △ | △ | △ | × | × | × |

FIG. 29

| HARDNESS (DEGREES) | | 70 | | | | | | | | | | | |
|---|---|---|---|---|---|---|---|---|---|---|---|---|---|
| THICKNESS (mm) | | 1.5 | 1.6 | 1.7 | 1.8 | 1.9 | 2.0 | 2.1 | 2.2 | 2.3 | 2.4 | 2.5 | 2.6 |
| EXTENSION (%) | 10 | × | × | × | × | × | × | × | × | × | × | × | × |
| | 9 | × | × | × | × | × | × | × | × | × | × | × | × |
| | 8 | × | × | × | × | × | × | × | × | × | × | × | × |
| | 7 | × | × | × | × | × | × | × | × | × | × | × | × |
| | 6 | ○ | ○ | ○ | × | × | × | × | × | × | × | × | × |
| | 5 | ○ | ○ | ○ | ○ | ○ | ○ | × | × | × | × | × | × |
| | 4 | △ | △ | △ | △ | △ | △ | △ | △ | △ | △ | △ | △ |

| HARDNESS (DEGREES) | | 70 | | | | | |
|---|---|---|---|---|---|---|---|
| THICKNESS (mm) | | 2.7 | 2.8 | 2.9 | 3.0 | 3.1 | 3.2 |
| EXTENSION (%) | 10 | × | × | × | × | × | × |
| | 9 | × | × | × | × | × | × |
| | 8 | × | × | × | × | × | × |
| | 7 | × | × | × | × | × | × |
| | 6 | × | × | × | × | × | × |
| | 5 | × | × | × | × | × | × |
| | 4 | × | × | × | × | × | × |

FIG. 30

| HARDNESS (DEGREES) | | 80 | | | | | | | | | | | |
|---|---|---|---|---|---|---|---|---|---|---|---|---|---|
| THICKNESS (mm) | | 1.5 | 1.6 | 1.7 | 1.8 | 1.9 | 2.0 | 2.1 | 2.2 | 2.3 | 2.4 | 2.5 | 2.6 |
| EXTENSION (%) | 10 | × | × | × | × | × | × | × | × | × | × | × | × |
| | 9 | × | × | × | × | × | × | × | × | × | × | × | × |
| | 8 | × | × | × | × | × | × | × | × | × | × | × | × |
| | 7 | × | × | × | × | × | × | × | × | × | × | × | × |
| | 6 | × | × | × | × | × | × | × | × | × | × | × | × |
| | 5 | ○ | ○ | ○ | × | × | × | × | × | × | × | × | × |
| | 4 | △ | △ | △ | △ | △ | △ | △ | △ | × | × | × | × |

| HARDNESS (DEGREES) | | 80 | | | | | |
|---|---|---|---|---|---|---|---|
| THICKNESS (mm) | | 2.7 | 2.8 | 2.9 | 3.0 | 3.1 | 3.2 |
| EXTENSION (%) | 10 | × | × | × | × | × | × |
| | 9 | × | × | × | × | × | × |
| | 8 | × | × | × | × | × | × |
| | 7 | × | × | × | × | × | × |
| | 6 | × | × | × | × | × | × |
| | 5 | × | × | × | × | × | × |
| | 4 | × | × | × | × | × | × |

SHEET CONVEYING DEVICE, AND IMAGE FORMING APPARATUS INCLUDING SAME

PRIORITY STATEMENT

The present patent application claims priority under 35 U.S.C. §119 from Japanese Patent Applications No. 2006-273391 filed on Oct. 4, 2006 and No. 2006-290216 filed on Oct. 25, 2006 in the Japan Patent Office, the contents and disclosures of which are hereby incorporated by reference herein in their entirety.

BACKGROUND

1. Field

Example embodiments of the present invention generally relate to a sheet conveying device effectively conveying various types of sheets, an image forming apparatus such as a copier, a facsimile machine, a printer, a printing machine, an inkjet recording device, a scanner provided with the sheet conveying device, and a multifunctional machine combining functions of at least two of the above.

2. Discussion of the Related Art

In order to reduce the overall sizes of related-art image forming apparatuses including copiers such as a PPC (plain paper copier) and an electrophotographic copier, facsimile machines, printers, printing machines, and inkjet recording devices, the sizes of conveying units provided therein also tend to be reduced.

Specifically, a conveying unit is used for conveying a recording medium or a sheet-type recording medium onto which an image is formed (hereinafter, referred to as "sheet"). The sheet is fed from a sheet storing unit or a sheet accommodating unit in which sheets are stacked and is conveyed to a main body of an image forming apparatus.

In reference to FIG. 1, example operations of an image forming apparatus and a sheet storing unit provided in the image forming apparatus are described.

FIG. 1 shows an example of a known monochrome copier 100 serving as an image forming apparatus.

The copier 100 in FIG. 1 includes a main body 102 thereof, a sheet feeding device 103 on which the main body 102 of the copier 100 is mounted, an image scanning device 104 attached on the main body 102 of the copier 100, a sheet eject tray 109, a fixing device 111, a transfer device 113, and a sheet reversing device 142.

The main body 102 of the copier 100 includes an image forming section for performing a given image forming process based on a scanned original image.

The sheet feeding device 103 supplies one sheet S at a time to the main body 102 of the copier 100. The sheet feeding device 103 includes a sheet conveying device 105. The sheet conveying device 105 includes a first conveying unit 106 and a second conveying unit 107 and is configured to feed and convey the sheets S stored in sheet feeding cassettes 151 of the sheet feeding device 103.

The image scanning device 104 scans an original image and sends information of the original image to the main body 102 of the copier 100.

The sheet eject tray 109 receives and holds (or stacks) sheets that have passed through the main body 102 of the copier 100.

The fixing device 111 fixes a transferred toner image onto a sheet.

The transfer device 113 transfers a toner image from a circumferential surface of a photoconductor 110A of an image forming device 110 onto a sheet, and conveys the sheet to which an unfixed toner image is transferred to the downstream side of a sheet conveying path Ra of the sheet reversing device 142.

The sheet reversing device 142 conveys a sheet back and forth along the sheet conveying path Ra and/or a sheet conveying path Rb and a reverse conveying path Rc to reverse the sides of the sheet S.

In the copier 100 of FIG. 1, a pickup roller 160 picks up a sheet S placed on top of a stack of sheet stacked and stored in one of the sheet feeding cassettes 151. When two or more sheets S are picked up by the pickup roller 160, one sheet in contact with a feed roller 161 of the first conveying unit 106 is separated from the other sheet(s) in contact with a reverse roller 162 of the first conveying unit 106. Then, the sheet S separated and fed by the feed roller 161 is conveyed to a pair of grip rollers 181 of the second conveying unit 107 disposed in a downstream side of the first conveying unit 106. The sheet S conveyed to the pair of grip rollers 181 abuts a leading edge thereof against a position immediately before a nip contact of a pair of registration rollers 121 disposed at a downstream side in a travel direction of the sheet S. When the leading edge of the sheet S abuts against the above-described position, the sheet S stops to change its position so as to provide a given bend at the leading edge thereof and to prevent skew or positional instability thereof. At a given timing in synchronization with a completion of an image forming operation on the photoconductor 110A, the pair of registration rollers 121 again starts to convey the sheet S to the transfer device 113.

The copier 100 of FIG. 1 employs a feed reverse roller (FRR) sheet separation mechanism, which uses a return separating method. However, a mechanism of separating and feeding a sheet at a separation position is not limited to the FRR sheet separation mechanism. For example, a sheet separation mechanism using a frictionally resisting member or a friction pad sheet separation mechanism that has a simple and inexpensive configuration can be applied to the sheet separation mechanism for the copier 100 of FIG. 1.

To reduce a time period from which the sheet S is fed from the sheet feeding cassette 151 to which the sheet S is ejected to the sheet eject tray 109, the sheet conveying path Ra extending from the sheet feeding device 103 to the fixing device 111 is directed to a substantially vertically upward direction or a direction substantially perpendicular to a horizontal direction.

A common conveying path is also provided so that the reversed sheet S can be conveyed through the reverse conveying path Rc of the sheet revering device 142 to the pair of registration rollers 121.

Further, a manual sheet feeding tray 167 is provided outside the main body 102 of the copier 100, below the reverse conveying path Rc. The manual sheet feeding tray 167 includes a sheet feeding roller 167A, and separating rollers 167B and 167C. The sheet S fed from the manual sheet feeding tray 167 is conveyed toward the pair of grip rollers 181 provided in the vicinity of the upper one of the sheet feeding cassettes 151. Accordingly, the common conveying path is provided before the pair of grip rollers 181 of the upper sheet feeding cassettes 151.

In recent years, a shorter distance from the sheet feeding device 103 to the pair of registration rollers 121 is highly demanded to further reduce the size of the copier 100. To meet the demand, a removal of the pairs of grip rollers 181 from the vicinity of the upper and lower sheet feeding cassettes 151 of the sheet feeding device 103 is taken into consideration.

The inventors of the present application therefore conducted a test to evaluate a sheet feeding operation after removing the pairs of grip rollers 181 from the sheet feeding device 103. Consequently, the inventors found that the removal of the pair of grip rollers 181 decreased a sheet conveying force of the sheet S, increased a slip rate of the sheet S, and caused a paper jam to occur before the pair of grip rollers 181. The evaluation resulted in a decrease of reproduction of copies or prints. The inconvenience was more obvious especially when a relatively high rigid sheet such as a cardboard recording medium was conveyed. According to the test result, the inventors of the present invention found the pair of grip rollers 181 is necessary to the copier 100.

Furthermore, the related-art image forming apparatuses generally accommodate various sheet sizes and sheet types. For example, sheets of different sizes and different types are previously stored in multiple sheet storing units. A sheet is fed from the sheet storing unit selected by a user or automatically selected by an image forming apparatus. In such a configuration, each sheet storage unit occupies a large space in the related-art image forming apparatus, and therefore, it is particularly necessary to reduce the size of the related-art conveying unit.

One approach is to have a conveying path between the sheet storing unit and a main body of a related-art image forming apparatus that considerably bends or changes its direction midway depending on the relative positions of the sheet storing unit and the main body, so as to reduce the space occupied by the conveying path. Thus, in order to change the conveying direction in a continuous and smooth manner in the conveying path, the conveying path is provided with a curved section. The curved section includes a relatively small curvature radius so that a regular-sized recording sheet normally used in the related-art image forming apparatus can be conveyed.

In one technique or a first technique used in a sheet feeding device of a related-art image forming apparatus, sheet feed trays serving as sheet storing units are arranged beneath a main body of an image forming apparatus. Given numbers of sheets of given sheet sizes and sheet types are stacked in the sheet storing units. In between the sheet storing units and the main body of the related-art image forming apparatus, a sheet conveying unit is provided for extracting a sheet in a substantially horizontal direction from the selected sheet storing unit and feeding the extracted sheet in an upward direction toward the main body of the image forming apparatus disposed above.

A sheet in a sheet storing unit is separated from the stack of sheets by a related-art FRR (Feed Reverse Roller) sheet separation mechanism, and is sent to the main body of the image forming unit through a conveying path provided with a curved section including an upper guide plate and a lower guide plate, each of which serves as a guide member for fixing a curved section. As the sheet is conveyed further on, the sheet is pressed from above by the upper guide plate. The sheet is conveyed by an elastically deformable guide piece positioned at the outlet end of the lower guide plate and reaches a pair of conveying rollers. Hereinafter, the upper guide plate and the lower guide plate are referred to as the "guide member for fixing a curved section."

However, in the sheet conveying device with the above-described configuration, the following problem arises when conveying a specific type of sheet with high rigidity, such as a cardboard recording paper or an envelope. That is, when the sheet bends and moves along the curved section, such a highly rigid recording paper or special paper receives a much greater resistance compared to a regular sheet such as a plain paper used for copying. This is because the curved section in the conveying path has a small radius. As a result, the highly rigid sheet cannot smoothly move along the conveying path, causing a paper jam or a conveyance failure. Thus, the sheet feeding operation cannot be reliably performed.

In order to facilitate the understanding of the related art and its problems, a description is now given of further details of the above-described conveyance operation.

When the leading edge of the sheet in the sheet conveying direction reaches the guide member for fixing a curved section configured with the upper guide plate and the lower guide plate, the front half of the sheet including the leading edge of the sheet curves or bends in its thickness direction. Accordingly, when a highly rigid sheet is conveyed, a large force resists this bending action, in such a manner that a large resistance obstructs the sheet conveying operation. As a result, the leading edge of the highly rigid sheet may not reach the pair of conveying rollers at the downstream side of the sheet conveying direction, with the result that the sheet may be conveyed only by a pair of rollers on the upstream side thereof. However, when the sheet is bent by the guide member, the conveying force of the pair of rollers alone may be insufficient for conveying the highly rigid sheet to counter to the resistance caused by the bending action. As a result, the following conveyance failures may be caused. Specifically, the sheet is caused to move in an oblique manner because the center-line of the highly rigid sheet does not match the center-line of the conveying path, or a paper jam occurs because the highly rigid sheet is caught inside the guide member and stops moving.

Accordingly, the above-described sheet feeding device with the first technique has been proposed. In the sheet feeding device, a sheet is sent out from a first conveying member then conveyed to a second conveying member disposed at a position downstream in the conveying direction and substantially vertically above the first conveying member. A pair of linear guide members is provided between the first conveying member and the second conveying member, and the sheet is conveyed by being guided by these linear guide members. In this sheet feeding device, the guide members do not have curved shapes but have linear shapes, and therefore, the conveyance load can be maintained at a low level. That is, the load can be prevented from rising abruptly so that conveyance failures such as a paper jam or oblique movements can be prevented.

That is, according to the above-described sheet feeding device, the conveyed sheet is not deformed or bent only at one position, but is deformed at two positions, i.e., near the front and the back ends of the linear guide members in the sheet conveying direction. Furthermore, the linear guide members are disposed obliquely at substantially intermediate angles, so that the sheet may bend by the same amount at the above-described two positions. Therefore, the conveyance load is prevented from rising abruptly. Specifically, the sheet changes its traveling direction by bending at the two positions, namely, when the sheet is passed from the pair of rollers located at the upstream side of the sheet conveying or traveling direction to the linear guide member, and when the sheet is passed from the linear guide member to the pair of rollers located at the downstream side of the traveling direction. Thus, the sheet bends by smaller extents at these two positions than when the sheet abruptly bends at one position only. Thus, the resistance caused by the bending action of the sheet can be reduced at each of the two positions, thereby preventing the conveyance load from rising abruptly.

Another type of sheet feeding device with a first conveying member and a second conveying member having substantially the same configurations as the above-described sheet feeding device employing the first technique is described as follows.

This sheet feeding device employing another technique or a second technique includes a reverse guiding member provided at an incline between the first conveying member and the second conveying member. This reverse guiding member is configured to move toward the second conveying member.

In this sheet feeding device, when the trailing edge of the sheet contacts the reverse guiding member, the reverse guiding member shifts its position in a direction substantially according to the trailing edge of the sheet. This shift makes it possible to absorb the shock or impact caused when the trailing edge of the sheet contacts the reverse guiding member. Hence, a flipping noise can be reduced.

Yet another type of sheet feeding device with a technique or a third technique different from the first and second techniques has been proposed. This sheet feeding device employing the third technique includes multiple sheet storing units for storing sheets, and each of the sheet storing units is provided with a conveying path and a sheet conveying unit. The ends of the conveying paths merge into a common conveying path. Each of the conveying paths has a curved section at the end thereof, at which each conveying path merges with the common conveying path. At least one of the conveying paths provided for a sheet storing unit that stores or accommodates highly rigid sheets has a first curved section with a larger curvature radius than those of the other conveying paths.

Therefore, in this sheet feeding device, highly rigid sheets are caused to bend more moderately compared to plain paper sheets. A highly rigid sheet moves along the conveying path and passes via the first curved section having a large curvature radius, so that the sheet may not bend as much as a plain paper sheet passing via a curved section having a smaller curvature radius. Accordingly, it is possible to reduce the resistance while conveying a highly rigid sheet, so that the sheet can be conveyed to the common conveying path without being suspended or stopped.

Now, a sheet reversing unit employing another technique is described. The sheet reversing unit is provided in a related-art image forming apparatus. This sheet reversing unit includes a pair of reverse rollers and a reverse conveying path for conveying and guiding a sheet received from the pair of reverse rollers. The reverse conveying path includes a redirection section for changing the direction of conveying a sheet. Rotatable members or rollers are arranged inside the redirection section in a direction orthogonal or perpendicular to the sheet conveying direction, so that a sheet sent into the reverse conveying path can be sent out while abutting the rollers.

According to this sheet reversing unit, when a sheet is sent inside, it is ensured that the portion of the sheet inside the redirection section contacts the rollers, and the rollers are caused to rotate by or following the movement of the sheet in the conveying direction. Thus, compared to a related-art guiding plate, the conveying resistance can be reduced. Specifically, it is possible to eliminate a frictional resistance occurring between a fixed guiding member and the moving sheet while changing the conveying direction of the sheet at the redirection section.

However, the technology used in the copier 100 in FIG. 1 may require the pair of grip rollers 181 to prevent paper jams that can occur before the pair of grip rollers 181. The configuration of the copier 100 with the pair of grip rollers 181 may degrade the sheet conveying properties for conveying relatively rigid sheets by reducing space at a turning or a curved section of a conveying path from the feed roller 161 and the reverse roller 162 of the first conveying unit 106 of the sheet feeding device 103 to the pair of grip rollers 181. As a result, especially when a relatively rigid sheet S such as a cardboard recording paper is conveyed, the leading edge of the sheet S may abut against a lower circumferential surface of an outer one, or a roller on the right side in FIG. 1, of the pair of grip rollers 181 and/or a distance from the pair of grip rollers 181 to the pair of registration rollers 121 may be reduced. Therefore, the sufficient space for bending the leading edge of the sheet S by abutting against the position immediately before the nip contact of the pair of registration rollers 121 cannot be obtained. Accordingly, skew and positional misregistration at the leading edge of the sheet S may be caused.

However, the sheet conveying device of the sheet feeding device using the first technique merely provides a fixed member for guiding a conveyed sheet, and thus does not eliminate the speed difference between the moving conveyed sheet and the fixed guiding member. Accordingly, regardless of the shape or position of the guiding member, resistance occurs in such a direction as to obstruct the sheet from being conveyed, which generating a conveyance load.

That is, this related-art configuration is insufficient for preventing conveyance failures or paper jams. Although the linear guiding member can reduce the conveyance load from rising abruptly, a conveyance load is generated nonetheless. Particularly when conveying a highly rigid sheet, such as a cardboard recording paper or an envelope, conveyance failures and paper jams frequently occur and flipping noises made by the trailing edge of the sheet increase considerably.

Furthermore, as described in reference to the sheet feeding device with the second technique, the reverse guiding member can shift or change its position in a direction according to the trailing edge of the sheet contacting the reverse guiding member. However, the reverse guiding member merely functions as a fixed guiding member in terms of changing the direction of the sheet. Accordingly, as with the related-art configuration described above, this related-art technique does not eliminate the relative speed difference between the sheet and the reverse guiding member when changing the direction of the sheet and guiding the sheet, thus generating a conveyance load. Particularly when conveying a highly rigid sheet, such as a cardboard recording paper or an envelope, conveyance failures and paper jams frequently occur and flipping noises caused by the trailing edge of the sheet increase considerably.

Furthermore, as described in reference to the sheet feeding device with the third technique, the conveying path with a large curvature radius dedicated to highly rigid sheets makes it possible for sheets traveling therethrough to bend moderately so as to reduce the conveyance resistance applied by the conveying path to the sheet. However, a conveyance load is still generated nonetheless, and therefore, particularly when conveying a highly rigid sheet, such as a cardboard recording paper or an envelope, conveyance failures and paper jams frequently occur.

Furthermore, as described in reference to the sheet reversing unit with the fourth technique, movable members such as rollers are provided at given positions inside the redirection section of the conveying path. Therefore, in the process of conveying the sheet, the frictional resistance between the sheet and the guiding member can be effectively reduced while the internal rollers are supporting the middle portion of the sheet between the leading edge and the trailing edge. However, there are no measures provided for reducing the conveyance load before and after the sheet is supported by the internal rollers, i.e., when the sheet is in contact with the conveying path outside the redirection section. Furthermore, no particular description is made of movements of the leading edge and the trailing edge of the sheet while being conveyed. Particularly when conveying a highly rigid sheet such as a cardboard recording paper or an envelope, conveyance failures and paper jams frequently occur and flipping noises caused by the trailing edge of the sheet increase considerably.

SUMMARY

In light of the foregoing, the inventors of the present application propose to provide, in at least one embodiment, a sheet conveying device and an image forming apparatus including a sheet conveying device that can reduce or even eliminate at least one of the drawbacks of the above-described techniques. In at least one embodiment, a sheet conveying device is provided that is compact and space-saving, that includes a simple configuration achieved at low cost, that can handle various types of sheets, and that can reserve or secure sufficient distance and space for bending a leading edge of a sheet, and an image forming apparatus that includes such sheet conveying device.

One or more embodiments of the present invention has been made, taking the above-described circumstances into consideration.

An embodiment of the present invention provides a sheet conveying device that includes a first conveying unit to convey a sheet in a first sheet conveying direction, a second conveying unit, disposed on a downstream side of the first conveying unit in the first sheet conveying direction, to convey the sheet conveyed by the first conveying unit in a second sheet conveying direction, different from the first sheet conveying direction, and including a moving and guiding unit and a rotary conveyance unit facing each other and forming a sheet holding section therebetween to hold and convey the sheet, a first sheet conveying path provided between the first conveying unit and the second conveying unit, the moving and guiding unit being disposed on an outer side of thereof to move and guide the sheet to the sheet holding section, a registration unit, disposed on a downstream side of the second conveying unit in the first sheet conveying direction, to change a positional condition of the sheet conveyed by the second conveying unit. The moving and guiding unit and the rotary conveyance unit are disposed in a vicinity of the first conveying unit such that a distance between the second conveying unit and the registration unit is increased.

The sheet conveying device may further include a second sheet conveying path different from the first sheet conveying path provided between an upstream side of the second conveying unit and the second conveying unit, and a common conveying path provided to a position where the first sheet conveying path and the second sheet conveying path merge. The moving and guiding unit may be disposed along an outer side of the common conveying path.

The moving and guiding unit may include a belt conveying unit including a belt to convey the sheet to the sheet holding section and at least a pair of rotary belt holding members to rotatably hold the belt. The belt conveying unit may be disposed so that a leading edge of the sheet is held in contact with a conveying surface of the belt, except that a portion the leading edge of the sheet is supported by the pair of rotary belt holding members.

The moving and guiding unit may include a belt conveying unit including a belt to convey the sheet to the sheet holding section, a first rotary belt holding member disposed facing the rotary conveyance unit sandwiching the belt therebetween, and a second rotary belt holding member disposed facing the first rotary belt holding member and disposed at an upstream side of the first rotary belt holding member in the second sheet conveying path. The second rotary belt holding member may be disposed on an outer side of the common conveying path.

The rotary conveyance unit may include a rotary conveyance driving unit configured to rotate to transmit a driving force. The belt of the moving and guiding unit may rotate with the rotary conveyance driving unit to convey the sheet.

The first conveying unit may include a rotary sheet feeding member to rotationally feed the sheet and a frictionally resisting member pressed to contact the rotary sheet feeding member, and the rotary sheet feeding member and the frictionally resisting member separate and feed the sheet from a stack of sheets accommodated in a sheet feeding device.

An image forming apparatus including the sheet conveying device.

At least one embodiment of the present invention provides a sheet conveying device that includes a first conveying unit to convey a sheet in a first sheet conveying direction, and a second conveying unit, disposed on a downstream side of the first conveying unit in the first sheet conveying direction, to convey the sheet conveyed by the first conveying unit in a second sheet conveying direction different from the first sheet conveying direction. The second conveying unit includes a rotary conveyance driving unit configured to rotate to transmit a driving force and a belt conveying unit disposed on an outer side of a sheet conveying path provided between the first conveying unit and the second conveying unit and forms a sheet holding section between the rotary conveyance driving unit and the belt conveying unit. The belt conveying unit includes a belt, including an elastic member, to rotate with the rotary conveyance member to convey the sheet to the sheet holding section, at least a pair of rotary belt holding members to rotatably hold the belt, and a belt supporting member configured to rotatably support each of the pair of rotary belt holding members to maintain a constant distance between the pair of rotary belt holding members. The belt has a hardness in a range of from approximately 40 degrees to approximately 80 degrees, and when the belt is spanned around the pair of rotary belt holding members, an extension rate of an extended circumferential length of the belt to a normal circumferential length of the belt is in a range of from approximately 5% to approximately 10%.

At least one embodiment of the present invention provides a sheet conveying device that includes a first conveying unit to convey a sheet in a first sheet conveying direction, a second conveying unit, disposed on a downstream side of the first conveying unit in the first sheet conveying direction, to convey the sheet conveyed by the first conveying unit in a second sheet conveying direction different from the first sheet conveying direction, a first sheet conveying path provided between the first conveying unit and the second conveying unit, a second sheet conveying path, different from the first sheet conveying path, provided between an upstream side of the second conveying unit and the second conveying unit, and a common conveying path provided to a position where the first sheet conveying path and the second sheet conveying path merge. The second conveying unit includes a rotary conveyance driving unit, to rotate to transmit a driving force, and a belt conveying unit, disposed on an outer side of the common conveying path and forms a sheet holding section between the rotary conveyance driving unit and the belt conveying unit. The belt conveying unit includes a belt, including an elastic member, to rotate with the rotary conveyance driving unit to convey the sheet to the sheet holding section, at least a pair of rotary belt holding members to rotatably hold the belt, and a belt supporting member to rotatably support each of the pair of rotary belt holding members to maintain a constant distance between the pair of rotary belt holding members. The belt has a hardness in a range of from approximately 40 degrees to approximately 80 degrees, and when the belt is spanned around the pair of rotary belt holding members, an extension rate of an extended circumferential length of the belt to a normal circumferential length of the belt is in a range of from approximately 5% to approximately 10%.

BRIEF DESCRIPTION OF THE DRAWINGS

The accompanying drawings are intended to depict example embodiments of the present invention and should not be interpreted to limit the scope thereof. The accompanying drawings are not to be considered as drawn to scale unless explicitly noted.

A more complete appreciation of the disclosure and many of the attendant advantages thereof will be readily obtained as the same becomes better understood by reference to the following detailed description when considered in connection with the accompanying drawings, wherein:

FIG. 26 is a table of the test results showing a relation of the thickness and extension rate of a conveyor belt having the rubber hardness of 40 degrees;

FIG. 27 is a table of the test results showing a relation of the thickness and extension rate of a conveyor belt having the rubber hardness of 50 degrees;

FIG. 28 is a table of the test results showing a relation of the thickness and extension rate of a conveyor belt having the rubber hardness of 60 degrees;

FIG. 29 is a table of the test results showing a relation of the thickness and extension rate of a conveyor belt having the rubber hardness of 70 degrees;

FIG. 30 is a table of the test results showing a relation of the thickness and extension rate of a conveyor belt having the rubber hardness of 80 degrees.

DETAILED DESCRIPTION OF EXAMPLE EMBODIMENTS

Figure 1:
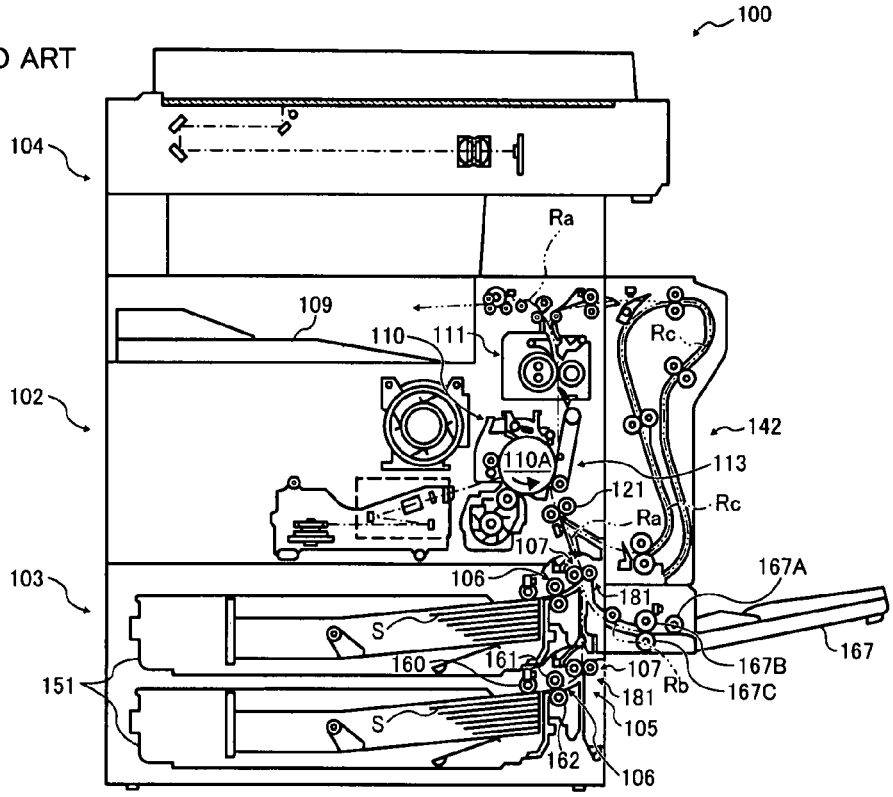
FIG. 1 BACKGROUND ART
FIG. 1 is a cross-sectional view of a schematic entire configuration of a related-art image forming apparatus.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, example embodiments of the present invention are described.

Now, example embodiments of the present invention are described in detail below with reference to the accompanying drawings.

Descriptions are given, with reference to the accompanying drawings, of examples, example embodiments, modification of example embodiments, etc., of a sheet conveying device according to the present invention, and an image forming apparatus including the same. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of example embodiments of the present invention.

FIGS. 2 through 11 show schematic structures and functions of examples of sheet conveying devices to which the present invention is applied, and an image forming apparatus including the same.

Figure 2:
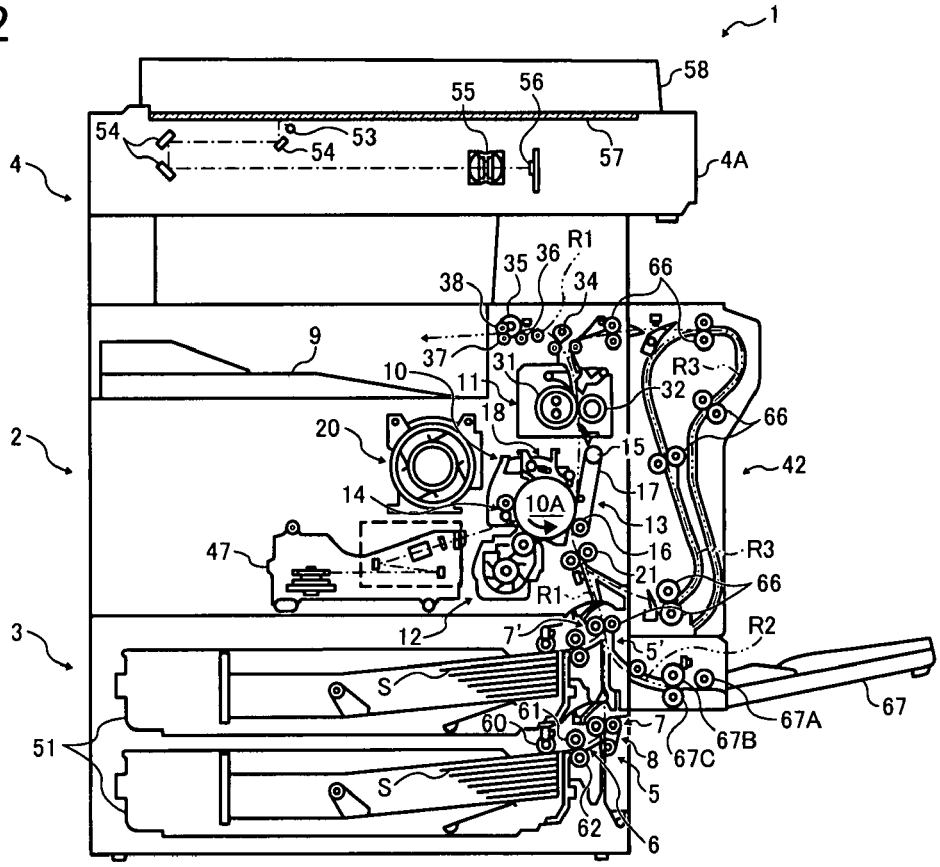
FIG. 2 is a cross-sectional view of a schematic entire configuration of an image forming apparatus, according to an example embodiment of the prevent invention.

Referring to FIG. 2, an overall configuration of a copier 1 serving as an image forming apparatus is described according to an example of the present invention.

The copier 1 is a monochrome copier that scans an image from a face of an original document and forms a copied image onto various sheet-type recording media (hereinafter, referred to as "sheet") such as recording paper, transfer paper, paper sheets, and OHP (overhead projector) transparencies.

The copier 1 includes a main body 2 thereof, a sheet feeding device 3 on which the main body 2 of the copier 1 is mounted, and an image scanning device 4 attached on the main body 2 of the copier 1.

The main body 2 of the copier 1 includes an image forming section for performing a given image forming process based on a scanned original image.

The sheet feeding device 3 supplies one sheet S at a time to the main body 2 of the copier 1.

The image scanning device 4 scans an original image and sends information of the original image to the main body 2 of the copier 1.

A sheet eject tray 9 is provided at the upper portion of the main body 2 of the copier 1, forming a space beneath the image scanning device 4. Sheets that have passed through the main body 2 of the copier 1 are ejected to and stacked on the sheet eject tray 9.

A sheet conveying path R1 extends from the sheet feeding device 3 to the sheet eject tray 9. A large proportion of the sheet conveying path R1 may extend between the sheet feeding device 3 and the upper portion of the main body 2 in a substantially vertical direction with respect to a substantially horizontal direction.

Sheet conveying units including pairs of conveying rollers and pairs of subordinate rollers may be provided along the sheet conveying path R1 with given intervals therebetween determined according to the smallest size of sheet S. Some of these sheet conveying units may be configured to sandwich or hold the sheet S to ensure that the sheet S continues to be conveyed along the sheet conveying path R1.

Furthermore, the sheet feeding device 3 includes a sheet conveying device 5 configured to feed and convey the sheets S stored in paper trays of the sheet feeding device 3.

Inside the main body 2 of the copier 1, a photoconductor unit 10 serving as an image forming device and a fixing device 11 serving as an image fixing device, both of which are included in the image forming section, are disposed in this order from the upstream side toward the downstream side of the sheet conveying path R1. As the sheet S is conveyed from the upstream side toward the downstream side of the sheet conveying path R1, the photoconductor unit 10 may transfer a toner image that is generated onto the sheet S and the fixing device 11 may fix the transferred toner image onto the sheet S. The sheet S on which the toner image is fixed may be ejected onto the eject tray 9 that is disposed at the end of the sheet conveying path R1.

The photoconductor unit 10 includes a single drum-type photoconductor 10A serving as an image carrier. The photoconductor 10A is supported by a side panel, not shown, inside the main body 2 of the copier 1 so as to rotate around a substantially horizontal axis.

The photoconductor 10A has a cylindrical shape of a given diameter and a generally known configuration. The photoconductor 10A may receive a rotational driving force from a driving source such as a motor provided on one end of the photoconductor 10A, either on the photoconductor unit 10 side or on the main body 2 of the copier 1. Accordingly, the photoconductor 10A may rotate in a direction indicated by an arrow shown in FIG. 2 at a steady and constant speed.

Around the photoconductor 10A, elements are disposed in the following order in direction indicated by the arrow, which is an order of a developing device 12, a transfer device 13, a photoconductor cleaning device 18, a discharging device, not shown, and a charging device 14. Within a range corresponding to one rotation of the photoconductor 10A in the counterclockwise direction, there are a developing position, a transferring position, a cleaning position, a discharging position, and a charging position from upstream to downstream positions for each of the above-described devices, which are the developing device 12, the transfer device 13, the photoconductor cleaning device 18, the charging device, and the charging device 14.

Between the charging position and the developing position, there is a latent image forming position. An exposing device 47 is provided at a position somewhat spaced apart from and diagonally downward from the photoconductor 10A. At the latent image forming position, the exposing device 47 may emit a given laser beam to irradiate the photoconductor 10A so as to form an invisible latent image thereon according to image data. In synchronization with the rotation of the photoconductor 10A in the counterclockwise direction, the above-described image forming components and the exposing device 47 may perform interlinked operations so as to execute a sequence of an image forming process in cooperation with each other.

The developing device 12 has an appropriate, generally known configuration including a developing roller for generating a toner brush by causing toner particles to stand erect on the surface of the developing device 12 in a radial direction. The developing device 12 may cause the toner particles at the tips of the toner brush to adhere onto the latent image formed on a given position on the surface of the photoconductor 10A, as the latent image moves in a circumferential direction of the photoconductor 10A and pass through the developing position in accordance with the rotation of the photoconductor 10A. Accordingly, the invisible latent image may be turned into a visible and monochrome toner image.

The transfer device 13 includes two supporting rollers 15 and 16 spaced apart from each other in a substantially vertical direction and a transfer belt 17, which is an endless belt stretched around the supporting rollers 15 and 16. The transfer device 13 may transfer the toner image from the circumferential surface of the photoconductor 10A onto the sheet S, and convey the sheet S onto which an unfixed toner image is transferred to the downstream side of the sheet conveying path R1. Specifically, a portion of the lower supporting roller 16 where the transfer belt 17 may be stretched around is pressed against a substantially diagonally downward right portion of the photoconductor 10A, and the transferring position corresponds to a position at which the surface of the photoconductor 10A and the transfer belt 17 contact to each other. The upper supporting roller 15 is disposed in front of the inlet of the fixing device 11.

The photoconductor cleaning device 18 may include either one or both of a blade, not shown, and a rotating brush, not shown. The blade may have a blade edge at the tip thereof that abuts against the cleaning position on the photoconductor 10A while maintaining a given pressure level. The rotating brush may contact the cleaning position and be caused to rotate following the rotation of the photoconductor 10A. The photoconductor cleaning device 18 may remove toner or foreign materials remaining on the surface of the photoconductor 10A after the transfer operation.

The discharge device is primarily configured with a lamp that can emit a light beam of a given light intensity. This lamp may irradiate a light beam used for the discharging onto the discharging position to neutralize the charged surface of the photoconductor 10A passing by the discharging position. Accordingly, the discharge device can initialize the surface potential of the photoconductor 10A that had passed by the transferring portion.

The fixing device 11 includes a heating roller 31 with a built-in electrothermal heater serving as a heat source and a pressing roller 32 facing and pressed against the heating roller 31 in a substantially horizontal direction. When the heating roller 31 is rotated by a driving source, not shown, such as a motor, the pressing roller 32 in contact with the heating roller 31 may be caused to rotate following the rotation of the heating roller 31. At the same time, the portion at which the heating roller 31 and the pressing roller 32 contact each other may have a given heating temperature and given pressure so as to function as a nip contact for fixing the toner image onto the sheet.

In FIG. 2, the main body 2 of the copier 1 further includes a toner storing container 20, which is a toner bottle storing unused and/or new toner. A toner conveying path, not shown, may extend from the toner storing container 20 to the developing device 12. When the developing device 12 has consumed the toner provided therein and there is a toner shortage, the newly replenished toner may be supplied from the toner storing container 20 into the developing device 12.

The sheet feeding device 3 is provided beneath the main body 2 of the copier 1, so that the sheet size can be chosen automatically or according to a user's manual input. The sheet feeding device 3 includes multiple sheet feeding cassettes 51 serving as sheet storing units arranged therein in multiple stages. Each of the sheet feeding cassettes 51 can be individually pulled outside of the sheet feeding device 3 so as to be replenished with an appropriate number of sheets corresponding to that individual sheet feeding cassette 51. Different types of sheets S that are of various sheet sizes and oriented in vertical or horizontal directions with respect to the sheet conveying direction are stacked and/or stored in the sheet feeding cassettes 51.

The image scanning device 4 includes a main body 4A thereof serving as a framework of the image scanning device 4. On top of the main body 4A, an exposure glass 57 is disposed across a given range. A scanning unit may be housed inside the main body 4A of the image scanning device 4 for optically scanning an original image by scanning the given range of the exposure glass 57. The scanning unit primarily includes at least a first moving member 53, a second moving member 54, and image forming lens 55, and a scanning sensor 56 such as a CCD.

The image scanning device 4 includes a platen cover 58 configured to open and close between a closed position covering the exposure glass 57 and an open position. The platen cover 58 is disposed on the top surfaced of the main body 4A of the image scanning device 4. The platen cover 58 has larger length/width sizes than those of the exposure glass 57, and one side thereof is fixed to the top surface of the main body 4A of the image scanning device 4 so as to freely open and close.

On the basis of the above-described configuration, the copier 1 may be operated as described below.

First, in order to make a copy of an original document with the copier 1, a user manually opens the platen cover 58 of the image scanning device 4 from the closed position to the open position, places and sets the original document on the exposure glass 57, and then manually brings the platen cover 58 to the closed position, so that the platen cover 58 can press the original document set on the exposure glass from above. Accordingly, the original document spreads out in a planar manner in close contact with the exposure glass 57 so that the original document face can be scanned accurately, and the original document can be fixed on the exposure glass 57.

As the user presses a start key of an operation panel section, not shown, initially provided in the copier 1, a scanning operation of the image scanning device 4 immediately starts, and a driving mechanism, not shown, causes the first moving member 53 and the second moving member 54 to travel. A light beam from a light source of the first moving member 53 may be emitted toward the original document, and the light beam may be reflected from the original document face and is directed toward the second moving member 54. The light beam may then be reflected by a mirror of the second moving member 54, and the light beam may enter the scanning sensor 56 via the imaging lens 55. As a result, the image of the original document can photoelectrically be converted and scanned by the scanning sensor 56.

When the start key is pressed, the photoconductor 10A of the photoconductor unit 10 starts rotating and an operation starts for forming a toner image on the photoconductor 10A based on the scanned original image. Specifically, as the photoconductor 10A rotates, a given position on the circumferential surface of the photoconductor 10A may sequentially pass by the respective positions between the charging device 14, the exposing device 47, the developing device 12, the transfer device 13, the photoconductor cleaning device 18, and the discharging device. Accordingly, the given position on the photoconductor 10A may be charged to a given charged status, a latent image may be generated thereon, and the latent image may be turned into a visible toner image. The toner image may then be transferred onto the sheet S, residual toner may be removed from the photoconductor 10A, and the charged status may be cancelled. Thus, one cycle of operations may be completed in the above-described order of the developing device 12, the transfer device 13, the photoconductor cleaning device 18, the charging device, and the charging device 14. This cycle is continued until the toner image is created in an area of a given size on the circumferential surface of the photoconductor 10A in the rotational direction, according to the size of the image to be formed.

When the start key is pressed, one sheet S is extracted from the sheet feeding cassette 51 in the sheet feeding device 3 corresponding to the sheet feeding stage storing the type of sheet S selected automatically or manually, and the extracted sheet S may be conveyed to the sheet conveying path R1 via a given sheet conveying path by the sheet conveying device 5 attached to the corresponding sheet feeding stage. This sheet S is conveyed in a substantially vertically upward direction through the sheet conveying path R1 in the main body 2 of the copier 1 by conveying rollers, and may temporarily be stopped when the leading edge of the sheet S abuts against a pair of registration rollers 21 that serves as a registration unit to correct a positional condition of a sheet.

In a case in which a manual sheet feeding operation is performed, the sheet S may set on a manual sheet feeding tray 67, and may be rolled out by the rotation of a sheet feeding roller 67A provided for the manual sheet feeding tray 67. When plural sheets S are stacked and set on the manual sheet feeding tray 67, separating rollers 67B and 67C may separate the sheets S one by one. The sheet is conveyed to a manual sheet feeding path R2, is conveyed from the manual sheet feeding path R2 to the sheet conveying path R1, and is then temporarily stopped when the leading edge of the sheet S abuts against the pair of registration rollers 21.

The pair of registration rollers 21 may start rotating at an accurate timing in synchronization with the relative movement of the toner image on the rotating photoconductor 10A so as to send the sheet S that has been temporarily stopped, into the transferring position. As a result, the toner image may be transferred onto the sheet S by the transfer device 13.

The sheet S, onto which an unfixed monochrome toner image is transferred, may then be conveyed to the fixing device 11 by the transfer belt 17 of the transfer device 13 serving as part of the sheet conveying path R1. The sheet S may pass through a nip contact of the fixing device 11. The nip contact may apply given heat and pressure onto the sheet S so that the image can be fixed onto the sheet S. The sheet S with the fixed image may be guided by a switching claw 34 to the sheet conveying path R1 that extends to the sheet eject tray 9, be ejected onto the sheet eject tray 9 by eject rollers 35, 36, 37, and 38, and be stacked on the sheet eject tray 9. The user can retrieve the sheet S stacked on the sheet eject tray 9 through an opening, which is located between the sheet eject tray 9 and the image scanning device 4 facing the front of the copier 1.

When a double-sided copy mode is selected by a user input, the sheet S with an image fixed on one side thereof may be guided by the switching claw 34 to be conveyed toward a sheet reversing device 42. Plural pairs of rollers 66 and guiding members, not shown, disposed inside the sheet reversing device 42 may convey the sheet S back and forth along a reverse conveying path R3 to reverse the sides of the sheet S. Then, the sheet S may be conveyed from a position in front of the photoconductor unit 10 back to the sheet conveying path R1 through the pair of registration rollers 21. The sheet S may be conveyed upward along the sheet conveying path R1 and guided to the transferring position once again, at which an image is transferred and fixed this time onto the backside of the sheet S. Finally, the sheet S may be ejected onto the sheet eject tray 9 by the eject rollers 35, 36, 37, and 38.

First Example

Figure 3:
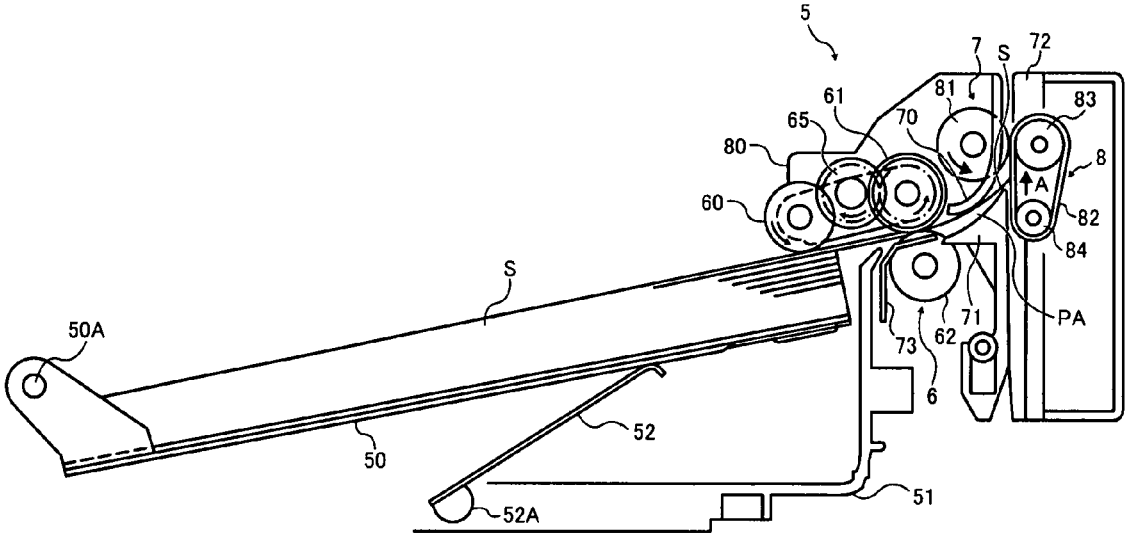
FIG. 3 is an enlarged cross-sectional view of a sheet conveying device, according to an example embodiment of the present invention, of the image forming apparatus of FIG. 2.
Figure 4:
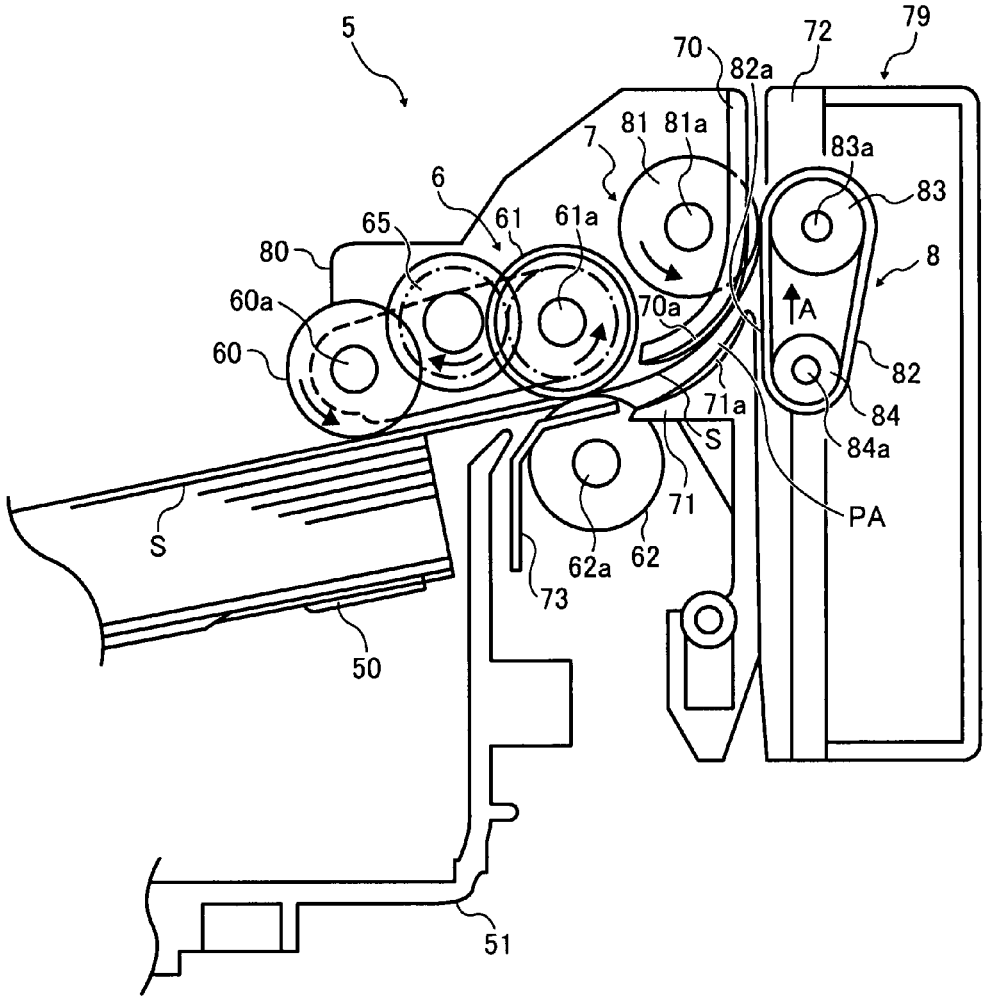
FIG. 4 is an enlarged cross-sectional view of the sheet conveying device of FIG. 3.

Detailed configuration and functions of the sheet conveying device 5 are described according to a first example of the present invention, in reference to FIGS. 3 and 4.

As shown in FIGS. 3 and 4, the sheet conveying device 5 according to the first example of the present invention extracts one sheet S from the stack of sheets S accommodated or stored in the sheet feeding cassette 51 of a given stage (in this example, the lower stage) in the sheet feeding device 3 shown in FIG. 2, changes the sheet conveying direction of the fed sheet S, and conveys the sheet S in a direction perpendicular to a substantially horizontal direction or a substantially vertically upward direction to the pair of registration rollers 21 disposed in the main body 2 of the copier 1.

The sheet conveying device 5 primarily includes a first conveying unit 6, a second conveying unit 7, a first conveying path PA, and the pair of registration rollers 21.

The first conveying unit 6 employs the FRR sheet separation mechanism for conveying the sheet S one by one.

The second conveying unit 7 is disposed on a downstream side of the first conveying unit 6 in the sheet conveying direction. The second conveying unit 7 forms a sheet holding section or nip contact to convey the sheet S received from the first conveying unit 6 in a sheet conveying direction different from the sheet conveying direction of the first conveying unit 6.

The first conveying path PA includes a curved section and is provided between the first conveying unit 6 and the second conveying unit 7.

The pair of registration rollers 21, as previously described, serves as a registration unit to correct a positional condition of the sheet S conveyed from the second conveying unit 7.

In the sheet conveying device 5, both the first conveying unit 6 and the second conveying unit 7 serve as holding and conveying unit to hold and convey the sheet S with a pair of rotary conveyance members.

Specifically, the first conveying unit 6 includes two rotary conveyance members disposed facing each other, namely a feed roller 61 and a reverse roller 62, and serve as a first pair of rotary conveyance members.

The second conveying unit 7 includes two rotary conveyance members disposed facing each other, namely a grip roller 81 and a conveyor belt 82 stretched around a roller-type pulley 83 and a roller-type pulley 84, and serve as a second pair of rotary conveyance members.

At least one of the first conveying unit 6 and the second conveying unit 7 includes a belt conveying unit 8 serving as a moving and guiding unit provided with the conveyor belt 82 to move and guide (convey) the sheet S toward the sheet holding section or nip contact of the second conveying unit 7 while keeping the leading edge of the sheet S in contact with the conveyor belt 82. A conveying surface 82*a* (see FIG. 4), which is a belt traveling surface on the conveyor belt 82 of the belt conveying unit 8, is disposed along an outer side of the first conveying path PA.

As described above, the sheet conveying direction of the first pair of rotary conveyance members including the feed roller 61 and the reverse roller 62 is different from the sheet conveying direction of the second pair of rotary conveyance members including the grip roller 81 and the conveyor belt 82. Specifically, the sheet conveying direction of the first pair of rotary conveyance members is substantially horizontal and directed to a diagonally upward right position, whereas the sheet conveying direction of the second pair of rotary conveyance members is directed in a substantially vertically upward direction, as viewed in FIGS. 3 and 4. Accordingly, the first conveying path PA provided between the first conveying unit 6 and the second conveying unit 7 includes a curved section with a small radius, which can cause the sheet conveying direction to change abruptly in the first conveying path PA.

A more specific description is given of the sheet conveying directions of the first and second conveying units 6 and 7.

Figure 5:
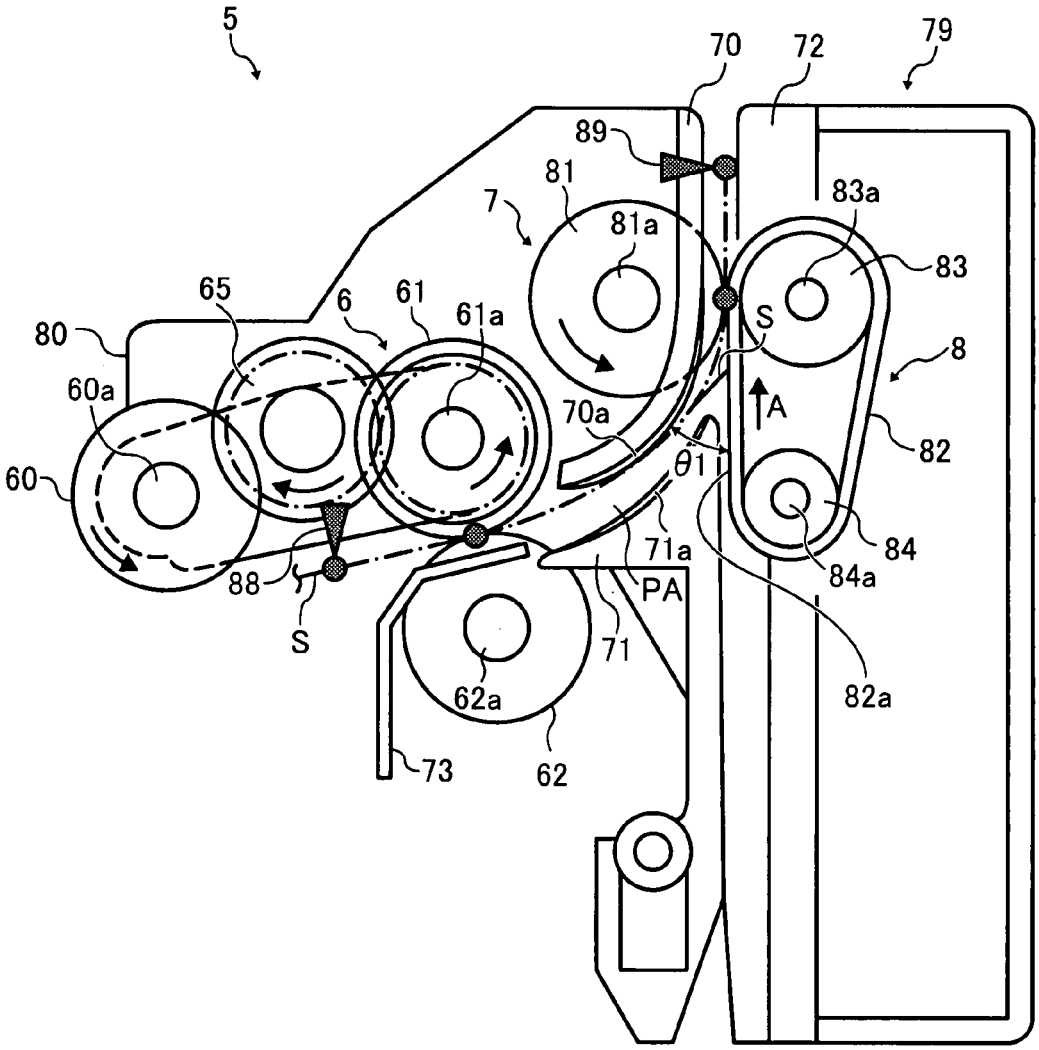
FIG. 5 is an enlarged cross-sectional view of relevant parts, with one conveying path, of the sheet conveying device of FIG. 3.

As shown in FIG. 5, the sheet conveying direction orthogonally intersecting the center of the nip contact of the first conveying unit 6 is substantially horizontal with respect to a line connecting three points, which are the rotational center of the feed roller 61, the rotational center of reverse roller 62, and the sheet holding section (also referred to as "nip contact") of the feed roller 61 and the reverse roller 62.

Similarly, the sheet conveying direction orthogonally intersecting the center of the nip contact of the second conveying unit 7 is substantially vertical with respect to a line connecting three points, which are the rotational center of the grip roller 81, the rotational center of the roller-type pulley 83, and the sheet holding section or the nip contact of the grip roller 81 and the conveyor belt 82.

That is, in the sheet conveying path PA provided between the first conveying unit 6 and the second conveying unit 7, the sheet conveying direction may change. The sheet conveying path includes two opposite surfaces that define the orientation of the conveyed sheet S in the thickness direction of the sheet S. When the sheet S is sent out from the first conveying unit 6, the leading edge of the sheet S may abut against a conveying guiding surface, which is one of the above-described two surfaces. The conveying guiding surface may move continuously and constantly within a given range, starting at least from the position at which the sheet S abuts against the conveying guiding surface, along the lengthwise direction of the sheet conveying direction, toward the sheet holding section of the second conveying unit 7. This conveying and guiding surface corresponds to the belt traveling surface or the conveying surface 82*a* on the conveyor belt 82 of the belt conveying unit 8. In the example embodiment of the present invention, the area surrounded by an extended line along the sheet conveying direction of the first conveying unit 6 and an extended line along the sheet conveying direction of the second conveying unit 7 may be referred to as an "inner area." The rest of the areas may be referred to as an "outer area." "Inner side" and "outer side" refer to a side closer toward the inner area and a side closer toward the outer area, respectively. The conveying surface 82*a* of the conveyor belt 82, which is the planar belt traveling surface used for conveying a sheet, is disposed along the outer edge of the inner area, and substantially intersects the sheet traveling direction.

As shown in FIGS. 3 through 5, the belt conveying unit 8 primarily includes the conveyor belt 82, and the roller-type pulley 83, and the roller-type pulley 84. The pulleys 83 and 84 may be a pair of rotary belt holding members for rotatably holding the conveyor belt 82.

The roller-type pulley 83 serves as a first rotary belt holding member. The roller-type pulley 83 is disposed opposite to the sheet holding section or nip contact formed between the grip roller 81 and the conveyor belt 82, so as to movably retain and span the conveyor belt 82.

The roller-type pulley 84 serves as a second rotary belt holding member. The roller-type pulley 84 is disposed opposite to the roller-type pulley 83 and at an upstream side of the sheet conveying direction of the second conveying unit 7. In the first example of the present invention, the second rotary belt holding member is disposed in a single unit. However, the second rotary belt holding member is not limited in a single unit. That is, a plurality of second rotary belt holding members can be applied to the present invention.

It is imperative that the belt conveying unit 8 be disposed in such a manner that the leading edge of the sheet S conveyed from the first conveying unit 6 abuts against or contacts the conveying surface 82*a*, at portions of the conveying surface 82*a* other than portions at which the conveyor belt 82 is held by the roller-type pulley 83 and the roller-type pulley 84. As shown in FIG. 4, the belt conveying unit 8 is disposed in such a manner that the axial center of the roller-type pulley 84 or a center of a pulley shaft 84*a* is disposed above the bottom edge of the reverse roller 62 and beneath the height of the downstream end of a guide surface 71*a* of a conveying guide member 71. Accordingly, the leading edge of the sheet S may collide with the abdominal portion (i.e., an "effective conveying portion") of the conveyor belt 82, where the conveyor belt 82 constantly and appropriately becomes elastically displaced and/or deformed (when colliding with the sheet S), so that the leading edge of the sheet S does not bounce back. Hence, it is ensured that the leading edge of the sheet S is kept in abutment with the conveying surface 82*a* (also referred to as "belt conveying surface 82*a*") of the conveyor belt 82, so that the effects described below can be achieved.

If the belt conveying unit 8 is disposed in such a manner that the leading edge of the sheet S abuts or contacts the conveyor belt 82 at the portions at which the conveyor belt 82 is held by or in contact with the roller-type pulley 83 and the roller-type pulley 84, the following problem may arise. That is, the hardness of the portions at which the conveyor belt 82 is held by the roller-type pulley 83 and the roller-type pulley 84 are generally greater than the abdominal portion of the conveyor belt 82, and thus the positions do not become elastically displaced and/or deformed as much as the abdominal portion. Hence, this arrangement is disadvantageous as the sheet S bounces back from the conveyor belt 82 because the conveyor belt 82 may not be constantly and appropriately become elastically displaced and/or deformed when the leading edge of the sheet S abuts against the portions at which the conveyor belt 82 is held by the roller-type pulleys 83 and 84. The same applies to other examples and modified example according to the present invention described below (hereinafter, also described as "the same applies to other examples").

Furthermore, as shown in FIG. 5, it is imperative that the belt conveying unit 8 be disposed in such a manner that the leading edge of the sheet S conveyed from the first conveying unit 6 approaches the conveying surface 82*a* at an acute collision angle θ1. By arranging the belt conveying unit 8 in such a manner, the leading edge of the sheet S may constantly abut the abdominal portion of the conveyer belt 82. Accordingly, it is ensured that the leading edge of the sheet S is kept in contact with the conveying surface 82*a*, so that the effects described below can be achieved.

If the belt conveying unit 8 is disposed in such a manner that the leading edge of the sheet S approaches the conveying surface 82*a* at a substantially perpendicular or orthogonal collision angle, the leading edge of the sheet S may abut against the conveying surface 82*a* in an irregular manner. For example, the sheet S may bend in the opposite direction to which the conveyor belt 82 is moving or the sheet S may bound back from the conveyer belt 82. Hence, this arrangement is disadvantageous (the same applies to other examples).

Each of the sheet feeding cassettes 51 in the stages of the sheet feeding device 3 may have a planar shape large enough to store the maximum size of the sheet S used in the copier 1. Each of the sheet feeding cassettes 51 is a substantially flat box with an upper opening and a bottom plate 50 provided at the bottom thereof serves as a sheet stacking unit. The rear end of the bottom plate 50, which is located on the left side as viewed in FIG. 3, is fixed to a horizontal shaft 50A supported by the sheet feeding cassette 51 so that the bottom plate 50 can freely rotate within a given angle range, i.e., so as to pivot back and forth or to oscillate. The free end of the bottom plate 50, which is located on the right side as viewed in FIG. 3, can pivot back and forth about the horizontal shaft 50A inside the sheet feeding cassette 51.

At the bottom of the sheet feeding cassette 51, there is a hollow section of a given shape. A rising arm 52 is provided in the hollow section. The rear end of the rising arm 52 is fixed to a horizontal shaft 52A so that the rising arm 52 can freely rotate within a given angle range, i.e., so as to pivot back and forth, in the hollow section. The horizontal shaft 52A may receive a driving force from a rotational driving source, not shown, causing the horizontal shaft 52A to rotate in arbitrary directions. As the horizontal shaft 52A rotates, the rising arm 52A may be caused to pivot about the horizontal shaft 52A to come to a given tilted position. Accordingly, the free end of the rising arm 52 may push up the bottom plate 52 so that one edge of the topmost face of the sheet S stacked on the bottom plate 50 can be maintained at a given height.

As described above, the sheet feeding cassette 51 stacks or stores the sheets S on the bottom plate 50 and stored therein. Furthermore, the free end of the bottom plate 50 on the right side as shown in FIG. 3 may rise so that the bottom plate 50 may tilt and the sheet S stacked thereon can be pushed up. Therefore, even if the sheets S are fed out one by one and the number of stacked sheet decreases, the topmost surface of the sheets S can be maintained at a given height.

As described above, the sheet feeding cassette 51 can be freely attached to or detached from the main unit of the sheet feeding device 3, namely, the sheet feeding cassette 51 can be inserted in or removed from the main unit of the sheet feeding device 3. Specifically, the sheet feeding cassette 51 can be set at an inserted position in the main unit of the sheet feeding device 3 as shown in FIG. 2 so that the sheet feeding can be performed. The sheet feeding cassette 51 can be pulled out and detached from the main unit of the sheet feeding device 3 toward the front as shown in FIG. 2 to a detached position, so that sheets S can be supplied or sheets S can be replaced with sheets S of a different size.

At least the first conveying unit 6, the second conveying unit 7, and the sheet conveying path formed between the first conveying unit 6 and the second conveying unit 7 may remain in the main body 2 of the copier 1 even when the sheet feeding cassette 51 is pulled out. The copier 1 serving as an image forming apparatus of the first example is an in-body paper eject type (i.e., the sheet eject tray 9 is located within the main body 2 of the copier 1). However, when the belt conveying unit 8 serving as the moving and guiding unit is provided, the curved section of the conveying path of this example embodiment can be kept equal to or less than that employing a general technique. Hence, the width of the image forming apparatus does not need to be increased, so that the advantage of the in-body paper eject type may not be diminished.

A pickup roller 60, which is shown in FIGS. 2 through 5, is axially rotatably supported by a housing 80, shown in FIGS. 3 through 5, which includes the outer shape of a structure provided on the main unit of the sheet feeding device 3, in such a manner that the pickup roller 60 contacts the topmost face of the sheets S raised to the given height. On an extended line along the direction to which the pickup roller 60 extracts the sheet S, a sheet separation mechanism may be provided for separating one sheet S from the stack of sheets S and for feeding out the separated sheet S. In the sheet separation mechanism, the feed roller 61 and the reverse roller 62 may contact each other by a given pressure level to form a nip contact therebetween.

As illustrated in FIG. 4, the pickup roller 60 can be a known roller that is integrally fixed around a shaft 60*a* that is integrally formed with a cored bar, not shown, and is supported together with the shaft 60*a* so as to freely rotate. Alternatively, a one-way clutch, not shown, can be provided between the shaft 60*a* and the cored bar, and the pickup roller 60 can be supported so as to freely rotate with respect to the shaft 60*a* when the pickup roller 60 is not driven. The circumferential section of the pickup roller 60 including its circumferential surface is made of a soft and highly frictional material such as rubber, which has a high frictional coefficient with respect to the sheet S, so as to easily pick up the sheet S by contacting the sheet S. Furthermore, in order to increase the frictional resistance, substantially sawtooth-shaped projections can be formed over the entire circumferential surface of the pickup roller 60.

There are various sheet separation mechanisms for separating a sheet S from a stack of sheets S to prevent multi-feeding of sheets, i.e., prevent plural sheets from being sent out at once. In this example embodiment, the FRR sheet separation mechanism, which is a return separating method, is employed. Specifically, when two or more sheets S are picked up by the pickup roller 60, one sheet in contact with the feed roller 61 may be separated from the other sheet in contact with the reverse roller 62. The feed roller 61 may continue to send the sheet S in contact therewith in the sheet conveying direction while the reverse roller 62 returns the other sheet in the opposite direction to the sheet conveying direction, back to the original position on the stack of sheets. Furthermore, the reverse roller 62 may be disposed not to obstruct the sheet conveying operation performed by the feed roller 61.

Figure 12:
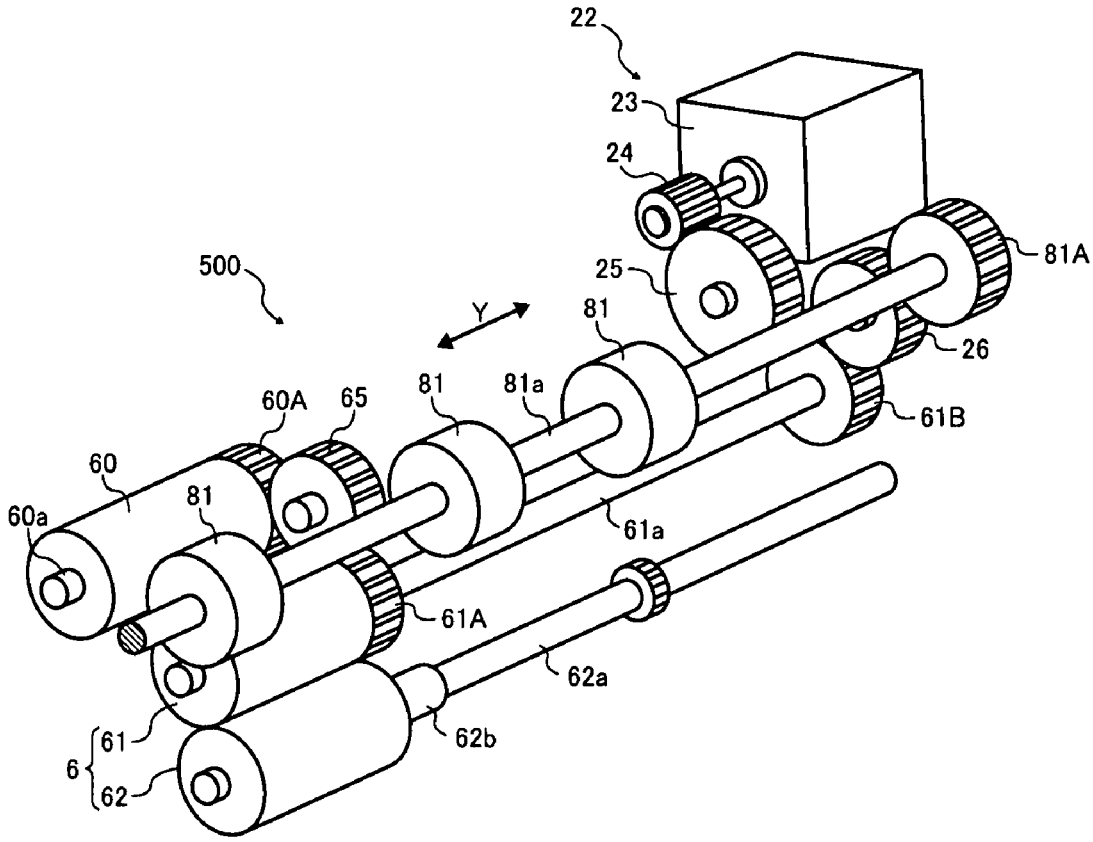
FIG. 12 is a schematic perspective view of a driving mechanism of the sheet conveying device of FIG. 8.

More specifically, the FRR sheet separation mechanism as a sheet separating mechanism includes the feed roller 61 that is rotated in the forward direction of the sheet conveying direction and the reverse roller 62 that is rotated in the reverse direction by receiving a rotational driving force in the reverse direction via a torque limiter 62*b*, see FIG. 12. The feed roller 61 may contact the top face of the topmost sheet S fed out from the bottom plate 50, while the reverse roller 62 contacts the bottom face of at least one sheet S under the feed roller 61.

The feed roller 61 can be a roller that is integrally fixed around a shaft 61*a* that is integrally formed with a cored bar, not shown, and is supported together with the shaft 61*a* so as to freely rotate. Alternatively, the feed roller 61 can be supported in a similar manner to the pickup roller 60.

Similarly to the pickup roller 60, the circumferential section of the feed roller 61, including its circumferential surface, is made of a soft and highly frictional material such as rubber, which has a high frictional coefficient with respect to the sheet S, so as to easily convey the sheet S in the sheet conveying direction by contacting the sheet S. Furthermore, in order to increase the frictional resistance, substantially sawtooth-shaped projections can be formed over the entire circumferential surface of the feed roller 61.

The reverse roller 62 is integrally formed with a cored bar, not shown, and is supported together with a reverse roller driving shaft 62*a* by the housing 80 so as to freely rotate by receiving a rotational driving force via the torque limiter 62*b* (see FIG. 12).

In the FRR sheet separation mechanism, the reverse roller 62 may receive a low level of torque in a direction opposite to that of the rotational direction of the feed roller 61 via the torque limiter 62*b*. Therefore, when the reverse roller 62 is held in contact with the feed roller 61, or when one sheet S enters in between the feed roller 61 and the reverse roller 62, the reverse roller 62 may rotate following the rotation of the feed roller 61. That is, the function of the torque limiter 62*b* may cause the reverse roller 62 to slip on the reverse roller driving shaft 62*a*, so that the reverse roller 62 can rotate in a forward direction in the sheet feeding direction, similarly to the feed roller 61. Conversely, when the reverse roller 62 is separated from the feed roller 61 or when two or more sheets S enter in between the feed roller 61 and the reverse roller 62, the reverse roller 62 may rotate in the opposite direction. Therefore, when more than one sheet S enters in between the feed roller 61 and the reverse roller 62, the reverse roller 62 may return the sheet S other than the topmost sheet S in contact with the feed roller 61, i.e., the sheets S in contact with the reverse roller 62, toward the upstream side of the sheet conveying direction. Accordingly, it is possible to prevent multi-feeding of sheets S or feeding more than one sheet S at once.

Therefore, the conveying force applied from the reverse roller 62 to the sheet S in contact therewith is large enough in the reverse direction for returning the sheet S to its original position on the stack of sheets S. However, this conveying force is sufficiently smaller than the conveying force applied from the feed roller 61 to the sheet S for conveying the sheet S in the forward direction, so as not to obstruct the feed roller 61 from conveying the sheet S in the forward direction. Due to the above-described configuration, the conveying force applied from the feed roller 61 to the sheet S can be reduced by the opposite conveying force applied from the reverse roller 62 to the sheet S.

In FIGS. 3 through 5, the sheet conveying device 5 further includes an idler gear 65 that is joined to a driving shaft that outputs a rotational driving force from a driving source provided in the main unit of the sheet feeding device 3. The idler gear 65 may distribute and transmit a rotational driving force supplied from the sheet feeding device 3 through the engagement of gears or through a belt to the pickup roller 60 and the feed roller 61 to rotate then at given speeds.

At a diagonally upper position of the feed roller 61, the grip roller 81 is provided as the other rotary conveyance member of the second pair of rotary conveyance members including the second conveying unit 7. The grip roller 81 is rotatably supported by the housing 80 via a rotational driving shaft 81*a* integrally provided with the grip roller 81. Similarly to the feed roller 61, the circumferential section of the grip roller 81 including its circumferential surface is made of a soft and highly frictional material such as rubber, which has a high frictional coefficient with respect to the sheet S, so as to easily convey the sheet S in the sheet conveying direction by contacting the sheet S.

The pulley 83 is provided in the vicinity of the grip roller 81. The pulley 83 is axially rotatably supported by the housing 80 so as to contact the circumferential surface of the grip roller 81 via the conveyor belt 82, facing the grip roller 81 in a horizontal direction.

The pulley 83 is integrally formed with a pulley shaft 83*a*, and is rotatably supported together with the pulley shaft 83*a* by the housing 80. The pulley 84 is disposed at a diagonally downward left position of the pulley 83, and is axially rotatably supported by the housing 80. The pulley 84 is integrally formed with a pulley shaft 84*a*, and is rotatably supported and held together with the pulley shaft 84*a* by the housing 80. The pulleys 83 and 84 serve as the rotary belt holding members for rotatably holding the conveyor belt 82.

The arrangement of the belt conveying unit 8 is not limited to the above-described descriptions. The belt conveying unit 8 can be arranged as follows. In FIGS. 4 and 5, the sheet conveying device 5 further includes an opening and closing guide 79 that opens and closes with respect to the housing 80. The opening and closing guide 79 is part of the main unit of the sheet conveying device 5. The opening and closing guide 79 is integrally mounted to a unit with a conveying guide member 72, which will be described later, and the belt conveying unit 8 and serves as an opening and closing unit. The opening and closing guide 79 may open and close by pivoting about a fulcrum shaft hinge, not shown, below the housing 80 so that the conveyor belt 82 can be separated from the grip roller 81, making it easier for a user to resolve a paper jam in the first conveying path PA or the vertical conveying path extending substantially upward.

The pulley 83, the pulley 84, and their respective pulley shafts 83*a*, 84*a*, are rotatably supported by the opening and closing guide 79 when the sheet conveying device 5 of the copier 1 is provided with the opening and closing guide 79.

The opening and closing guide 79 shown in FIGS. 4 and 5 is provided with the belt conveying unit 8 including the conveyor belt 82 arranged in a continuous or discontinuous manner along the sheet width direction so as to contact the entire width or at least both width ends of the sheet S.

The conveyor belt 82 is an endless belt stretched around the pulleys 83 and 84, as described above. The axes of the pulleys 83 and 84 are spaced apart by a given distance. The linear belt traveling surface or the conveying surface 82*a* of the conveyor belt 82 between the pulleys 83 and 84 is disposed at a position to ensure that the linear belt traveling surface thereof is contacted by the leading edge of the sheet S sent out from the first conveying unit 6. As described above, the circumferential surface, which is the conveying surface 82*a*, of the conveyor belt 82 stretched around the circumferential surface of the pulley 83 may directly contact the circumferential surface of the grip roller 81 at a given pressure level. The portion at which the conveyor belt 82 contacts the grip roller 81 corresponds to the sheet holding section or nip contact. More specifically, a pressuring member, not shown, (e.g., springs 92 shown in FIG. 15 described later) may be attached to a bearing member or supporting member, not shown, (e.g., belt supporting members 86 shown in FIG. 15 described later) for supporting the pulley shaft 83*a*. This forcing unit may press the conveyor belt 82 against the grip roller 81.

The conveyor belt 82 is made of an elastic material such as rubber. The frictional coefficient of the surface of the conveyor belt 82 may be specified a given value with respect to the conveyed sheets S. The frictional coefficient is defined by characteristics of the material of the conveyor belt 82 itself or by treating the surface with an appropriate process. Specifically, the frictional coefficient may be specified to ensure that an outer circumferential surface or the conveying surface 82*a* of the conveyor belt 82 may transmit a conveying and propelling force to the face of the sheet S in contact with the conveyor belt 82, without allowing the sheet face to slip along the conveying surface 82*a* of the conveyor belt 82.

The belt width of the conveyor belt 82 in a sheet width direction perpendicular or orthogonal to the sheet conveying direction may be at least substantially equal to the width of a maximum size sheet to be conveyed. That is, the belt width of the conveyor belt 82 may substantially be equal to or wider than the width of a maximum size sheet to be conveyed. The sizes in the sheet width direction or axial lengthwise direction of the pulleys 83 and 84 around which the conveyor belt 82 is stretched and the grip roller 81 facing and contacting the conveyor belt 82 are equal to or larger than the above-described belt width of the conveyor belt 82. Hence, it is ensured that the entire width of the sheet S sent out from the first conveying unit 6 contacts the conveyor belt 82, so that the contact area therebetween can be increased. Accordingly, it is possible to increase the conveying and propelling force for conveying the sheet S in conveying direction. The conveying and propelling force may constantly be transmitted to the sheet S from the conveyor belt 82 moving in the sheet conveying direction.

A rotational driving source, not shown, such as an electric motor provided specifically for rotating the grip roller 81 is connected to the rotational driving shaft 81*a* of the grip roller 81 via a driving force transmitting unit, not shown, such as a gear or a belt. Configurations in which the rotational driving source and the driving force transmitting unit are included are shown later (in FIGS. 12 and 13). The grip roller 81 may be rotated by receiving a rotational driving force of a given rotational speed from the rotational driving source via the driving force transmitting unit. Accordingly, the grip roller 81 serves as a driving roller, while the conveyor belt 82 in contact with the grip roller 81 may serve as a subordinate belt that is caused to move following the rotation of the grip roller 81 serving as the driving roller, and the pulley 83 supporting the contact portion between the conveyor belt 82 and the grip roller 81 from inside the belt may serve as a subordinate roller that is caused to rotated via the subordinate belt or the conveyor belt 82. As a matter of course, the pulley 84 may also serve as a subordinate roller that is caused to rotate via the subordinate belt or the conveyor belt 82.

Alternatively, a rotary conveyance driving unit of a driving mechanism can be removed to leave the grip roller 81 to serve as a subordinate roller and a different driving unit can be provided to drive the conveyor belt 82. Detailed description of such a rotary conveyance driving unit of a driving mechanism will be given later in reference to FIGS. 12 and 13.

As shown in FIGS. 3 through 5, a conveying guiding member 70 is positioned in the inner area of the sheet conveying device 5, including a curved guide surface 70*a* (FIGS. 4 and 5) swelling in a substantially downward direction with which the sheet S comes in contact. The conveying guide member 71 is positioned in the outer area of the sheet conveying device 5, including the guide surface 71*a* curved in a caved-in or concave shape in accordance with the conveying guiding member 70. Furthermore, the conveying guide member 71 is spaced apart with a given gap from the guide surface 70*a* of the conveying guiding member 70. The conveying guiding members 70 and 71 are both fixed to the housing 80. Accordingly, the first conveying path PA is formed between the first conveying unit 6 and the second conveying unit 7, by arranging the guide surface 70*a* of the conveying guide member 70, the guide surface 71*a* of the conveying guide member 71 facing the conveying guiding member 70, and the conveying surface 82*a* of the conveyor belt 82 as described above.

As shown in FIGS. 3 through 5, the conveying guide member 72 is positioned along the outer side of the vertical conveying path extending substantially upward from the second conveying unit 7. A conveying guide member 73 may provide a sheet conveying path from the sheet feeding cassette 51 to the sheet holding section or nip contact between the feed roller 61 and the reverse roller 62, and provide an inlet for guiding the sheet S into the nip contact. Accordingly, the vertical conveying path communicating with or connected to the sheet conveying path R1 is formed by the vertical conveying guide surface of the conveying guide member 72 and the guide surface 70*a* of the conveying guiding member 70. The curved surface or guide surface 70*a* of the conveying guiding member 70 may swell in a substantially downward direction (toward the conveying guide member 71 provided on the outer side), beneath a line connecting the nip contacts of the first conveying unit 6 and the second conveying unit 7. The degree of swelling is defined so that the sheet S can moderately bend to ensure that the leading edge of the sheet S reaches the conveying surface 82*a*.

As shown in FIG. 2, the configuration of the upper stage of the sheet feeding device 3 is the same as that of a known technique. The difference from the lower stage described above is that a sheet conveying device 5' is employed instead of the sheet conveying device 5. The sheet conveying device 5' is different from the sheet conveying device 5 in that the sheet conveying device 5 employs a second conveying unit 7' instead of the second conveying unit 7. The second conveying unit 7' is different from the second conveying unit 7 in that the second pair of rotary conveyance members only includes the grip roller 81 and a subordinate roller that is caused to rotate following the rotation of the grip roller 81, which is practically the same size and shape as the pulley 83. The sheet feeding cassette 51 of the upper stage and the sheet conveying device 5' can be used for sheets S of a relatively low rigidity such as plain paper and not for sheets S of a relatively high rigidity such as cardboard recording papers or envelopes.

Next, a description is given of a sheet feeding operation of feeding a sheet S from a given stage in the sheet feeding device 3 and a conveying operation of conveying the sheet S of the sheet conveying device 5 that starts in conjunction with the sheet feeding operation.

As shown in FIG. 3, the sheets S stacked on the bottom plate 50 may be raised by the pivoting and rising movement of the rising arm 52 so that the topmost face can be located at a given height. First, the pickup roller 60 rotates to extract the topmost sheet S, and sends the topmost sheet S to the sheet separation mechanism including the feed roller 61 and the reverse roller 62. In the sheet separation mechanism, the feed roller 61 and the reverse roller 62 may cooperate with each other to separate only the topmost sheet from the others. The separated sheet S may be conveyed to the downstream side of the sheet conveying path. As shown in FIG. 3, the leading edge of the sheet S may be guided and moved as the conveyor belt 82 travels in the direction indicated by the arrow while being kept in contact with the belt conveying surface 82*a*. When the leading edge of the sheet S reaches the nip contact between the grip roller 81 and the conveyor belt 82, the grip roller 81 and the conveyor belt 82 may hold the sheet S and convey the sheet S further vertically upward, and finally send out the sheet S in a vertical manner.

More specifically, the leading edge of the sheet S is held by the nip contact of the feed roller 61 and the reverse roller 62, sent out from the nip contact, and then reaches the belt conveying surface 82*a* of the conveyor belt 82.

As shown in FIGS. 3 through 5, as the conveying surface 82*a* may move in the sheet conveying direction by the movement of the conveyor belt 82 in the direction indicated by an arrow "A", the sheet S may gradually bend starting from the leading edge thereof. As the sheet S bends further, the contact area between the belt conveying surface 82*a* and the face of the sheet S may become larger. Hence, even if the sheet S is a highly rigid sheet, a sufficient amount of conveying and propelling force can be applied from the belt conveying surface 82*a* to the face of the sheet S face in order to convey the sheet S in the sheet conveying direction. When conveyance resistance is generated while the highly rigid sheet S is being conveyed and considerably bent, the conveying and propelling force applied to the sheet S by the first conveying unit 6 alone may be insufficient for conveying the sheet S. This insufficiency can be thoroughly compensated for by the conveying and propelling force applied to the sheet S from the belt conveying unit 8. Thus, it is possible to prevent conveyance failures of the sheet S at least between the first conveying unit 6 and the second conveying unit 7 so that the leading edge of the sheet S can reach the nip contact of the second conveying unit 7.

The conveying surface 82*a* of the conveyor belt 82 may continuously extend to the nip contact of the second conveying unit 7, thus ensuring that the leading edge of the sheet S in contact with the conveying surface 82*a* smoothly and constantly reaches the sheet holding section or nip contact. More specifically, a highly rigid sheet S being conveyed by the first conveying unit 6 may be caused to bend moderately so that the leading edge of the sheet S can surely contact the belt conveying surface 82*a*. The belt conveying surface 82*a* may apply an active conveying and guiding effect to the leading edge of the sheet S in contact thereto. Accordingly, the sheet S may receive a second conveying and propelling force from the belt conveying surface 82*a* for moving in the sheet conveying direction. Subsequently, the sheet S may be caused to bend even further so as to reach the sheet holding section of the second conveying unit 7.

After the leading edge of the sheet S has reached the second conveying unit 7, the sheet S is held and conveyed by both the first conveying unit 6 and the second conveying unit 7. Thus, a sufficient amount of conveying force may be applied to the sheet S from both the first conveying unit 6 and the second conveying unit 7. Therefore, it is possible to continue to convey the highly rigid sheet S in a smooth manner. After the trailing edge of the sheet S has been separated from the first conveying unit 6, the sheet S can no longer receive a conveying force from the first conveying unit 6. However, this loss may be compensated for by the conveying and propelling force from the belt conveying surface 82*a* applied once again to the sheet S, depending on how the sheet S is contacting the belt conveying surface 82*a* between the sheet holding section of the second conveying unit 7 and the trailing edge.

Furthermore, the sheet S may gradually become less bent. Therefore, it is possible to continue to convey the sheet S even after the trailing edge of the sheet S has been separated from the first conveying unit 6. Accordingly, in the sheet conveying device 5, it is ensured that the sheet S from the first conveying unit 6 is steadily sent to the second conveying unit 7 and then to the downstream sheet conveying path, regardless of the rigidity of the sheet S.

As described above, the belt conveying unit 8 is disposed along the outer side of the first conveying path PA formed between the first conveying unit 6 and the second conveying unit 7. The belt conveying unit 8 may serve as the moving and guiding unit for moving and guiding the sheet S toward the second conveying unit 7 while keeping the leading edge of the sheet S in contact with the belt.

In the first example, the belt conveying unit 8 serving as the moving and guiding unit may also have a function of changing, with the conveyor belt 82, the conveying direction of the sheet S into a direction toward the sheet holding section or nip contact of the second holding unit 7.

Figure 6:
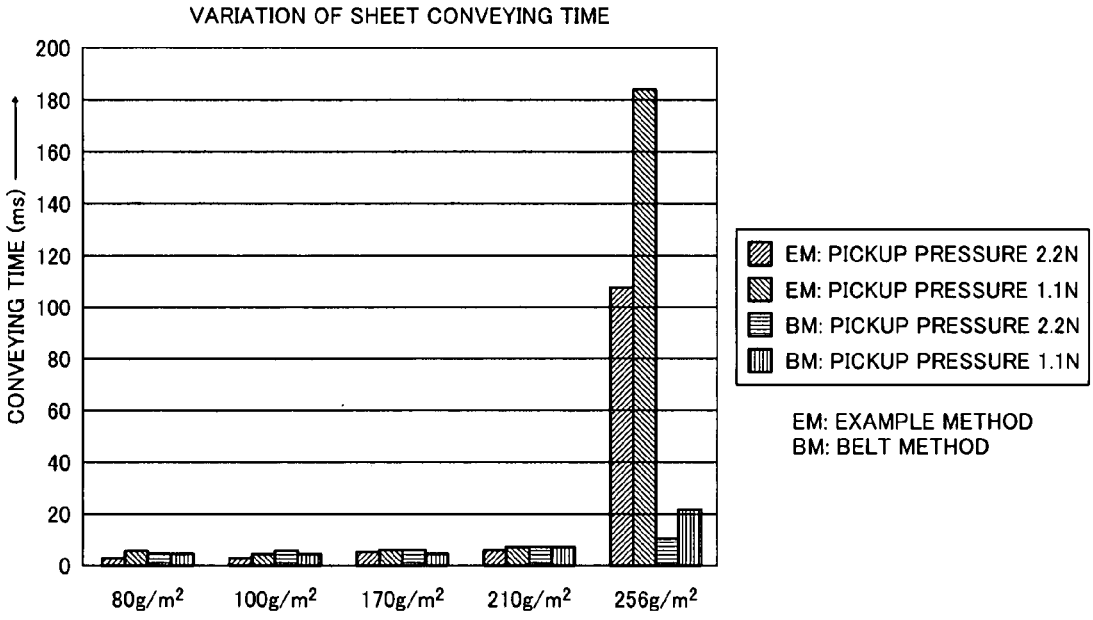
FIG. 6 is a graph showing test results indicating the variation in conveying time with the sheet conveying device of FIG. 3.

Next, in reference to FIG. 6, results of a comparative test on the first example of the present invention is described.

A comparative test was conducted to compare the sheet conveying or passing properties of a copier according to the example embodiment to which the present invention is applied (indicated as "BELT METHOD" in Table 1) and a copier according to a known method (indicated as "EXAMPLE METHOD" in Table 1).

Among the components of "imagio Neo453" manufactured by RICOH, only a sheet feeding device was modified to be used for the "BELT METHOD" of this comparative test. The modified sheet feeding device used for the "BELT METHOD" basically has the same configurations and specifications as that of the sheet conveying device 5 of the sheet feeding device 3 shown in FIGS. 2 through 4.

For the "EXAMPLE METHOD", "imagio Neo453" manufactured by RICOH including a sheet feeding device with a known sheet conveying device was used. Specifically, the known sheet conveying device corresponds to the sheet conveying device 5' of the sheet feeding device 3 shown in FIG. 2. That is, the sheet conveying device for "EXAMPLE METHOD" is different from the sheet conveying device for "BELT METHOD" according to the above-described example embodiment in reference to FIGS. 2 through 4, and includes the roller-type pulley 83 to be the only rotary conveyance member facing and contacting the grip roller 81 and does not include the conveyor belt 82 and the roller-type pulley 84.

Details of the belt conveying unit 8 and peripheral components used for this comparative test in the belt method are described below (components commonly applied to the example method can be included as well):

- Material of conveyor belt 82: ethylene propylene rubber (EPDM);
- Hardness of conveyor belt 82: JIS K6253 A type 40 degrees;
- Frictional coefficient of conveyor belt 82 with respect to sheet: 2.6;
- (Wall) Thickness of conveyor belt 82: 1.5 mm;
- Diameter of pulley 83: 13 mm;
- Diameter of pulley 84: 7 mm;
- Gap or distance between pulleys 83 and 84: 13 mm (distance between axes of pulley shafts 83*a* and 84*a*);
- Extension factor of conveyor belt 82: 7%; and
- Diameter of rollers 60, 61, 62, and 81: all 20 mm.

As the basic test conditions, the weight of a sheet (meter basis weight or grams per square meter ($g/m^2$)) was employed to represent the stiffness (rigidity) of the sheet. Six types of sheets with different weights were passed through the above copies from sheet feeding trays corresponding to the same stages under an environment of normal temperature (23 degree Celsius, relative humidity 50%). Other test conditions described below with reference to FIG. 6 were also applied to test differences in conveying time between the different types of sheets. The test results indicating the differences in conveying time are shown in FIG. 6, and Table 1 indicates a summary of the sheet passing properties based on the test results shown in FIG. 6.

The sheet conveying device 5 shown in FIG. 5 further includes a sheet feeding sensor 88 and a vertical conveyance sensor 89. The sheet feeding sensor 88 detects the leading edge of the sheet S picked up by the pickup roller 60, and the vertical conveyance sensor 89 detects the leading edge of the sheet S conveyed by the second conveying unit 7 for "BELT METHOD" or the pair of the grip roller 81 and the roller-type pulley 83 for "EXAMPLE METHOD". The sheet feeding sensor 88 and the vertical conveyance sensor 89 are both reflection type photo-sensors.

The conveying path length (sheet conveying distance) between the positions at which the sheet feeding sensor 88 and the vertical conveyance sensor 89 are disposed is 57 mm for both in the belt method and the example method. The conveying path length between the position at which the sheet feeding sensor 88 is disposed and the nip contact between the feed roller 61 and the reverse roller 62 is 10 mm. The conveying path length between the nip contact between the feed roller 61 and the reverse roller 62 and the nip contact of the second conveying unit 7 for "BELT METHOD" or between the nip contact between the feed roller 61 and the reverse roller 62 and the nip contact between the grip roller 81 and the roller-type pulley 83 for "EXAMPLE METHOD" is 38 mm for both methods. And, the conveying path length between the nip contact of the second conveying unit 7 for "BELT METHOD" and the position where the vertical conveyance sensor 89 is disposed or between the nip contact between the grip roller 81 and the roller-type pulley 83 for "EXAMPLE METHOD" and the position where the vertical conveyance sensor 89 is disposed to 9 mm for both methods. Accordingly, the total conveying path length is 57 mm for both methods.

The curvature radius at the center of the curved sheet conveying path or first conveying path PA between the first conveying unit 6 and the second conveying unit 7 of the sheet conveying device 5 is 20 mm for both the belt method and the example method.

For both the belt method and the example method, tests were conducted for two different values of a parameter including the pickup pressure or sheet feeding pressure of the pickup roller 60, namely 1.1N and 2.2N. The linear speed of both the feed roller 61 on the driving side and the grip roller 81 on the driving side was 154 mm/s. The time required for the leading edge of the sheet S to be conveyed from the sheet feeding sensor 88 to the vertical conveyance sensor 89, corresponding to 57 mm of the conveying path, was measured for five different types of paper with an oscilloscope. Results indicating differences between the conveyance times between different types of paper are shown in the graph of FIG. 6.

The graph of the test results in FIG. 6 show that in the example method, if the sheet is 256 g/m$^2$ meter basis weight or more, the conveyance time considerably changes or becomes long, and the sheet is caused to slip considerably. Meanwhile, in the belt method to which the present invention is applied, even if the sheet is 256 g/m$^2$ meter basis weight or more, the conveyance time changes only scarcely or does not become as long as the example method, and the sheet is caused to slip only scarcely. Furthermore, if the pickup pressure is reduced, the conveying force decreases. However, in the belt method to which the present invention is applied, the conveying force may not be affected as much even if the pickup pressure is reduced. This means that the pickup pressure can be made smaller by employing the belt method to which the present invention is applied, and therefore, the power of the driving motor can be reduced. As a result, the apparatus can be made compact.

Table 1 summarizes the sheet passing properties based on the test results shown in FIG. 6.

In Table 1, "meter basis weight" corresponds to the weight (grams) of a sheet per one square meter. In general, a sheet with a small meter basis weight is "light paper" or "thin paper", and a sheet with a large meter basis weight is "heavy paper" or "thick paper."

In the first test results shown in Table 1, "GOOD" indicates that "sheet passing property is good." Specifically, "GOOD" means that the leading edge of the sheet S reached the vertical conveyance sensor 89 within a given time after the sheet feeding sensor 88 had turned on and detected the leading edge of the sheet S. Conversely, "POOR" indicates that "sheet passing property is unacceptable." Specifically, "POOR" means that the leading edge of the sheet S did not reach the vertical conveyance sensor 89 within a given time after the sheet feeding sensor 88 had turned on and detected the leading edge of the sheet S.

TABLE 1

| METER BASIS WEIGHT | EXAMPLE METHOD | BELT METHOD |
|---|---|---|
| 80 g/m$^2$ | GOOD | GOOD |
| 100 g/m$^2$ | GOOD | GOOD |
| 170 g/m$^2$ | GOOD | GOOD |
| 210 g/m$^2$ | GOOD | GOOD |
| 256 g/m$^2$ | POOR | GOOD |
| 300 g/m$^2$ | POOR | GOOD |

GOOD: sheet passing good; and
POOR: sheet passing unacceptable.

In the first test results shown in Table 1, if the paper type is 256 g/m$^2$ meter basis weight or more, the results were "POOR" in the example method, whereas all of the results were "GOOD" in the belt method according to the above-described first example to which the present invention is applied shown in FIGS. 2 through 5.

By comparing the sheet passing and conveying properties observed in the test, the inventors have found that, in the example method, if the paper type is 256 g/m$^2$ meter basis weight or more, the sheet may be too stiff to bend along the curved sheet conveying path. Hence, the leading edge of the sheet S may be disadvantageously crushed against the roller-type pulley 83 that faces and contacts the grip roller 81 (see FIGS. 2 through 5).

Furthermore, tests were conducted with sheets of 256 g/m$^2$ meter basis weight or more with coated surfaces and uncoated surfaces to observe whether it makes a difference in sheet passing and conveying properties. However, no particular results distinguishable from those of the first test shown in Table 1 were obtained.

The conclusions described below can be made from the tests results observed in the above-described example embodiment. That is, when a highly rigid sheet that is 256 g/m$^2$ meter basis weight or more is conveyed from the first conveying unit 6 to the conveying surface 82*a* of the belt conveying unit 8 via the first conveying path PA, the following configuration can be achieved. Specifically, because the highly rigid sheet is capable of being conveyed in a rectilinear manner, various guiding members including the first conveying path PA can be made to have simplified shapes so as to reduce the conveyance load resistance, or the various guiding members can be completely omitted.

Therefore, in the sheet conveying device dedicated for conveying the sheet S with a relatively high rigidity, the essential components are the first conveying unit 6, the second conveying unit 7, and the belt conveying unit 8 (moving and guiding unit) for guiding the sheet to the second conveying unit 7 while keeping the leading edge of the sheet S in contact with the belt conveying unit 8. The belt conveying unit 8 is disposed along the outer side of the first conveying path PA (in this case, guiding members are unnecessary) formed between the first conveying unit 6 and the second conveying unit 7.

For the above-described reasons, the various guiding members forming the first conveying path PA are necessary for conveying a sheet S with a relatively low rigidity, such as plain paper (PPC). As such a PPC sheet S cannot be conveyed in a rectilinear manner compared to the case of a highly rigid sheet S such as a cardboard recording paper, the various guiding members of the first conveying path PA are necessary to compensate for this disadvantage in guiding the sheet S to the conveying surface 82*a* of the belt conveying unit 8. That is, as the rigidity of the sheet S becomes lower, the sheet S moves in a less rectilinear manner. Therefore, to assist the sheet S to move in a rectilinear manner, guiding surfaces of the various guiding members in the first conveying path PA may need to have appropriate shapes so as to ensure that the leading edge of the sheet S abuts against the abdominal portion of the conveying surface 82*a* of the conveyor belt 82.

This means that the higher the rigidity of the sheet S (more meter basis weight) becomes, the more flexible the design of the shapes and positions of the various guide members including the sheet conveying path with a curved section of a relatively small curvature radius can be obtained.

The material of the conveyor belt 82 is not limited to that of the above-described comparative test. That is, the material can be, for example, chloroprene rubber, urethane rubber, or silicon rubber. The hardness of the rubber of the conveyor belt 82 can be JIS K6253 A type in a range from 40 degrees to 60 degrees (JIS: Japan Industrial Standard).

According to the results of the above-described comparative test, the sheet conveying device 5 shown in FIGS. 2 through 5 and the copier 1 including the sheet conveying device 5 can provide a configuration thereof that is compact, space-saving, simple, low-cost, and capable of conveying various sheet types. The basic configuration can be made by adding the belt conveying unit 8 provided with a conveyor belt stretched around rollers including one of the second conveying unit 7, and a driving source dedicated to the belt conveying unit 8 can be omitted. Therefore, it is possible to realize a sheet conveying device or the sheet conveying device 5 in an image forming apparatus or the copier 1 that has a simple configuration that is thus low-cost.

In the configuration provided for a known sheet conveying device, a conveyance failure may occur when a highly rigid type of sheet is conveyed. The failure can be caused by a large conveyance resistance generated as the sheet contacts the conveying guiding member 70, or by a conveyance load in the first conveying path PA between the first conveying unit 6 and the second conveying unit 7. However, the sheet conveying device 5 according to this example embodiment of the present invention can convey highly rigid sheets without failures, and can thus convey various sheet types.

Specifically, the known configuration merely provides a fixed member for guiding a sheet, and thus does not eliminate the sheet difference between the conveyed sheet, which is a mobile object, and the fixed guiding member. As a result, a conveyance resistance is constantly generated.

On the contrary, in the sheet conveying device 5 and the copier 1 according to the first example of the present invention, the conveyance resistance can be substantially completely eliminated. In addition, the sheet can be guided by actively applying a conveying and propelling force to move the sheet in the downstream direction or the conveying force of the second conveying unit 7 may be applied to the sheet in addition to the conveying force of the first conveying unit 6 so as to counter the conveyance load in the first conveying path PA between the first conveying unit 6 and the second conveying unit 7 and move the sheet in the downstream direction.

In the sheet conveying device 5, the frictional resistance between the sheet S and the conveyor belt 82 may not obstruct the sheet S from being conveyed. Further, the frictional resistance may function as a negative resistance to apply a conveying and propelling force to the sheet S. That is, the frictional resistance may not obstruct the sheet S from being conveyed, but may be converted into an advantageous negative resistance to apply a conveying and propelling force to the sheet S.

Furthermore, in the conveying direction of the sheet S, as the leading edge of the sheet S abuts against the moving surface or conveying surface 82*a* of the conveyor belt 82 and is then conveyed forward by the conveyor belt 82, the leading edge of the sheet S gradually may overlap the outer circumferential surface 82*a* of the conveyor belt 82, even though there may be differences according to the rigidity of the sheet type. As a result, the area of the sheet in contact with the moving surface of the belt gradually can increase. Thus, the resistance between the sheet and the outer circumferential surface 82*a* of the conveyor belt 82 may increase as the contact area increases. Therefore, an even larger conveying and propelling force for moving the sheet S in the conveying direction can be applied from the conveyor belt 82 to the sheet S. Further, the conveyor belt 82 can change the direction of the sheet S in a direction toward the nip contact between the grip roller 81 and the conveyor belt 82. This configuration can ensure a steady increase of the conveying and propelling force transmitted from the outer circumferential surface or conveying surface 82*a* of the conveyor belt 82 to the sheet surface.

Therefore, even if the sheet S is highly rigid, it is possible to overcome this rigidity and appropriately deform or bend the sheet S in its thickness direction, and thereby ensuring that the sheet S is steadily conveyed toward the sheet holding section of the second conveying unit 7 in the downstream direction. In this manner, it is possible to address the factors of major conveyance failures caused by the fact that the sheet S is highly rigid. Therefore, it is ensured that the sheet S can be steadily conveyed after the leading edge of the sheet S reaches the sheet holding section of the second conveying unit 7. As a result, the sheet conveying device 5 can convey various types of sheets and achieve excellent sheet conveying properties.

Modification Examples of First Example

Figure 7A:
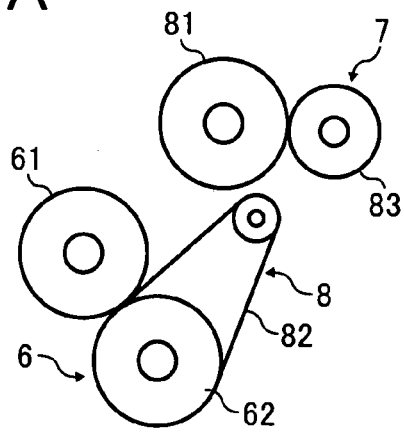
FIGS. 7A, 7B, and 7C are modification examples of the sheet conveying device of FIG. 3.
Figure 7B:
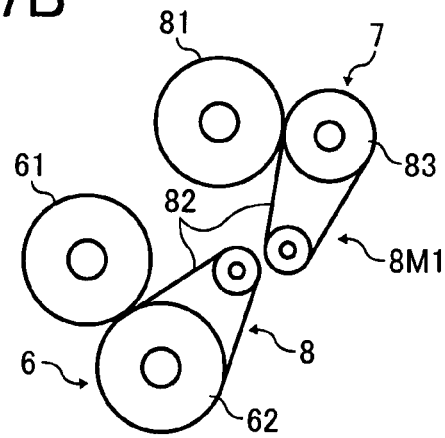
Figure 7C:
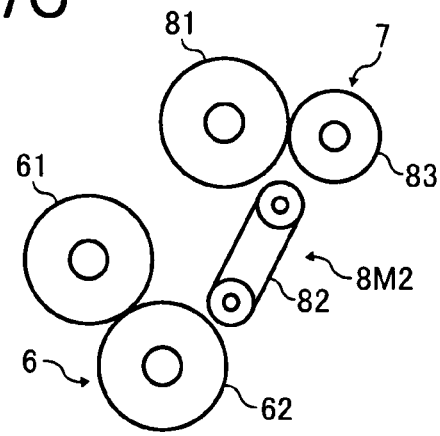

FIGS. 7A through 7C show modification examples of the first example to which the present invention is applied.

As shown in FIG. 7A, one member of the pair of rollers facing and contacting each other in the first conveying unit 6 can be the belt conveying unit 8. Furthermore, as shown in FIG. 7B, one member of the pair of rollers facing and contacting each other in the first conveying unit 6 and one member of the pair of rollers facing and contacting each other in the second conveying unit 7 can be the belt conveying unit 8 and a belt conveying unit 8M1, respectively. Furthermore, as shown in FIG. 7C, a separate and independent belt conveying unit 8M2 can be provided as a moving and guiding unit alternative to one member of the pair of rollers in the first conveying unit 6 arranged on the upstream side or one member of the pair of rollers in the second conveying unit 7 arranged on the downstream side, and arranged between the first conveying unit 6 and the second conveying unit 7.

In the belt conveying unit 8 of the modification examples shown in FIG. 7A and at the lower side of FIG. 7B, there is provided an intermediate roller-type pulley with an outside diameter somewhat smaller than the outside diameter of the reverse roller 62. The reverse roller 62 is divided into a shish-kebab-like structure in its axial direction, and the intermediate roller-type pulley is arranged inside the divided reverse roller 62 (at a position where the reverse roller 62 does not exist) via a rolling bearing, not shown, on the outer circumference of a shaft holding the reverse roller 62. The intermediate roller-type pulley is arranged so as not to affect the separating function of the reverse roller 62 (rotation in the anticlockwise direction for returning the sheet S). By providing this intermediate roller-type pulley, the conveyor belt 82 can be moved and/or rotated in the clockwise direction to convey the sheet S to the second conveying unit 7 or the belt conveying unit 8M1 at the downstream side of the conveying path. The conveyor belt 82 is one step lower than the circumferential surface of the reverse roller 62 so that the conveyor belt 82 does not form part of the nip contact between the feed roller 61 and the reverse roller 62. Accordingly, after the sheet S is separated from the rest of the sheets at the nip contact between the feed roller 61 and the reverse roller 62, the conveyor belt 82 can provide the above-described functions.

Hence, in any of the above-described modification examples, the same effects as those of the first example embodiment can be achieved.

Second Example

Figure 8:
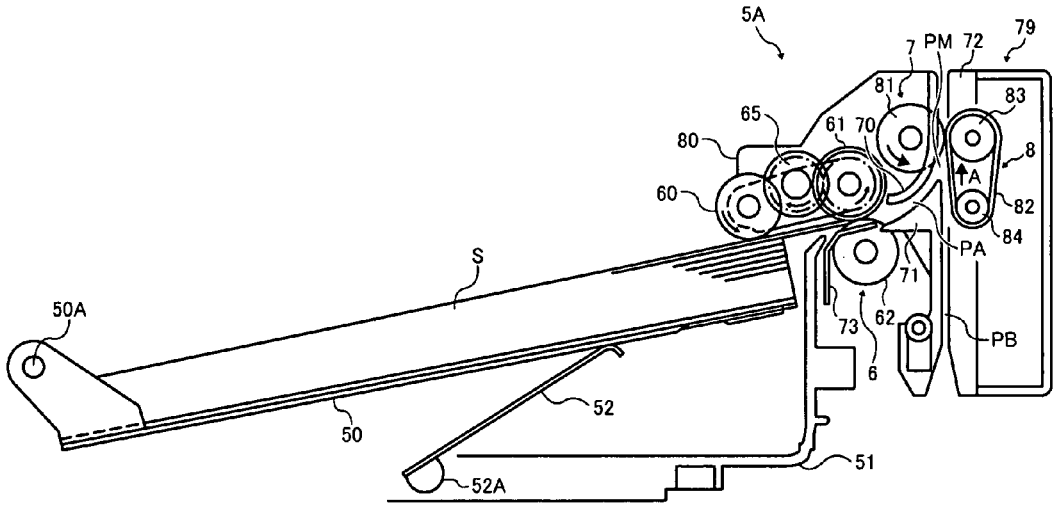
FIG. 8 is a cross-sectional view of another sheet conveying device according to an example embodiment of the present invention.
Figure 9:
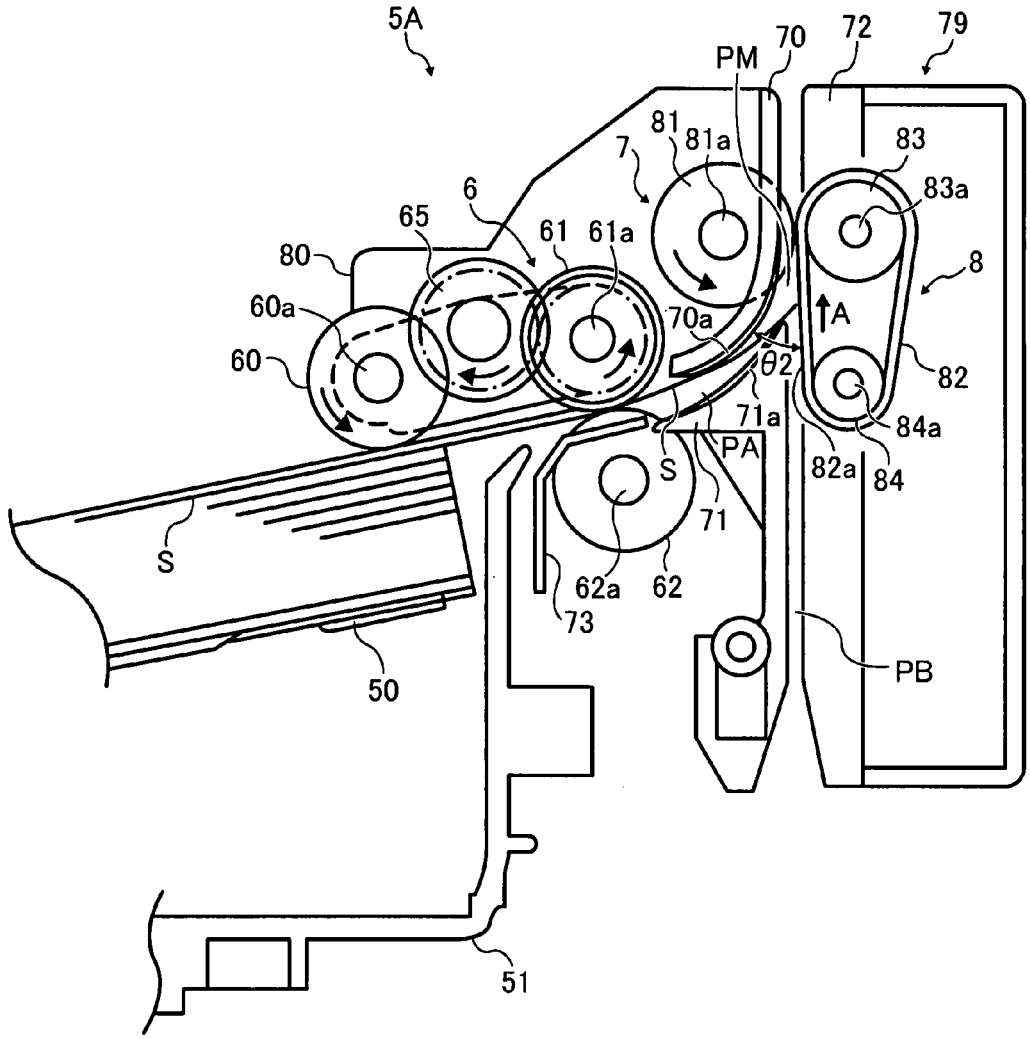
FIG. 9 is an enlarged cross-sectional view showing one state of the sheet conveying device of FIG. 8.
Figure 10:
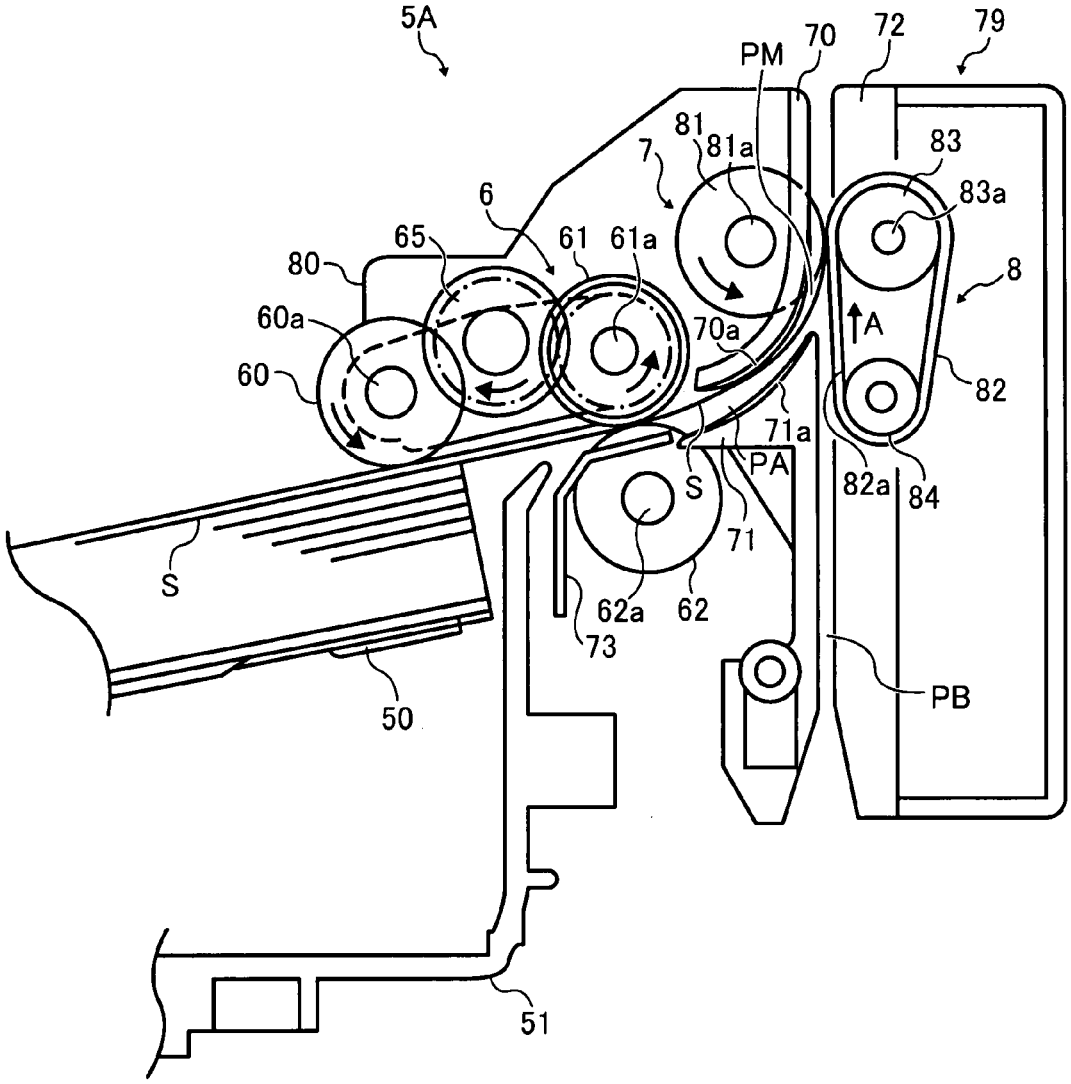
FIG. 10 is an enlarged cross-sectional view showing another state of the sheet conveying device of FIG. 8.

Referring to FIGS. 8 through 10, schematic configuration and functions of a sheet conveying device 5A according to a second example of the present invention is described.

Elements and members corresponding to those of the sheet conveying device 5 of the first example shown in FIGS. 2 through 5 are denoted by the same reference numerals and descriptions thereof are omitted or summarized. Although not particularly mentioned, configurations of the sheet conveying device 5A, etc., and operations that are not particularly described in the second example are the same as those of the sheet conveying device 5 of the first example previously described with reference to FIGS. 2 through 5.

The main differences between the sheet conveying device 5 shown in FIGS. 2 through 5 according to the first example and the sheet conveying device 5A shown in FIGS. 8 through 10 according to the second example are as follows.

In addition to the first conveying path PA serving as a first sheet conveying path formed between the first conveying unit 6 and the second conveying unit 7, a second conveying path PB serving as a second sheet conveying path is provided. The second conveying path PB, which is different and separate from the first conveying path PA, may extend from an upstream position of the second conveying unit 7 to the second conveying unit 7. The first conveying path PA and the second conveying path PB may merge at an upstream side of the second conveying unit 7, thereby forming a common conveying path PM. The belt conveying unit 8, which is one of the members of the second conveying unit 7, is disposed along the outer side of the first conveying path PA and the second conveying path PB. Apart from these differences, the sheet conveying device 5A according to the second example, described in reference to FIGS. 8 through 10, is the same as the sheet conveying device 5 according to the previously described first example, in reference to FIGS. 2 through 5.

That is, the pulley 84 around which the conveyor belt 82 is stretched in the belt conveying unit 8. The pulley 84 is one member of the pair of roller-type pulleys 83 and 84, axially rotatably supported by the housing 80, and disposed beneath the pulley 83 with a space therebetween. Therefore, it can be ensured that the leading edge of the sheet S conveyed by the first conveying unit 6 into the first conveying path PA abuts against the conveying surface 82*a* of the conveyor belt 82, and that the sheet S conveyed along the second conveying path PB by a conveying unit, not shown, is not obstructed from reaching the second conveying unit 7.

Next, conveying operations of the sheet conveying device 5A according to the second example are described, with reference to FIGS. 8 through 10.

The sheet S is extracted and conveyed from a stack of sheets stacked horizontally in the sheet feeding cassette 51. Therefore, the sheet conveying direction in the sheet feeding and separating mechanism of the first conveying unit 6 is a substantially horizontal direction. Subsequently, the sheet S is conveyed upward an image forming section of the main body 2 of the copier 1 positioned above. Therefore, the sheet S may need to be conveyed in a substantially vertical and upward direction, which is orthogonal or perpendicular to the substantially horizontal direction.

Thus, as shown in FIG. 9, after the sheets S have been separated one by one in the sheet feeding and separating mechanism, the sheet S may bend moderately while being conveyed to reduce the conveyance resistance, and then the leading edge of the sheet S may abut against the conveyor belt 82.

The conveyor belt 82 may move in a substantially vertically upward direction or substantially directly upward direction as indicated by arrow "A" in FIGS. 9 and 10. The leading edge of the sheet S abutting the conveyor belt 82 may be conveyed to the sheet holding section or nip contact between the grip roller 81 and the conveyor belt 82, and then be conveyed to the downstream side in the substantially directly upward direction by the grip roller 81 and the conveyor belt 82 while being held therebetween. As described above, a conveying and propelling force may be transmitted from the conveyor belt 82 to the sheet S for moving the sheet S in the conveying direction. Moreover, the conveyor belt 82 may change the direction of the sheet S toward the nip contact between the grip roller 81 and the conveyor belt 82. Accordingly, even a highly rigid sheet S can be steadily conveyed without causing conveyance failures.

With the above-described configuration and conveying operations, the sheet conveying device 5A provided with the common conveying path PM shown in FIGS. 8 through 10 can provide the same effects as those of the sheet conveying device 5 shown in FIGS. 2 through 5. That is, a highly rigid sheet such as a cardboard recording paper can be steadily conveyed, and thereby achieving excellent sheet conveying properties. Moreover, the sheet conveying device 5A of this example embodiment may have plural conveying paths, at least the first conveying path PA and the second conveying path PB, so as to be applied to a wider range of machine types.

As shown in FIGS. 8 through 10, the belt conveying unit 8 according to the second example of the present invention includes the grip roller 81 and the pulley 83 both of which serving as the second pair of rotary conveyance members. However, the configuration of the belt conveying unit 8 is not limited to the above-described configuration. For example, as described in the modification example of the first example in reference to FIG. 7C, a different belt conveyor unit separated from the second pair of rotary conveyance members, i.e., the grip roller 81 and the pulley 83, can be provided.

Third Example

A third example embodiment to which the present invention is applied is described with reference to FIG. 11. Elements and members corresponding to those of the first and second examples are denoted by the same reference numerals and descriptions thereof are omitted or summarized. Although not particularly described, configurations of a sheet conveying device 5B, etc. and operations that are not particularly described in the third example are the same as those of the sheet conveying apparatus 5A of the second example embodiment described with reference to FIGS. 8 through 10.

Figure 11:
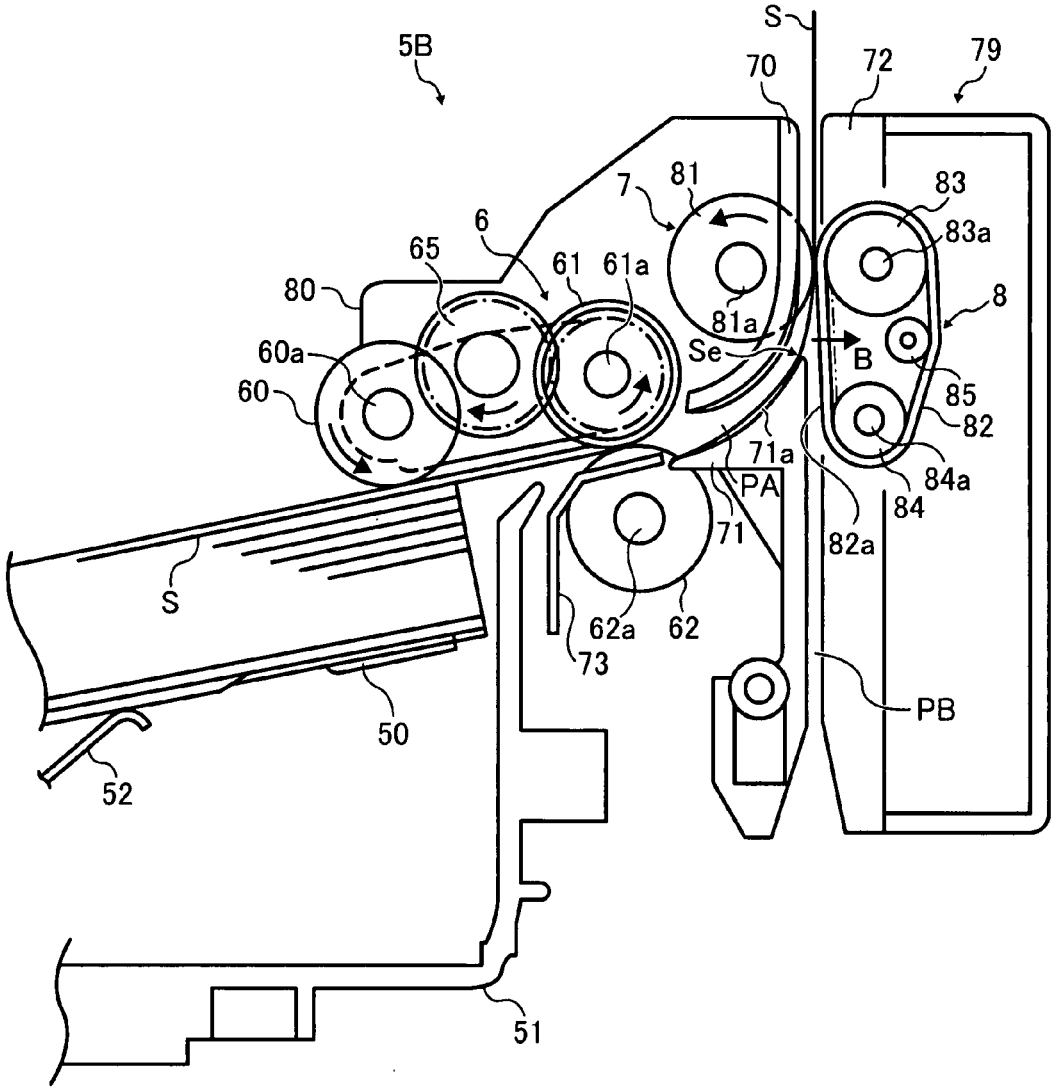
FIG. 11 is an enlarged cross-sectional view showing another state of the sheet conveying device of FIG. 8.

As shown in FIG. 11, when a trailing edge Se of the sheet S that is bent while being conveyed is released from the conveying guiding member 71, the reaction force of the bent sheet S causes the trailing edge Se of the sheet S to move in a direction indicated by arrow B shown in FIG. 11, i.e., causes a flipping phenomenon. Particularly if the sheet S is stiff (highly rigid) such as a cardboard recording paper, the reaction force is larger, and therefore, a sudden noise caused by this flipping phenomenon becomes a problem.

Specifically, in the process of being conveyed, the sheet S is held at two or more supporting points and is forcibly bent. When the trailing edge Se of the sheet S is released from the sheet holding section of the first conveying unit 6 or the conveying guiding member 71 acting as one of the supporting points, the sheet S is only supported at the leading edge. Thus, an elastic restoring force of the belt sheet S causes the trailing edge of the sheet S to immediately collide against the conveying surface 82*a* of the conveyor belt 82. The impact of the collision becomes larger as the rigidity of the sheet S becomes higher. Accordingly, the sudden noise made when the trailing edge Se of the sheet S is caused to collide against the conveying belt 82 by the flipping phenomenon is not only unpleasant for the user but may also cause the user to have a misperception that a failure has occurred. That is, even if the sheets S are being conveyed normally, regardless of whether the sheet S is a regular type or a highly rigid type, the above-described sudden noises may give the wrong impression to the user that the copier 1 is malfunctioning.

To address this issue, as shown in FIG. 11, in the belt conveying unit 8, a tension roller 85 serving as a contacting member is avoided from the side of the conveying surface 82*a* of the conveyor belt 82. The tension roller 85 is a member that contacts the conveyor belt 82, other than the pair of roller-type pulleys 83 and 84 around which the conveyor belt 82 is stretched, and the grip roller 81. Accordingly, the portion of the conveying surface 82*a* of the conveyor belt 82 is made to have appropriate elasticity, so that the impact caused by the flipping phenomenon of the trailing edge Se of the sheet S can be absorbed by the elastic property of the conveyor belt 82. Thus, the sheet conveying device 5B can remain silent even while a highly rigid sheet S such as a cardboard recording paper is being conveyed.

Among the two linear portions of the conveyor belt 82 stretched around the pair of pulleys 83 and 84, the tension roller 85 is not arranged on the side of the conveying surface 82*a* of the conveyor belt 82, but on the opposite side and in contact with the inside perimeter of the conveyor belt 82. Furthermore, the tension roller 85 is axially supported so as to be movable in an outward direction from inside the conveyor belt 82, and is pressed outward in the right direction as viewed in FIG. 11 by a forcing unit, not shown. Therefore, the tension roller 85 is caused to rotate by the movement of the conveyor belt 82, and contacts the inside perimeter of the conveyor belt 82 while constantly receiving a given pressing force in an outward direction, so that the conveyor belt 82 maintains a fixed tension without slackening in its circumferential direction.

Accordingly, in the sheet conveying device 5B of the third example of the present invention, the following advantage is achieved. That is, as the leading edge of the sheet S in the sheet conveying direction is held and conveyed by the second conveying unit 7, the trailing edge Se of the sheet S is released from being supported by the conveying guiding member 71 and is made to collide against the conveying surface 82*a* of the conveyor belt 82. However, the conveying surface 82*a* of the conveyor belt 82 can elastically deform sufficiently and change its position in the direction of collision as indicated by the chain double-dashed line in FIG. 11. Accordingly, the impact caused by the flipping phenomenon of the trailing edge Se of the sheet S can be absorbed, and the noise caused by the impact can be reduced, so that abnormal noises can be reduced and mitigated during the operation of the sheet conveying device 5B.

As described above, in the sheet conveying device 5B of the third example, as one of the contacting members to support the conveyor belt 82, the tension roller 85 is provided in contact with the conveyor belt 82 where the trailing edge Se of the conveyed sheet S does not come in contact with the conveying surface 82*a* of the conveyor belt 82. When the sheet S that is bent to a given extent is conveyed and the trailing edge Se of the sheet S is released from either one of the nip contact of the first conveying unit 6 or the conveying guiding member 71, the trailing edge Se collides against the conveying surface 82*a* of the conveyor belt 82. However, the portion of the conveyor belt 82 where this collision occurs elastically bends sufficiently to absorb the impact of the collision. Therefore, the sudden noise or flipping noise caused by the collision can be reduced. That is, when the trailing edge Se of the sheet S contacts the conveying surface 82*a* of the conveyor belt 82, the contacting member, i.e., the tension roller 85, does not obstruct the deforming motion of the conveyor belt 82 where it is contacted by the trailing edge Se of the sheet S. Thus, the conveyor belt 82 sufficiently bends in the same direction as the direction in which the trailing edge Se of the sheet S contacts the conveyor belt 82.

Particularly, when a highly rigid sheet S such as a cardboard recording paper is being conveyed, and the trailing edge Se of the sheet S in the sheet conveying direction strongly collides against the conveyor belt 82, the elastic deforming motion of the conveyor belt 82 absorbs and mitigates the impact caused by the collision so that an impulsive noise is sufficiently reduced.

Accordingly, as sudden noises can be reduced while conveying the sheet S, operations can be performed quietly so that unpleasant noises are reduced or prevented, if possible, and misperceptions that a failure has occurred are not created. This results in advantageous usability of the sheet conveying device 5B.

In the process of conveying the sheet S, even if a sudden noise is not generated when the leading edge of the sheet S first contacts the conveying surface 82*a* of the conveyor belt 82, the above-described configuration still has an advantageous effect. That is, as the conveyor belt 82 elastically deforms to some extent, the leading edge of the sheet S is prevented from bouncing back from the conveying surface 82*a* of the conveyor belt 82. Instead, the leading edge of the sheet S softly abuts the conveying surface 82*a* and stays in contact with the conveying surface 82*a* of the conveyor belt 82. Specifically, when the leading edge of the sheet S conveyed by the first conveying unit 6 first abuts the conveying surface 82*a* of the conveyor belt 82 moving in the sheet conveying direction at an oblique collision angle θ2 (see FIG. 9), the leading edge of the sheet S is prevented from bouncing back from the conveying surface 82*a* of the conveyor belt 82. Rather, the leading edge of the sheet S is caused to follow the direction of movement of the conveying surface 82*a* of the conveyor belt 82 and change its direction to that of the conveyor belt 82.

The third example is not limited to that shown in FIG. 11 as long as the conveyor belt 82 can be deformed in such a manner that the sheet conveying device 5 operates sufficiently quietly. For example, among the two substantially linear belt moving surfaces of the conveyor belt 82 stretched around the pair of pulleys 83 and 84 spaced apart in a given manner, the tension roller 85 is not limited to being provided on the linear surface opposite to the conveying side of the conveyor belt 82, i.e., the side not facing the first conveying unit 6. The tension roller 85 can be provided on the belt moving surface facing the first conveying unit 6. That is, regardless of the rigidity of the sheet S in its thickness direction, the trailing edge of the sheet S always contacts substantially the same position of the belt conveying surface. Accordingly, the tension roller 85 is to be arranged in contact with the conveyor belt 82 at a position sufficiently spaced apart from where the trailing edge of the sheet S contacts the belt conveying surface so as to allow the conveyor belt 85 to deform.

In the sheet conveying device 5B of the third example, the tension roller 85 is arranged at a position defined as above to apply a pressing force from inside to stretch the conveyor belt 82 outward. Conversely, the tension roller 85 can be arranged so as to apply a pressing force from outside the conveyor belt 85 to stretch the conveyor belt 82 inward.

In such a configuration, the tension roller 85 can also have a function of cleaning the outer circumferential surface or conveying surface 82*a* of the conveyor belt 82 in addition to the function of applying tension to the conveyor belt 82. With such a tension roller having functions of both applying pressure to the conveyor belt 82 and cleaning the belt conveying surface, the belt conveying surface can be maintained in a clean condition, which may improve the image quality. Furthermore, at a position defined as above, both a tension roller and a cleaning roller can be provided separately, or only a cleaning roller that primarily functions as a cleaning unit and does not primarily function as a tensioning unit can be provided.

As described above, the second conveying unit 7 of the sheet conveying device 5 shown in FIGS. 2 through 5 and of the sheet conveying device 5A shown in FIGS. 8 through 11 is configured to serve as a holding and conveying unit that holds and conveys the sheet S. That is, the second conveying unit 7 is a second pair of rotary conveyance driving members that includes the grip roller 81 and the conveyor belt 82 spanned around the roller-type pulleys 83 and 84, in which the grip roller 81 and the conveyor belt 82 face each other. In the second conveying unit 7, the grip roller 81 is a driving member and the conveyor belt 82 is a subordinate or driven member rotated by the grip roller 81. However, the conveyor belt 82 can be a driving member and the grip roller 81 can be a subordinate or driven member rotated by the conveyor belt 82.

Further, as described above, the conveyor belt 82 of the sheet conveying devices 5, 5A, and 5B described in reference to FIGS. 2 through 5 and FIGS. 8 through 11 has a width in a sheet width direction "Y" that is at least substantially equal to the width of a maximum-size sheet to be conveyed. That is, the belt width of the conveyor belt 82 extends across the entire width of the sheet, so as to be substantially equal to or greater than the width of a maximum-size sheet to be conveyed. The pulleys 83 and 84 around which the conveyor belt 82 is stretched and the grip roller 81 facing and contacting the conveyor belt 82 extends across the entire width of the sheet, in which a manner that their sizes in the sheet width direction "Y" (axial length wise direction) are equal to or larger than the above-described width of the conveyor belt 82. Hence, it is ensured that the entire width of the sheet S sent out from the first conveying unit 6 contacts the conveyor belt 82, so that the contact area therebetween can be increased. Accordingly, it is possible to increase the conveying and propelling force for conveying the sheet S in the conveying direction, which force is constantly transmitted to the sheet S from the conveyor belt 82 moving in the sheet conveying direction.

By contrast, the following example embodiment has a different configuration from the above-described configuration of the sheet conveying devices 5, 5A, and 5B.

First Example Embodiment

Figure 13:
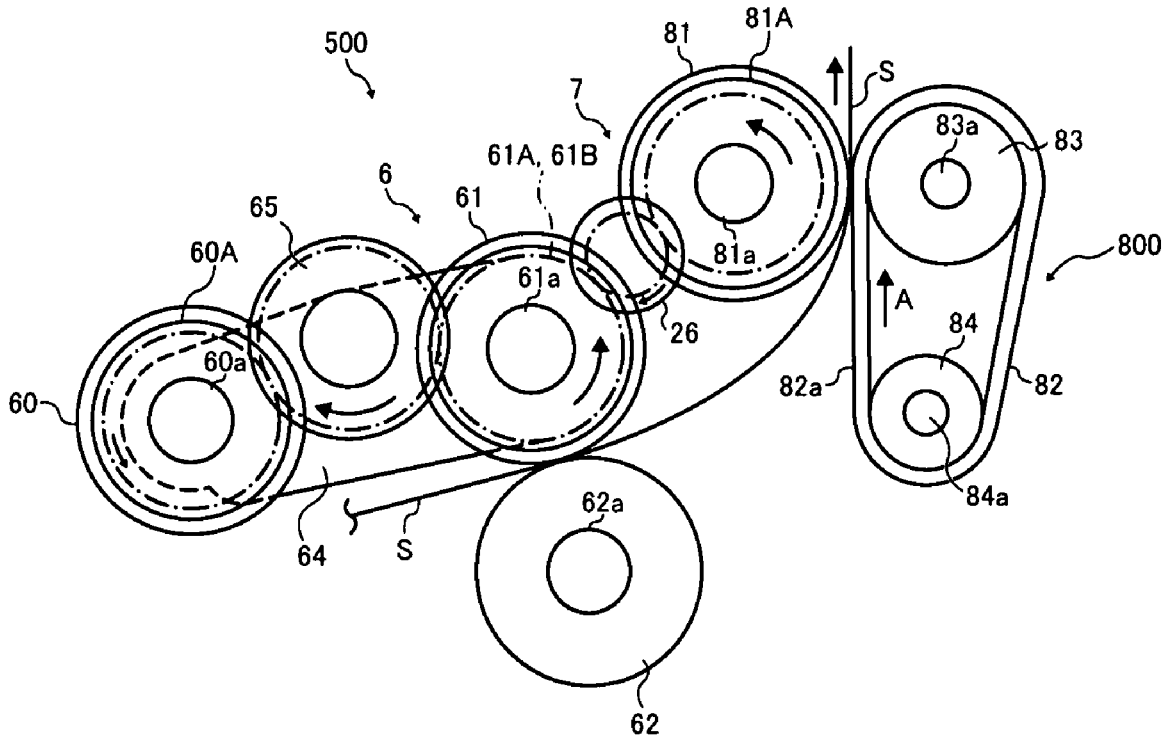
FIG. 13 is a schematic front view of relevant parts of the driving mechanism of FIG. 12.
Figure 14:
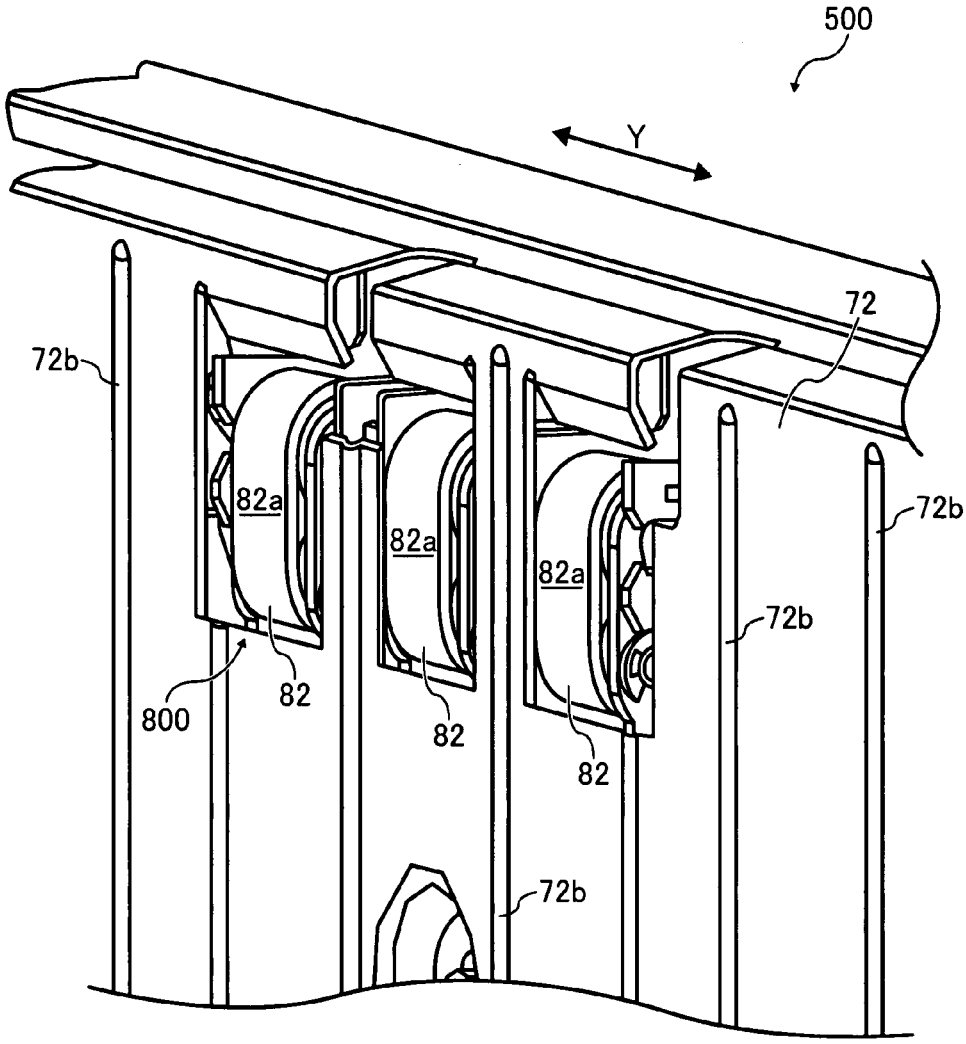
FIG. 14 is a perspective view of relevant parts around belt conveying units and a conveying guiding member of the sheet conveying device of FIG. 8.

A sheet conveying device 500 according to the first example embodiment of the present invention is described with reference to FIGS. 12 through 21. FIGS. 12 and 13 schematically illustrate a driving mechanism 22 acting as a driving force transmitting unit or a sheet feeding driving unit (sheet feeding driving system) of the first conveying unit 6 and the second conveying unit 7 in the sheet conveying device 500 according to the first example embodiment of the present invention. FIGS. 14 through 18 illustrate the surroundings of a belt conveying unit 800 of the second conveying unit 7 in the sheet conveying device 500 according to the first example embodiment of the present invention.

The primary differences of the sheet conveying device 500 from the sheet conveying device 5 shown in FIGS. 2 through 5, the sheet conveying device 5A shown in FIGS. 8 through 10, and the sheet conveying device 5B shown in FIG. 11 are as follows.

In the sheet conveying device 500 of the first example embodiment, the relationship between the driving member and the subordinately driven member of the second conveying unit 7 acting as a holding and conveying unit is clearly defined. Furthermore, the belt conveying unit 800 is employed instead of the belt conveying unit 8. Elements of the belt conveying unit 8A including the conveyor belt 82 are arranged in a discontinuous manner (i.e., in a spaced-apart manner) along the sheet width direction "Y" so as to contact parts of the sheet S in the sheet width direction "Y" (i.e., not in contact with the entire sheet width).

Apart from these differences, the sheet conveying device 500 according to the first example embodiment of the present invention is same as the sheet conveying devices 5, 5A, and 5B shown in FIGS. 2 through 5 and FIGS. 8 through 11.

Specifically, in the second conveying unit 7 of the sheet conveying device 500, the nip contact or the sheet holding section is formed by a pair of members facing each other, namely, the grip roller 81 and the belt conveying unit 800. The grip roller 81 disposed facing the belt conveying unit 800 in the second conveying unit 7 serves as a rotary conveyance driving unit or member that transmits a driving force by its rotation. The belt conveying unit 800 (moving and guiding unit) including the conveyor belt 82, which is the other member of the pair, is arranged along the outer side of the sheet conveying path (the first conveying path PA) formed between the first conveying unit 6 and the second conveying unit 7. The conveyor belt 82 directly contacts the grip roller 81, and is caused to rotate following the rotation of the grip roller 81. The conveyor belt 82 conveys (moves and guides) the sheet S toward the nip contact of the second conveying unit 7 while keeping the leading edge of the sheet S in contact with the conveyor belt 82.

In the sheet conveying devices 5, 5A, 5B shown in FIGS. 2 through 5 and FIGS. 8 through 11, the width of the conveyor belt 82 is equal to or greater than the width of a maximum-size sheet to be conveyed, and the pulleys 83 and 84 and the grip roller 81 are formed across the entire sheet width direction "Y" so that their sizes are equal to or larger than the above-described belt width of the conveyor belt 82. Instead of this configuration, the sheet conveying device 500 according to the first example embodiment of the present invention, elements of the belt conveying unit 800 including the conveyor belt 82 are arranged in a discontinuous manner along the sheet width direction "Y" so as to contact parts of a leading edge section of the sheet S in the sheet width direction "Y" (the leading edge section includes the leading edge, the sheet surface around the leading edge, the corners and edges at the leading edge).

The grip roller 81 includes multiple rotary conveyance members fixed and arranged in a discontinuous manner along the rotational driving shaft 81*a* in the sheet width direction "Y" in a shish-kebab-like structure. Meanwhile, the conveyor belt 82 and the pulleys 83 and 84 in the belt conveying unit 800 are arranged facing at least one of the multiple grip rollers 81 (forming at least one pair of facing members). Specifically, in the sheet conveying device 500 shown in FIG. 12, there are three grip rollers 81 arranged along the rotational driving shaft 81*a* in the second conveying unit 7 acting as the holding and conveying unit. One conveyor belt 82 is arranged facing the center one of the three grip rollers 81, having a substantially equal width to that of the center grip roller 81. The grip rollers 81 positioned at the outermost edges in the sheet width direction "Y" are arranged so that their outer edges are within the width of a minimum-sized sheet S (a sheet size in the sheet width direction "Y") used in the copier 1 provided with the sheet conveying device 500. The detailed description of the configuration will be described below.

In FIG. 12, as a matter of convenience in describing the driving mechanism 22 of the sheet conveying device 500, the grip rollers 81 are purposely arranged with irregular intervals in the direction of the rotational driving shaft 81*a*. However, in reality, the grip rollers 81 are equally spaced apart at positions facing the conveyor belt 82 and the pulleys 83, as a matter of course.

As shown in FIGS. 12 and 13, the sheet conveying device 500 further includes the driving mechanism 22 that drives the grip roller 81. The driving mechanism 22 primarily includes a sheet feeding motor 23, a motor gear 24, an idler gear 25, a feed roller driving gear 61B, an idler gear 26, a grip roller driving gear 81A, a feed roller gear 61A, the idler gear 65, and a pickup roller gear 60A.

The sheet feeding motor 23 is a stepping motor serving as the only driving source or driving unit.

The motor gear 24 is fixed on an output shaft of the sheet feeding motor 23.

The idler gear 25 is engaged with the motor gear 24.

The feed roller driving gear 61B is engaged with the idler gear 25 and fixed to one end of the shaft 61*a* of the feed roller 61.

The idler gear 26 is engaged with the feed roller driving gear 61B.

The grip roller driving gear 81A is engaged with the idler gear 26 and fixed to one end of the rotational driving shaft 81*a* of the grip rollers 81.

The feed roller gear 61A is fixed to the other end of the shaft 61*a* near the feed roller 61.

The idler gear 65 is engaged with the feed roller gear 61A.

The pickup roller gear 60A in engagement with the idler gear 65 and fixed to the other end of the shaft 60*a* near the pickup roller 60.

The sheet feeding motor 23 is fixed to the housing 80. The idler gears 25, 26, and 65 are rotatably supported by the housing 80.

As described above, the sheet conveying device 500 according the first example embodiment can be compact and space-saving by making the first conveying path PA have a curved section of a relatively small curvature radius as later described in reference to FIGS. 12 and 13. The sheet feeding motor 23 is the only driving source provided for driving both the first conveying unit 6 and the second conveying unit 7, which also contributes in reducing the size of the device.

The reverse roller 62 may be driven by a different system including, for example, a solenoid for releasing pressure from the feed roller 61.

As shown in FIG. 12, the sheet conveying device 5 further includes the torque limiter 62*b*.

In the first example shown in FIGS. 2 through 5, the rotating and driving relationship between the pickup roller 60 and the feed roller 61 is described only briefly. In reality, as shown in an enlarged view of FIG. 13, the respective shafts 60*a* and 61*a* of the pickup roller 60 and the feed roller 61, respectively, may be connected by a pickup arm member 64. Accordingly, for the pickup action, a combination of a solenoid, not shown, and a spring, not shown, causes the pickup roller 60 to pivot or move about the shaft 61*a* of the feed roller 61 via the pickup arm member 64.

In the actual driving mechanism 22, there are many driving force transmitting members such as gears and timing belts disposed between the sheet feeding motor 23 and the feed roller 61. However, the example of the driving mechanism 22 is shown only schematically in FIGS. 12 and 13 for the sake of clearly indicating that the grip rollers 81 serve as rotary conveyance driving members.

In addition, the conveyor belt 82 of the belt conveying unit 8 directly contacts the grip roller 81 serving a rotary conveyance driving member that is rotated by the driving mechanism 22, so that the conveyor belt 82 can rotate following the rotation of the grip roller 81. Variations in the linear velocity of the conveyor belt 82 can be further reduced by driving the grip roller 81, compared to the case in which the conveyor belt 82 is driven. Therefore, the following advantages can be achieved by arranging the conveyor belt 82 along the outer side of the turning or curved section of the first conveying path PA. The conveyor belt 82 may rotate toward the sheet holding section of the second conveying unit 7. That is, it is possible to enhance sheet conveying properties for conveying relatively rigid sheets such as a cardboard recording paper at the turning section of the first conveying path PA. Furthermore, by causing the conveyor belt 82 to rotate following the rotation of the grip roller 81 that faces and directly contacts the conveyor belt 82, the sheet S can be conveyed at a steady linear velocity beyond the second conveying unit 7.

Referring now to FIGS. 14 through 21, a detailed configuration disposed on the belt conveying unit 800 side and opposite to the grip roller 81 is described.

The belt conveying unit 800 of the sheet conveying device 500 is primarily different from the belt conveying unit 8 of the sheet conveying devices 5, 5A, and 5B shown in FIGS. 2 through 5 and FIGS. 8 through 11 in the following points and subsequently described characteristics.

That is, the material and characteristics, such as a hardness and tension rate of rubber as an elastic member, and thickness of the conveyor belt 82 may be specified as described below.

Instead of having three pulleys 83 fixedly attached to the pulley shaft 83*a*, three pulleys 83 are rotatably supported by a pulley shaft 83*b*.

Instead of having the pulley 84 fixedly attached to the pulley shaft 84*a*, three pulleys 84 are rotatably supported by the pulley shaft 84*b*.

Each of the pulleys 83 and 84 may be formed of a resin material such as polyacetal resin.

The belt supporting members 86 may be provided to rotatably support the pulleys 83 and 84.

Instead of the pulley shaft 84*a* with a long length continuously extending in its longitudinal or axial direction, there are three metal pulley shafts 84*b* with short lengths in their axial directions provided for the belt conveying unit 800.

Figure 15:
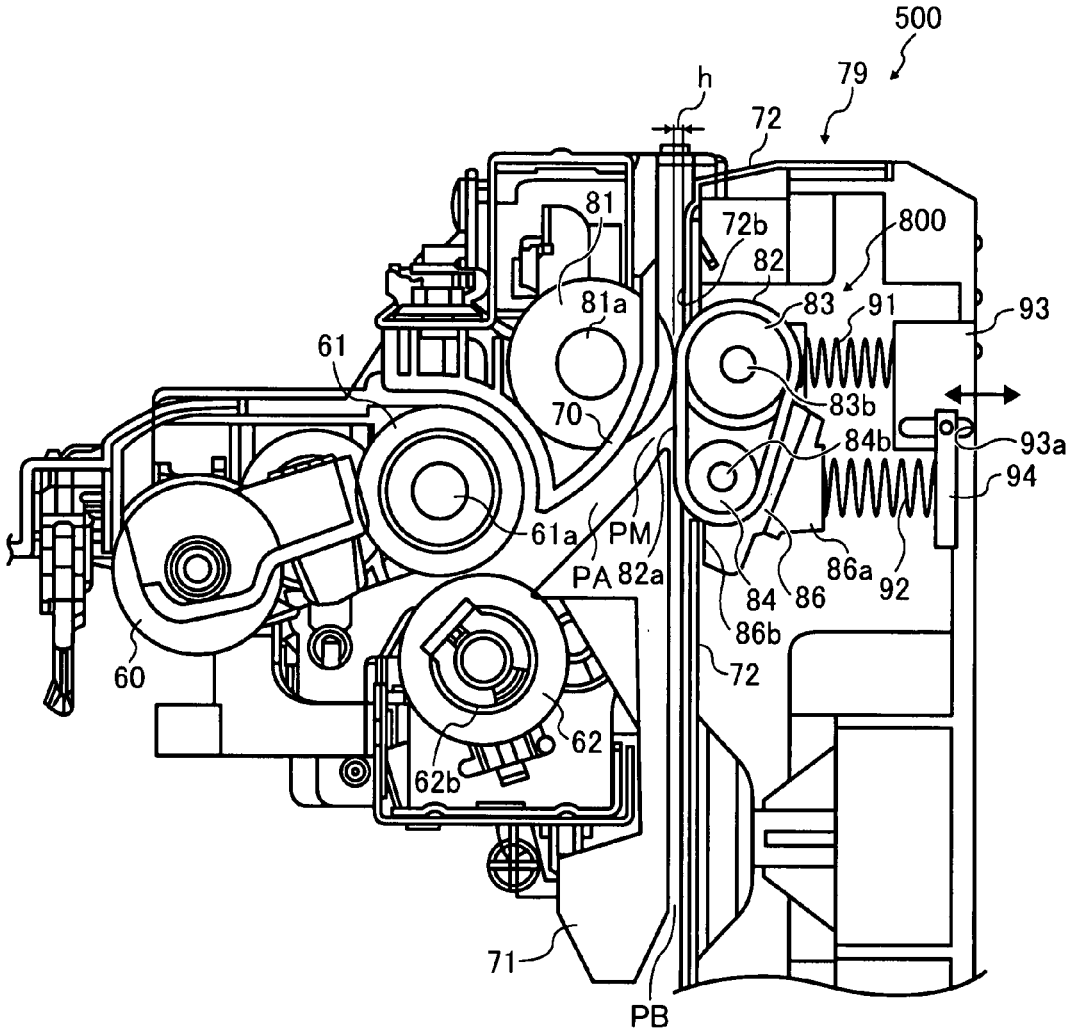
FIG. 15 is a cross-sectional view of relevant parts around the sheet conveying of FIG. 8.

As shown in FIG. 15, the grip roller 81 and the conveyor belt 82 may contact with each other on a line connecting the center of the rotational driving shaft 81*a* of the grip roller 81 and the center of the pulley shaft 83*b*, similarly to the first example shown in FIG. 5. The sheet holding section or nip contact may be formed at the portion including this contact point. The pulleys 83 and 84 can be formed of a resin material such as polyacetal resin that has good lubricity, abrasion resistance, and durability, and are thus light-weight.

The conveyor belts 82 provided at three positions have the same configurations except for their spring loads as described below. Therefore, the configuration of one of the conveyor belts 82 is described as a representative example.

The conveyor belt 82 is an elastic member made of, for example, ethylene propylene rubber (EPDM), without using a base material. (A belt is generally formed by attaching rubber onto a base material such as a cloth made by weaving threads.)

The conveyor belt 82 can also be made of one of chloroprene rubber (CR), urethane rubber (U), silicon rubber, and silicone rubber (Q).

The conveyor belt 82 may be stretched around the pulley 83 rotatably supported by the pulley shaft 83*b* and the pulley 84 rotatably supported by the pulley shaft 84*b* with a given tension determined by the relative positions of the pulleys 83 and 84 attached to the belt supporting member 86 via the pulley shafts 83*b* and 84*b*.

The pulley shafts 83*b* and 84*b* may be fixed and supported by the belt supporting member 86 in such a manner that a fixed distance is maintained between their axes. Furthermore, the pulley shafts 83*b* and 84*b* may be fixed and supported by the belt supporting member 86 in such a manner that the conveyor belt 82 has a longer circumference when stretched around the pulleys 83 and 84 compared to when the conveyor belt 82 is by itself (in a non-stretched state). Accordingly, the conveyor belt 82 may elastically be stretched so that the conveyor belt 82 can have a longer circumference when the belt conveying unit 800 is assembled in the belt supporting member 86, compared to when the conveyor belt 82 is by itself (in a non-stretched state).

Two bearings 87 (see FIGS. 16 and 17) are provided on the pulley shaft 83*b* held by the three belt supporting members 86. Springs 91 that serve as biasing and elastic members may apply forces on the pulley shaft 83*b* via the bearings 87 to press the conveyor belt 82 against the grip roller 81, which provides a given sheet holding section or nip contact. Thus, a conveying force for conveying a sheet S can be generated. As described above, the pulley shafts 83*b* and 84*b* may be fixed by the belt supporting members 86 in such a manner that a fixed distance is maintained between their axes, and the pulley shaft 84*b* can pivot back and forth about the pulley shaft 83*b*.

Each of the belt supporting members 86 is a single component made of a resin material such as polyacetal resin, and is thus light-weight. On the back wall of each of the belt supporting members 86, a spring stage 86*a* is disposed integrally with the belt supporting member 86 for latching one end of a spring 92. In the vicinity of the portions at which the pulley shafts 83*b* and 84*b* protrude out from the belt supporting members 86, retaining rings, not shown, are provided to stop the pulley shafts 83*b* and 84*b* from slipping out.

As shown in FIG. 15, the springs (pressuring springs or compression springs) 92 are provided between the spring stages 86*a* of the belt supporting members 86 and spring bearing members 93. The springs 92 may serve as pressuring members for pressing and biasing the backsides of the belt supporting members 86 in such a direction that the conveyor belts 82 constantly press contact with the grip rollers 81 toward the first conveying path PA shown in FIG. 15.

Figure 16:
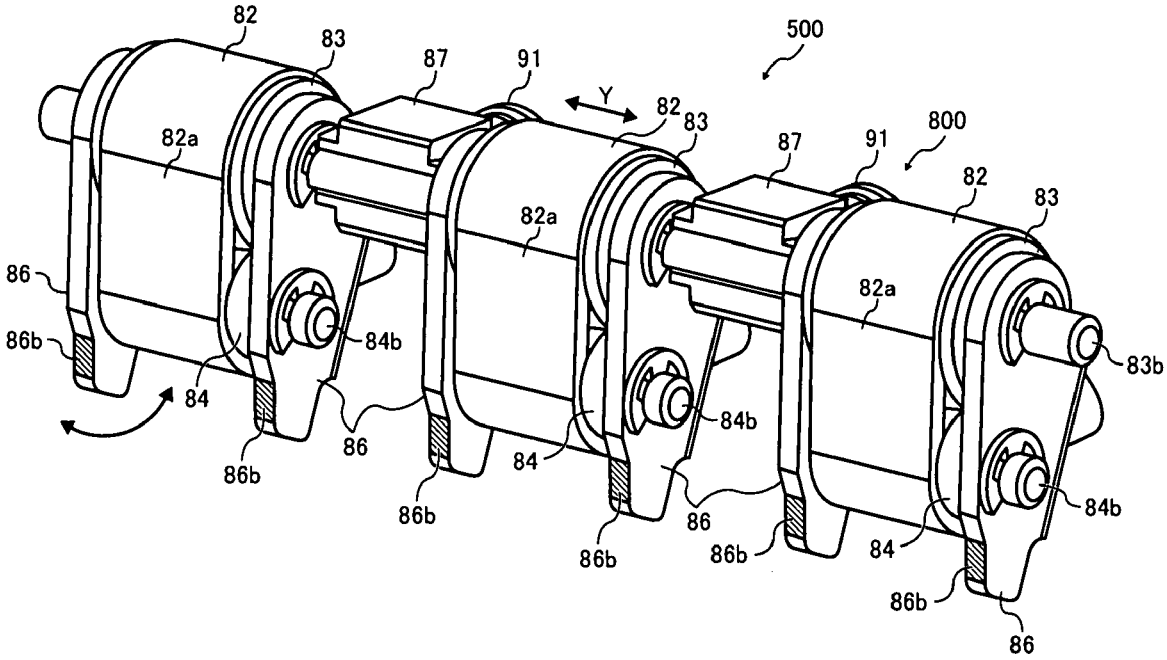
FIG. 16 is a perspective view around the belt conveying units of the sheet conveying device of FIG. 8.
Figure 17:
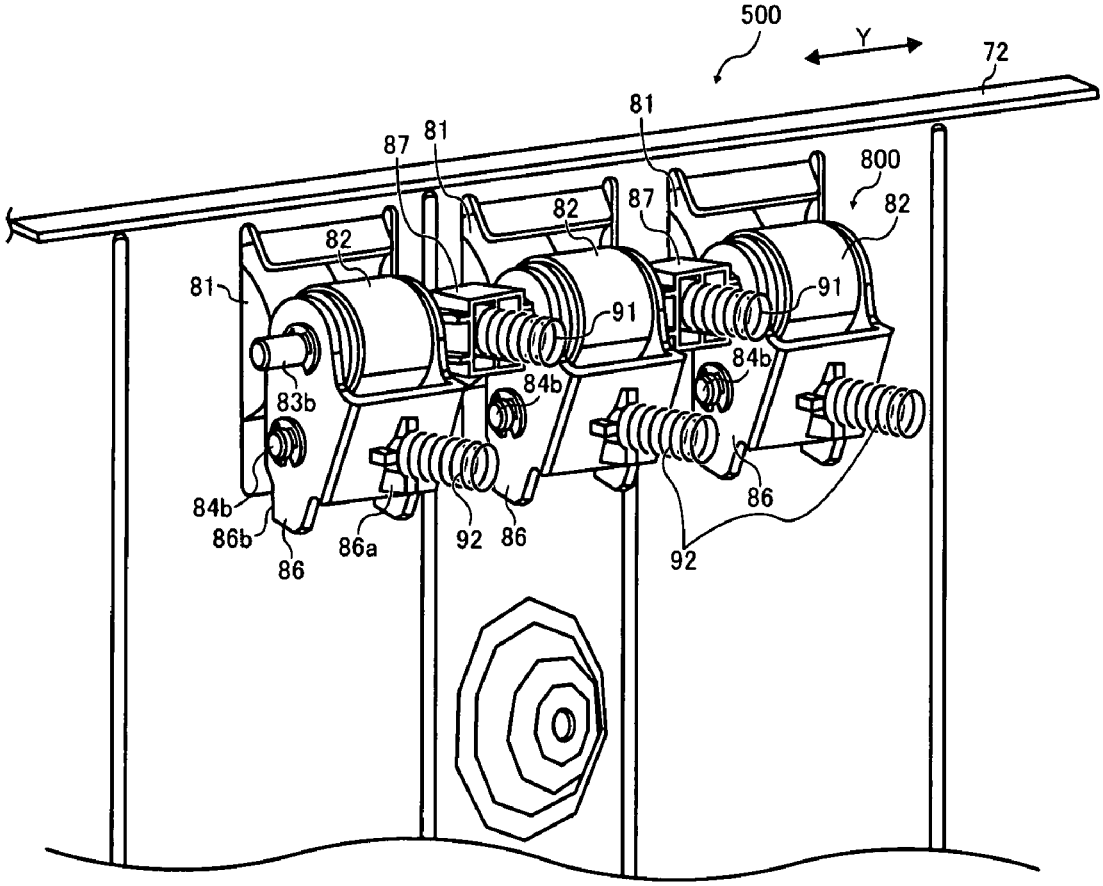
FIG. 17 is another perspective view around the belt conveying units of the sheet conveying device of FIG. 8.

As indicated by the hatched portions shown in FIG. 16, positioning sections 86*b* are integrally formed at the bottom of the belt supporting member 86 for positioning the conveyor belt 82 at a given position. The positions of the conveyor belts 82 are determined as the positioning sections 86*b* contact the conveying guide member 72.

Figure 18:
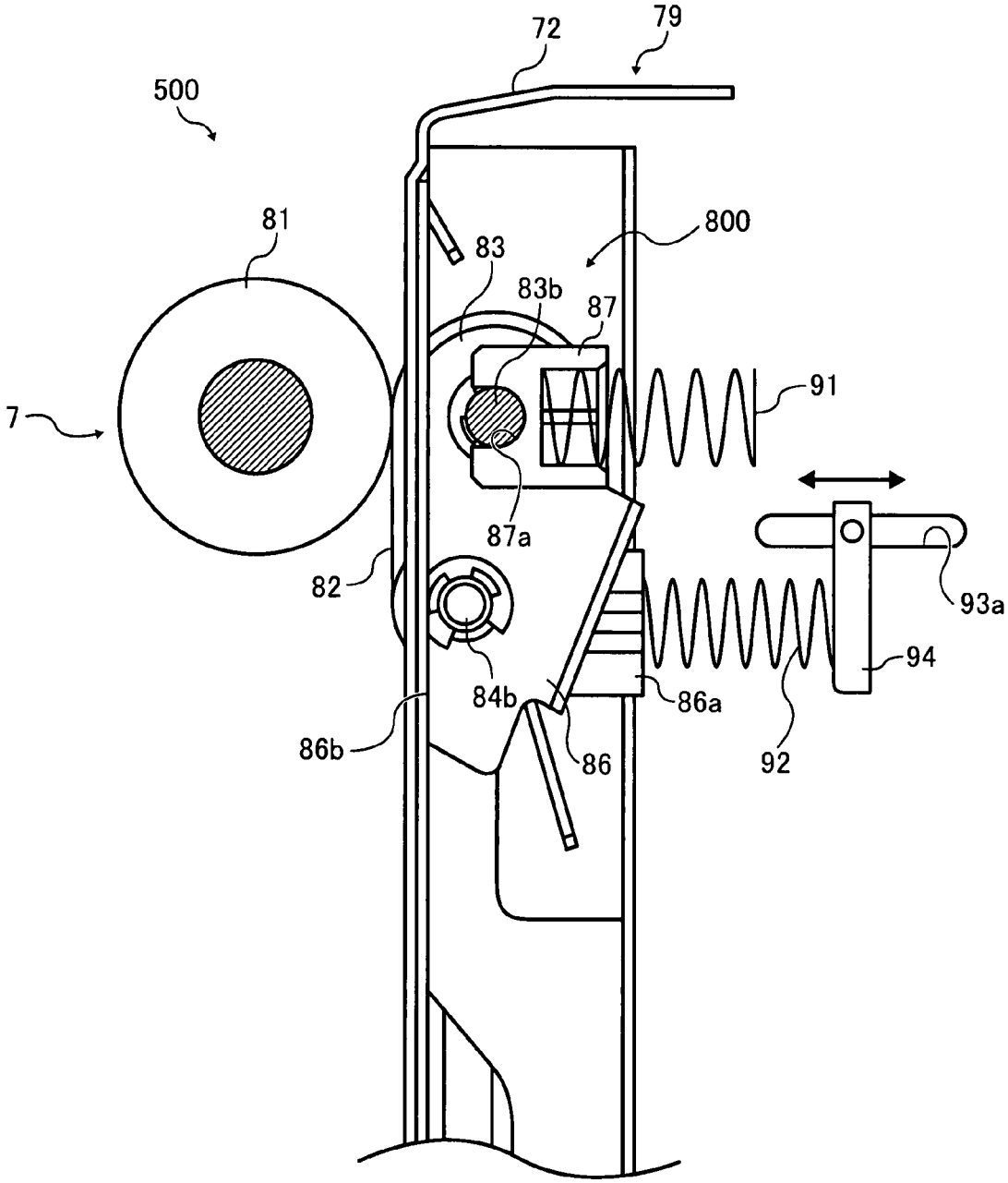
FIG. 18 is a cross-sectional view of relevant parts around a second conveying unit of the sheet conveying device of FIG. 8.

Further, as shown in FIGS. 15 and 18, the positioning sections 86*b* may be made to contact the conveying guide member 72 by the biasing or pressing force of the springs 92 that serve as biasing and elastic members. Therefore, the conveyor belts 82 may be provided at given positions so as to ensure a belt protruding height "h" from a conveying guide rib 72*b* that is formed the sheet conveying device 500 by protruding toward the inside of the sheet conveying device 500 from the conveying guide rib 72*b* of the conveying guide member 72.

As shown in detail in FIG. 18, each of the bearings 87 has a U-shaped groove 87*a*, and the pulley shaft 83*b* is loosely fit in the U-shaped groove 87*a*. Accordingly, the pressing force of the spring 91 may press the conveyor belt 82 against the grip roller 81 via the pulley shaft 83*b*. The position of the pulley shaft 83*b* may be fixed as the conveyor belt 82 is pressed against the grip roller 81. The pulley shaft 84*b* may pivot back and forth or rotatably or swingably move about the pulley shaft 83*b* in a direction indicated by a bidirectional arrow shown in FIG. 16.

As described with reference to FIGS. 15 and 18, one end of the spring 92 may apply a force on the belt supporting member 86. The other end of the spring 92 may be supported and latched by a spring pressuring stage 94. The spring pressuring stage 94 can move along a slit 93*a* formed in the spring bearing member 93 in the direction of the biasing or pressing force of the spring 92, and can also be fixed at an arbitrary position.

In FIGS. 15 and 18, the spring pressuring stage 94 may be fastened and fixed by a screw. With such a configuration, the springs 92 can be arbitrarily pressed to different lengths so that the spring load serving as the pressuring force, i.e., the pressuring force of the springs 92 can be arbitrarily changed.

In the first example embodiment, the two springs 91 have the same spring specifications such as spring load, spring length, shape, etc. Similarly, the three springs 92 have the same spring specifications such as spring load, spring length, shape, etc.

Figure 19A:
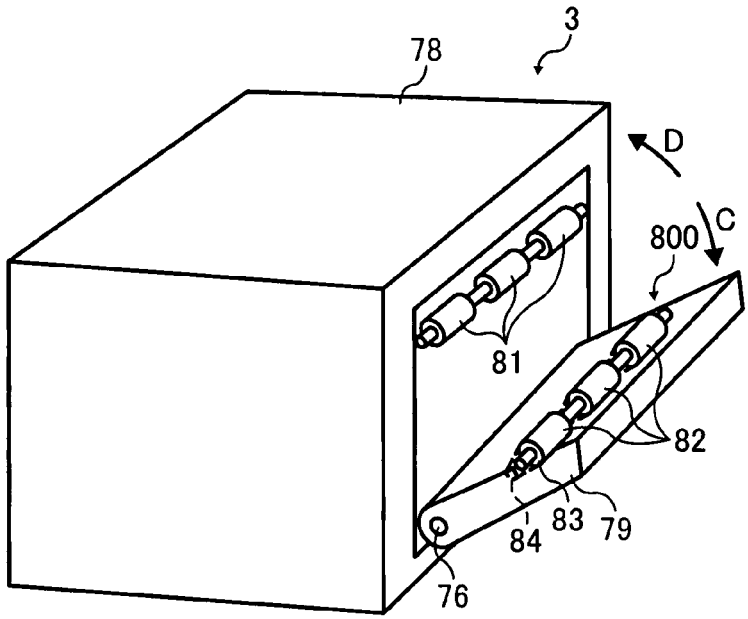
FIG. 19A is a perspective view of a sheet feeding device including the sheet conveying device of FIG. 8.
Figure 19B:
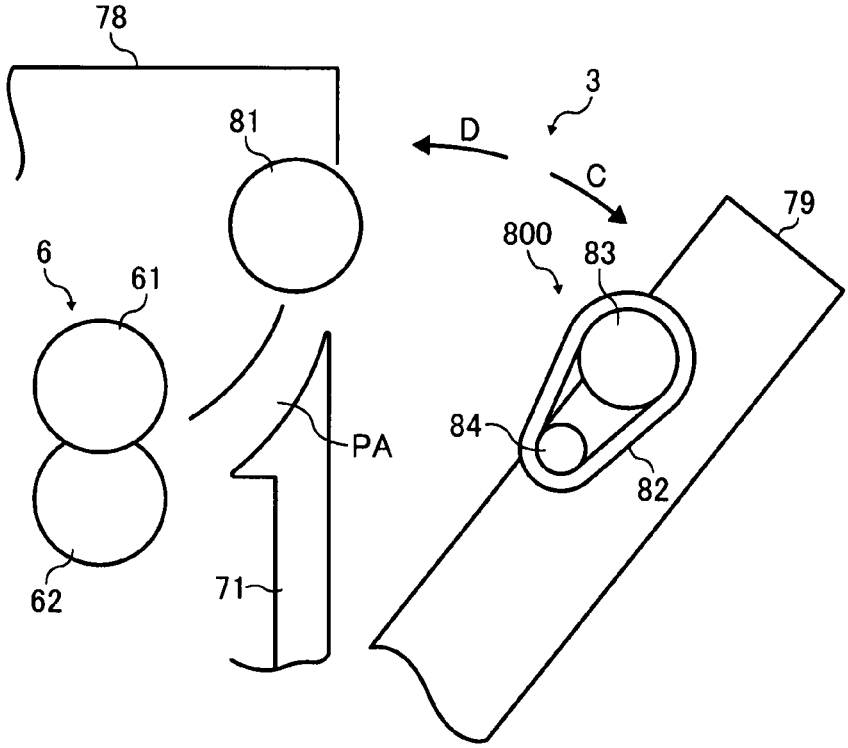
FIG. 19B is a partial cross-sectional view of the sheet feeding device of FIG. 19A.

In reference to FIGS. 19A and 19B, schematic structures of the sheet feeding device 3 are described.

As shown in FIGS. 19A and 19B, the sheet feeding device 3 includes a main body 78 having the opening and closing guide 79 serving as an opening and closing unit. The opening and closing guide 79 may separate the first conveying path PA by opening and closing with respect to the main body 78 including the first conveying unit 6 and so forth shown in FIGS. 4, 5, and 8 through 11. The opening and closing guide 79 may open and close in respective directions indicated by arrows C and D in FIGS. 19A and 19B by pivoting around a fulcrum shaft 76 disposed below the main body 78. Therefore, the opening and closing guide 79 of the sheet feeding device 3 having the configuration shown in FIGS. 19A and 19B can effectively remove a jammed paper or papers therefrom.

In FIGS. 19A and 19B, the opening and closing guide 79 is provided with the belt conveying unit 800 including the multiple conveyor belts 82 in a discontinuous manner along the sheet width direction, while the belt conveying unit 8 including the conveyor belt 82 arranged in a continuous or discontinuous manner along the sheet width direction is mounted on the opening and closing guide 79 in FIG. 4.

As described above, the conveyor belt 82 of the belt conveying unit 800 according to the first example embodiment may be stretched around the pair of roller-type pulleys 83 and 84 with a given tension determined by the relative positions of the pulleys 83 and 84 attached to the belt supporting member 86 via the pulley shafts 83*b* and 84*b*. The conveyor belt 82 may be pressed by the pressing force of the spring 92 against the grip roller 81 that drives the pulley 83. The pulley 83 may be provided in a freely rotatable manner, and be thus caused to rotate following the rotation of the grip roller 81.

In a basic configuration around the belt conveying unit 800 according to this example embodiment of the present invention, the conveyor belt 82 has an appropriate condition determined according to the following considerable parameters.

(1) A rotational load obtained when the conveyor belt 82 is rotated with the grip roller 81 with an increased percentage of extension thereof; and (2) A looseness of the conveyor belt 82 when the conveyor belt 82 is used with a decreased percentage extension thereof.

The conveyor belt 82 generally has a following relation between the rubber hardness and the extension rate.

When the conveyor belt 82 with low rubber hardness is used at a low extension rate thereof, the amount of tension of the conveyor belt 82 may reduce and the conveyor belt 82 cannot be sufficiently functional as the above-described moving and guiding member. For example, when the conveyor belt 82 is spanned around the pulleys 83 and 84 under the condition that the extension rate of the conveyor belt 82 is low, regardless of the rubber hardness degree, straightly extended belt parts of the conveyor belt 82 formed between the pulleys 83 and 84 may expand outwardly as indicated by a dashed line in FIG. 20A.

Further, when the conveyor belt 82 with high rubber hardness is used at a high extension rate thereof, the amount of tension of the conveyor belt 82 may increase and the rotational loads of the pulleys 83 and 84 via the conveyor belt 82 may also increase, thereby causing a rotation torque of the conveyor belt 82 to unnecessarily increase. This makes the conveyor belt 82 difficult to rotate with the grip roller 81. That is, the conveyor belt 82 slips on the grip roller 81, and the linear velocity of the conveyor belt 82 becomes less than the linear velocity of the grip roller 81. Consequently, the conveyor belt 82 cannot obtain a desired linear velocity to achieve the preferable effects of the present invention.

To prevent the above-described disadvantages, such as the looseness of the conveyor belt 82 and/or the unnecessarily large amount of rotational load of the conveyor belt 82 so as to obtain the necessary function(s) of the conveyor belt 82, the inventors of the present invention provided critical thresholds of the conveyor belt 82 in the extension rate and the rubber hardness, with a constant thickness of the conveyor belt 82. Specifically, the inventors set the necessary threshold and evaluation standard of the conveyor belt 82 to cause the conveyor belt 82 to obtain a desired linear velocity that is substantially same as the linear velocity of the grip roller 81.

With the above-described threshold and evaluation standard of the conveyor belt 82, the inventors of the present invention conducted the following tests to evaluate various combinations of the values of the extension rate of the conveyor belt 82 and the hardness of the conveyor belt 82 and determine a given range suitable for holding and stably conveying a sheet.

The tests were conducted under basic conditions same as the conditions shown in FIG. 6 and Table 1, except a specific condition described below. Table 2 shows the results of the above-described tests to determine whether or not the linear velocity of the conveyor belt 82 is substantially same as the linear velocity of the grip roller 81 in the relation of the rubber hardness degree of the conveyor belt 82 including an ethylene propylene rubber and the extension rate of the conveyor belt 82.

As shown in Table 2, the test was conducted under the conditions that the extension rate (%) of the conveyor belt 82 was gradually changed in 7 steps from 10% to 4% while the degree of the rubber hardness (JIS K 6253 Type-A) of the conveyor belt 82 was gradually changed in 3 steps from 40 degrees, 60 degrees, and 80 degrees.

The specific condition of the test was that the conveyor belt 82 had a constant thickness of 1.5 mm. The other test conditions were same as those of the tests shown in Table 1. That is, the distance between the pulleys 83 and 84 was 13 mm, the linear velocity of the grip roller was constant, the test environment was a thermally neutral environment, six types of sheets in a unit of meter basis weight were conveyed, etc.

The extension rate of the conveyor belt 82 in the first example embodiment represents a percentage of extended circumferential length of the conveyor belt 82 spanned around the pulleys 83 and 84 or the rotary belt holding members having a constant distance therebetween to the normal circumferential length of the single conveyor belt 82. That is, the extension rate of the conveyor belt 82 can be obtained with the following equation:

$$(\text{Extended Circumferential Length})/(\text{Normal Circumferential Length})\times 100(\%)-100(\%).$$

For example, when the single conveyor belt 82 has the normal circumferential length of 100 mm before spanned around the pulleys 83 and 84 and the extended circumferential length of 110 mm after spanned around the pulleys 83 and 84, the extension rate of the conveyor belt 82 can be obtained according to the above-described equation as follows:

$$110(\text{mm})/100(\text{mm})\times 100(\%)-100(\%)=10(\%).$$

The above-described equation for obtaining the extension rate of the conveyor belt 82 can be applied to the tests shown in Table 1.

An extension rate of a belt can be obtained when a distance between pulleys serving as rotary belt holding members is constantly fixed and cannot be applied to a belt tensioner, for example, that is a known expensive unit having multiple parts and a complex configuration for applying a tension to a belt.

By contrast, the belt conveying units 8 and 800 serving as a moving and guiding unit according to the present invention is a new and inexpensive unit having less parts and a simple configuration in which the conveyor belt 82 is simply spanned around the pulleys 83 and 84 disposed at a constant distance.

Table 2 shows the test results in evaluation of sheet conveying properties for conveying six types of sheets.

TABLE 2

| | | Hardness (JIS A) (Degree) | | |
|---|---|---|---|---|
| | | 40 degrees | 60 degrees | 80 degrees |
| Extension rate (%) | 10% | GOOD | POOR | POOR |
| | 9% | GOOD | POOR | POOR |
| | 8% | GOOD | POOR | POOR |
| | 7% | GOOD | GOOD | POOR |
| | 6% | GOOD | GOOD | POOR |
| | 5% | GOOD | GOOD | GOOD |
| | 4% | ACCEPTABLE | ACCEPTABLE | ACCEPTABLE |

Details of the evaluation of the test results shown in Table 2 are as follows:

"GOOD" represents the result that the linear velocity of the conveyor belt 82 was substantially same as the linear velocity of the grip roller 81 (or a desired linear velocity of the conveyor belt 82 was obtained), and therefore, the conveyor belt 82 having the combination of the hardness and the extension rate can be used without any particular disadvantage.

Figure 20A:
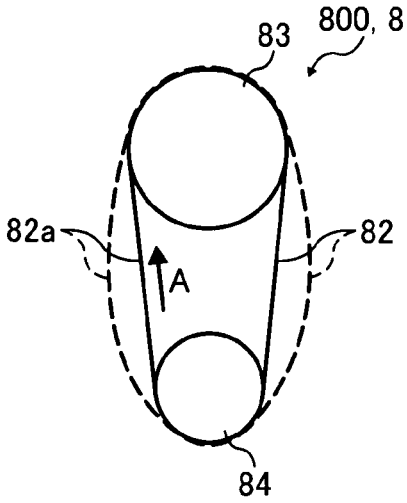
FIG. 20A is a schematic front view of a belt conveying unit of the sheet conveying device of FIG. 8.

"ACCEPTABLE" represents the result that, through an external observation, it was found that the conveyor belt 82 produced a straightly extended belt parts formed between the pulleys 83 and 84 expanded outwardly as indicated by a dashed line in FIG. 20A when the extension rate of the conveyor belt 82 was 4%. Therefore, when the sheet feeding device 3, for example, includes the lower sheet feeding cassette 51 further provided below the upper sheet feeding cassette 51 and the conveying guide member 71 also serving as the second conveying path PB and a guide, the conveyor belt 82 may interfere the conveying guide member 71, as indicated by the chain double-dashed line in FIG. 20B.

Figure 20B:
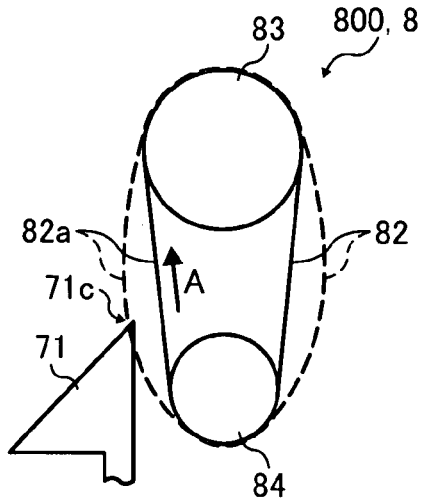
FIG. 20B is a schematic front view of the belt conveying unit moved to a different position from the view of FIG. 20A.

However, when the second conveying path PB from the lower sheet feeding cassette 51 is not provided as shown in FIGS. 2 through 5, the conveying guide member 71 as indicated by a solid line in FIG. 20B may be shifted to the left-hand side in FIGS. 2 through 5 so as not to interfere with the conveyor belt 82 as indicated by the dashed line in FIG. 20B. It is because there is no particular problem in moving and guiding the leading edge of the sheet S when a distance from a downstream end 71*c* of the conveying guide member 71 to the conveyor belt 82 in the sheet travel direction.

In other words, the conveying surface 82*a* of the conveying belt 82 contacting the sheet S may outwardly be extended to a direction sufficient to interfere with the downstream end 71*c* of the conveying guide member 71 under the condition that the hardness of the conveyor belt 82 is in a range of from approximately 40 degrees to approximately 80 degrees and the extension rate is approximately 4%. In this case, by moving or shifting the conveying guide member 71 from the conveying surface 82*a* of the conveyor belt 82 to a position on the left-hand side of FIG. 20B so that the conveying guide member 71 may not interfere with the conveying surface 82*a* of the conveyor belt 82, the conveyor belt 82 satisfying the above-described specific condition can be employed.

"POOR" represents the result that the belt method according to the present invention did not obtain the desired linear velocity of the conveyor belt 82 because the conveyor belt 82 had a large extension rate and rubber hardness, the rotational load of the conveyor belt 82 increased, the conveyor belt 82 slipped on the surface of the grip roller 81, and therefore, the linear velocity of the conveyor 82 was smaller than the linear velocity of the grip roller 81.

According to the test results shown in Table 2, the inventors of the present invention found the preferable relations between the rubber hardness of the conveyor belt 82 and the extension rate of the conveyor belt 82 as follows:

When the rubber hardness of the conveyor belt 82 is set to approximately 40 degrees, it is preferable to set the extension rate of the conveyor belt 82 in a range of from approximately 5% to approximately 10%;

When the rubber hardness of the conveyor belt 82 is set to approximately 60 degrees, it is preferable to set the extension rate of the conveyor belt 82 in a range of from approximately 5% to approximately 7%; and When the rubber hardness of the conveyor belt 82 is set to approximately 80 degrees, it is preferable to set the extension rate of the conveyor belt 82 to approximately 5%.

Further, the inventors found that, when the rubber hardness of the conveyor belt 82 was small, a large extension rate of the conveyor belt 82 did not exert an adverse affect to the conveyor belt 82 in rotation following the grip roller 81.

However, the test results of the extension rate of 4% with the rubber hardness in a range of from approximately 40 degrees to approximately 80 degrees were all "ACCEPTABLE", and therefore, the above-described rubber hardness can be applied only under the above-described specific condition that the conveyor belt 82 has the thickness of 1.5 mm.

Next, tables of FIGS. 26 through 31 show results of tests different from the previous tests, conducted by the inventors of the present invention.

In addition to the specific condition that the conveyor belt 82 had a constant thickness of 1.5 mm in the previous tests, the inventors of the present invention added the thickness of the conveyor belt 82 as a parameter of the tests and provided additional thresholds of the conveyor belt 82 in the thickness, the extension rate, and the rubber hardness. Further, the inventors of the present invention changed the degree of the rubber hardness (JIS K 6253 Type-A) of the conveyor belt 82 in 5 steps, which are 40 degrees as shown in the table of FIG. 26, 50 degrees as shown in the table of FIG. 27, 60 degrees as shown in the table of FIG. 28, 70 degrees as shown in the table of FIG. 29, and 80 degrees as shown in the table of FIG. 30.

The other parameters were same as the previous tests. Specifically, the inventors set the necessary threshold and evaluation standard of the thickness, extension rate, and rubber hardness of the conveyor belt 82 to cause the conveyor belt 82 to obtain its desired linear velocity that is substantially same as the linear velocity of the grip roller 81.

With the above-described threshold and evaluation standard of the conveyor belt 82, the inventors of the present invention conducted the tests to evaluate various combinations of the values of the thickness, extension rate, and rubber hardness of the conveyor belt 82 and determine a given range suitable for holding and stably conveying a sheet. The test results are shown in the tables of FIGS. 26 through 30. It is noted that the tables of FIGS. 26 through 30 partially include the results of the previous tests. Specifically, the results of the tests were same as the previous tests when conducted under the conditions that the thickness of the conveyor belt 82 was 1.5 mm, the rubber hardness of the conveyor belt 82 was provided in 3 steps at 40 degrees, 60 degrees, and 80 degrees, and the extension rate of the conveyor belt 82 was gradually changed in 7 steps from 10% to 4%.

The basic evaluation standard of the conveyor belt 82 in the tests was conducted under the conditions similar to the conditions of the previous tests, except specific conditions described later. Then, the results in the tables of FIGS. 26 through 30 showing relations of the thickness, rubber thickness, and extension rate of the conveyor belt 82 made of ethylene propylene rubber were obtained to determine whether the linear velocity of the conveyor belt 82 was substantially same as the linear velocity of the grip roller 81. As shown in FIGS. 26 through 30, the thickness of rubber of the conveyor belt 82 were changed by 0.1 mm from 1.5 mm to 4.0 mm when the rubber hardness was at 40 degrees, from 1.5 mm to 3.5 mm when the rubber hardness was at 50 degrees, and from 1.5 mm to 3.2 mm when the rubber hardness was at 60, 70, or 80 degrees, while the extension rate (%) of the conveyor belt 82 was gradually changed in 7 steps from 10% to 4%. At the same time, the degree of the rubber hardness (JIS K 6253 Type-A) of the conveyor belt 82 was changed in 5 steps, which are 40 degrees, 50 degrees, 60 degrees, 70 degrees, and 80 degrees.

The other conditions are same as the conditions of the previous test, including the conditions that the distance between the pulley shaft 83*b* of the pulley 83 and the pulley shaft 84*b* of the pulley 84 was a constant distance of 13 mm, the linear velocity of the grip roller was constant, and the test environment was a thermally neutral environment, six types of sheets in a unit of meter basis weight were conveyed.

In FIGS. 26 through 30, the detailed meanings of "GOOD", "ACCEPTABLE", and "POOR" for describing the results of the conveying performance of the six types of sheets as shown in Table 1 and the technical contents for the evaluation "ACCEPTABLE" are same as the previous tests. Therefore, the detailed descriptions thereof are omitted here. However, the meaning of the evaluation "ACCEPTABLE" is different in the tests shown in FIGS. 26 through 30 under the specific conditions that the rubber hardness of the conveyor belt 82 is in a range of from 40 degrees to 80 degrees, the extension rate of the conveyor belt 82 is 4%, and the thickness of rubber of the conveyor belt 82 is 1.5 mm. In the tests the results of which are shown in FIGS. 26 through 30, when the conveying surface 82*a* of the conveyor belt 82 contacting a sheet is outwardly extended to a direction interfering with the downstream end 71*c* of the conveying guide member 71, the conveyor belt 82 satisfying the above-described specific conditions can be employed by moving or shifting the conveying guide member 71 from the conveying surface 82*a* of the conveyor belt 82 to a position on the left-hand side of FIG. 20B so that the conveying guide member 71 may not interfere with the conveying surface 82*a* of the conveyor belt 82.

According to the test results shown in FIGS. 26 through 30, the inventors found that it is preferable the relations of the three parameters, which are the thickness, rubber hardness, and extension rate, are set to the thickness, rubber hardness, and extension rate of the conveyor belt 82 under the conditions satisfying the evaluation "GOOD". Further, the inventors found that, when the rubber hardness of the conveyor belt 82 is small and the extension rate is great, an effect to the action of the conveyor belt 82 rotating with the grip roller 81 is small. However, the test results of the extension rate of 4% with the rubber hardness in a range of from approximately 40 degrees to approximately 80 degrees were all "ACCEPTABLE", and therefore, the above-described rubber hardness can be applied only under the above-described specific conditions.

The thickness of the conveyor belt 82 may vary depending on the relation with the rubber hardness and extension rate of the conveyor belt 82. The test results in FIGS. 26 through 30 shows that it is preferable that the conveyor belt 82 has the thickness of equal to or greater than 1.5 mm. However, it is needless to say that the upper limit value may be restricted when resource saving of materials of the conveyor belt 82, the cost saving according to the resource saving, the working properties in manual assembling of the conveyor belt 82 to the pulleys 83 and 84 are considered in a comprehensive manner.

An additional description is given of the setting of the rubber hardness of the conveyor belt 82.

The setting of the rubber hardness according to a general design of the conveyor belt 82 has a design tolerance or margin of error of ±5 degrees. Based on this standpoint, the rubber hardness of the conveyor belt 82 according to the test results shown in FIGS. 26 through 30 may be set in a range of from approximately 85 degrees to approximately 35 degrees. In other words, an appropriate upper limit value of the rubber hardness of the conveyor belt 82 may be 85 degrees while the upper limit is set to 80 degrees in FIG. 30, and an appropriate lower limit value of the rubber hardness of the conveyor belt 82 may be 35 degrees while the lower limit is set to 40 degrees in FIG. 26.

Figure 21:
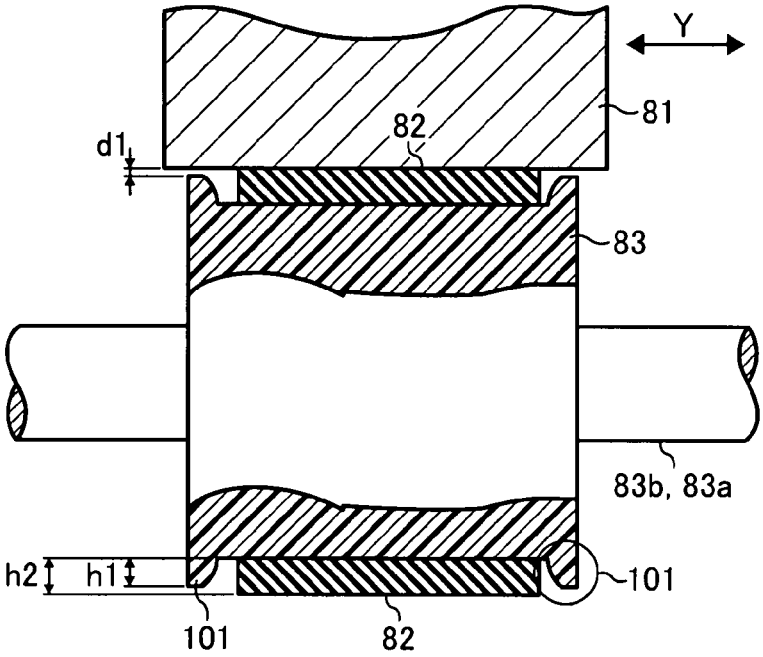
FIG. 21 is a cross-sectional view of relevant parts around the belt conveying unit of FIGS. 20A and 20B.
Figure 31:
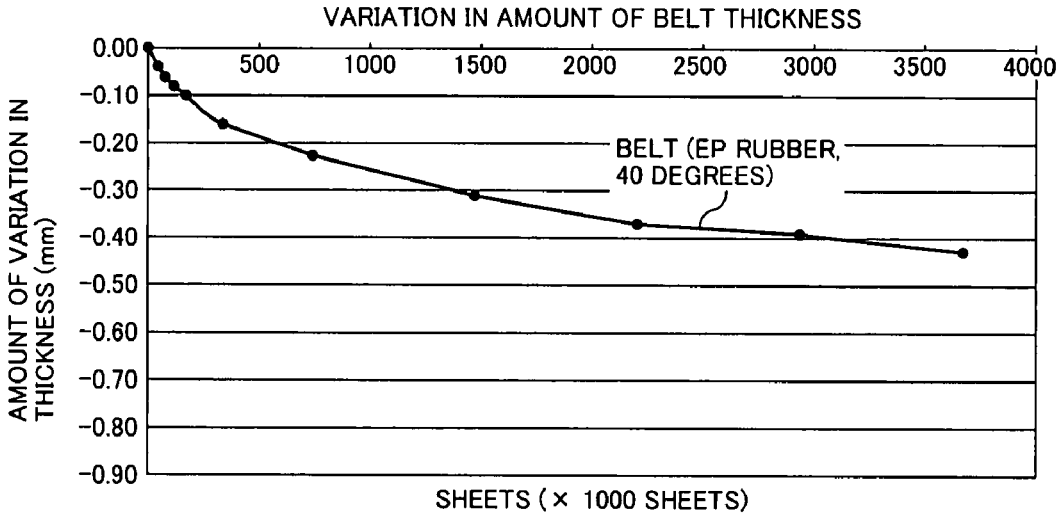
FIG. 31 is a graph showing amounts of variation in thickness of the conveyor belt during the duration tests.

A detailed description is given of the reason that the lower limit value of the thickness or height "h2" of the conveyor belt 82 was set to 1.5 mm, in reference to FIGS. 21 and 31.

At each end of the pulley 83, a flange part 101 protruding from an axial center of the pulley 83 toward a distal direction is integrally formed so as to cause the conveyor belt 82 to stay on the pulley 83 without coming off the pulley 83. A height "h1" of the flange part 101 is generally set to 1.0 mm.

In addition, by accounting for the change of the conveyor belt 82 with age, even when the conveyor belt 82 abrades or wears away, an outer circumferential surface of the flange part 101 is controlled not to protrude more than an outer circumferential surface or the conveying surface 82*a* of the conveyor belt 82. That is, a thickness or height "h2" of the conveyor belt 82 is controlled to be greater than or equal to the height "h1" so as not to satisfy the relation of "h1>h2".

Accordingly, the inventors of the present invention conducted duration tests to check how much the thickness or height "h2" of the conveyor belt 82 changes depending on the number of copies.

FIG. 31 shows the results of the duration tests.

In FIG. 31, the horizontal scale is indicative of the number of sheets to be copied (×1000 sheets) and the vertical scale is indicative of the amount of variation in thickness of the conveyor belt 82 or the amount of abrasion of the conveyor belt 82 (mm). As shown in FIG. 31, the maximum value of the variation amount of thickness of the conveyor belt 82 was obtained based on the duration tests of the conveyor belt 82.

In the duration tests, the inventors of the present invention used the conveyor belt 82 including a resin treated with an abrasion-resistant process. The material of the resin is made of ethylene propylene rubber (EPDM or EP rubber in FIG. 31) with a hardness of 40 degrees, which is the hardness most easily wearing away. Hereinafter, the conveyor belt 82 used in the duration tests is referred to as "YA product." The duration tests were conducted in a same manner as the previous tests.

After the completion of the duration tests, the inventors of the present invention obtained the results as shown in FIG. 31. Specifically, when 3.7 million copies were reproduced with a regular sheet or PPC paper, the maximum value of the amount of variation in thickness of the conveyor belt 82 was −0.42 mm while the target value was −0.5 mm or below, for example.

Therefore, by accounting that the height "h1" of the flange part 101 is approximately 0.1 mm in general and that the maximum value of the amount of variation in the thickness or height "h2" of the conveyor belt 82 is −0.42 mm according to the above-described duration tests, the thickness or height "h2" of the conveyor belt 82 is determined to protrude by 0.5 mm (h2−h1=0.5) greater than the outer circumferential surface of the flange part 101 with the height "h1". That is, the practical lower limit value of the thickness or height "h2" of the conveyor belt 82 is set to approximately 1.5 mm.

For example, when the height "h1" of the flange part 101 is set to 0.5 mm, the conveyor belt 82 may run on the flange part 101 and come off the pulleys 83 and 84. Therefore, the height "h1" of the flange part 101 was set to 1.0 mm.

The setting of the height "h1" of the flange part 101 is not limited to 1.0 mm when the resource saving and/or cost saving related to the settings of the thicknesses of the flange part 101 and of the conveyor belt 82 may not be considered.

In general, as the rubber hardness of the conveyor belt 82 increases, the amount of abrasion of the conveyor belt 82 decreases from the results of the duration tests.

Further, a relatively rigid sheet, for example, a sheet having 256 g/m$^2$ meter basis weight or more (see Table 1) can be used to copy. When such a relatively rigid sheet is used and the conveyor belt 82 has a rubber hardness of 40 degrees used in the above-described duration tests, it is possible that the maximum amount of variation in thickness of the conveyor belt 82 becomes slightly greater than the maximum amount thereof obtained when the regular paper is used. In this case, the linear velocity of the relatively rigid sheet is same as the linear velocity of the regular paper. However, in the actual condition, the linear velocity of the above-described relatively rigid sheet may be quite smaller than the linear velocity of the regular sheet. Specifically, the linear velocity of the relatively rigid sheet may be approximately ⅓ of the linear velocity of the regular sheet. Accordingly, it is considered that the maximum amount of variation in thickness of the conveyor belt 82 when the relatively rigid sheets are used is substantially same as the maximum amount of variation in thickness of the conveyor belt 82 when the regular sheets are used. Alternatively, by setting the rubber hardness of the conveyor belt 82 to a higher value to correspond to the relatively rigid sheet, it is possible to obtain the maximum amount of variation in thickness of the conveyor belt 82 for using the relatively rigid sheets to be substantially same as the maximum amount of variation in thickness of the conveyor belt 82 for using the regular sheets.

In an example shown in FIG. 21, the width of the grip roller 81 is greater than the width of the pulley 83. The height "h1" of the flange part 101 integrally mounted on the pulley 83 is set to smaller than the thickness or height "h2" of the conveyor belt 82. Therefore, a distance "d1" is provided between the surface of the grip roller 81 and the flange part 101 to satisfy a relation of "h2>h1>d1." Under this relation, the conveyor belt 82 may not come off from the pulley 83 and the flange part 101 of the pulley 83 may not interfere with the sheet S, thereby securing preferable sheet conveying properties without giving any damage to the sheet S.

Next, a description is given of the conditions of the front side and back side of the conveyor belt 82 and the surface treatment thereof.

In the first example embodiment, the conditions of the outer circumferential surfaces of the pulleys 83 and 84 contacting the back side of the conveyor belt 82 are flat and smooth, while a known belt used for driving has a tooth-shaped surface like a gear so that the belt and a pulley can surely engage with each other to stably maintain a constant linear velocity. The conveyor belt 82 of the first example embodiment frictionally contacts the grip roller 81 to rotate with the grip roller 81 shown in FIG. 21, thereby rotating the pulleys 83 and 84 with the conveyor belt 82 spanned therearound. Therefore, the slippage caused between the conveyor belt 82 and the pulleys 83 and 84 does not practically impact on sheet conveying properties. However, when the conveyor belt 82 is not rotate with the grip roller 81, the slippage caused between the conveyor belt 82 and the grip roller 81 may impact on sheet conveying properties.

It is general that the conveyor belt 82 is processed with texture or crepe finishing to a specific mold for providing concave and convex parts or irregularity on the outer circumferential surface thereof. Belt polishing that may provide polishing marks for enhancing accuracy in thickness of a belt may also be conducted to prevent adhesion of paper powder.

When the outer circumferential surface or conveyor surface 82*a* of the conveyor belt 82 is flat and smooth, the conveyor belt 82 may slip on the grip roller 81 and not rotate with the grip roller 81. Texture finishing and belt polishing can prevent such a slippage. These processes, however, have different surface treatment methods. In addition, the texture finishing process can be processed at lower cost than the belt polishing process.

The inventors of the present invention further conducted additional tests with the parameters, which are the coefficient of friction of the outer circumferential surface of the pulley 83 to the back side of the conveyor belt 82 contacting the outer circumferential surface of the pulley 83, and the rubber hardness of the conveyor belt 82.

According to the results of the additional tests, the inventors of the present invention found the relations between the rubber hardness of the conveyor belt 82 and the coefficient of friction of the outer circumferential surface of the pulley 83 as follows:

When the rubber hardness of the conveyor belt 82 is set to approximately 40 degrees, it is preferable to set the coefficient of friction of the outer circumferential surface of the pulley 83 to approximately 2.6;

When the rubber hardness of the conveyor belt 82 is set to approximately 60 degrees, it is preferable to set the coefficient of friction of the outer circumferential surface of the pulley 83 to approximately 1.8; and When the rubber hardness of the conveyor belt 82 is set to approximately 80 degrees, it is preferable to set the coefficient of friction of the outer circumferential surface of the pulley 83 to approximately 1.2.

It is confirmed that the coefficient of friction of the outer circumferential surface of the pulley 83 can generally be set to 0.8 as the lower limit value. Even when a hardness of the conveyor belt 82 is same, the elements disposed in the material of the conveyor belt 82 may be different to each other. Therefore, the coefficient of friction of the outer circumferential surface of the pulley 83 has a certain degree of tolerance. With this point in view, even through the coefficient of friction of the outer circumferential surface of the pulley 83 is set to approximately 1.2 according to the test result, the lower limit value thereof can be set to approximately 0.8.

Accordingly, the inventors found that the coefficient of friction of the outer circumferential surface of the pulley 83 to the back side of the conveyor belt 82 can be set in a range of from approximately 0.8 to approximately 2.6.

Therefore, according to the first example embodiment, the following advantages can be achieved.

In the combination of the rubber hardness (JIS K6253 A-scale) and the extension rate of the conveyor belt 82, when the rubber hardness is set in a range of from approximately 40 degrees to approximately 80 degrees and the extension rate is set in a range of from approximately 5% to approximately 10%, the conveyor belt 82 can constantly and appropriately become elastically displaced and/or deformed so that the sheet S can be stably held and conveyed without causing the leading edge of the sheet S to bounce back.

Further, the grip rollers 81 and the conveyor belts 82 of the belt conveying unit 840 are disposed at given intervals to reduce costs, compared with a case in which a long and single belt conveying unit 8 is used.

In addition, the conveyor belt 82 of the belt conveying unit 800 directly contacts the grip roller 81 that is a rotary conveyance member and is rotated by the driving mechanism 22, so that the conveyor belt 82 can rotate following the rotation of the grip roller 81. Variations in the linear velocity of the conveyor belt 82 can be more reduced by driving the grip roller 81, compared to the case in which the conveyor belt 82 is driven. Therefore, the following advantages can be achieved by arranging or disposing the conveyor belt 82 along the outer side of the turning or curved section of the common conveying path PM formed at which the first conveying path PA and the second conveying path PB merge. The above-described structure can cause the conveyor belt 82 to rotate toward the sheet holding section of the second conveying unit 7. That is, it is possible to enhance sheet conveying properties for conveying relatively rigid sheets such as a cardboard recording paper at the turning or curved section of the first conveying path PA. Furthermore, by causing the conveyor belt 82 to rotate following the rotation of the grip roller 81 that faces and directly contacts the conveyor belt 82, the sheet S can be conveyed at a steady linear velocity beyond the second conveying unit 7.

These advantages and effects are easily understandable by considering the following technique.

In a case in which the grip roller 81 is driven, the linear velocity of the grip roller 81 may be determined based on the outside diameter of the grip roller 81 and the rotational speed. Conversely, in a case in which the conveyor belt 82 is driven, it may usually need to drive the roller-type pulley 83 (belt driving roller, main pulley) provided inside the conveyor belt 82.

In this case of driving the conveyor belt 82, the linear velocity of the conveyor belt 82 may be determined not only based on the outside diameter and the rotational speed of the pulley 83 provided inside the conveyor belt 82. That is, the linear velocity is also affected by variations in the thickness of the conveyor belt 82 caused by variations in components, changes in the thickness of the conveyor belt 82 caused by attrition, or slipping actions between the conveyor belt 82 and the pulley 83. Therefore, variations in the linear velocity of the conveyor belt 82 can be more reduced by driving the grip roller 81 rather than driving the conveyor belt 82.

Further, the pulleys 83 and 84 or rotary belt holding members may axially be supported by the belt supporting member 86 in such a manner that a fixed distance is maintained between their axes. The pulley shafts 83*b* and 84*b* of the pulleys 83 and 84, respectively, may be disposed in the belt supporting member 86 in such a manner that the conveyor belt 82 including an elastic member has a longer circumference when stretched around the pulleys 83 and 84, compared to a case when the conveyor belt 82 is by itself (in a non-stretched state). This example embodiment is not provided with a tightener, which is a typically used mechanism for applying tension to a belt. Instead, the conveyor belt 82 is elastically stretched between the two pulleys 83 and 84. Therefore, the configuration of the sheet conveying device 500 according to the first example embodiment can be simple, space-saving, and cost-saving, compared to a configuration provided with a tightening mechanism such as a tightener.

Accordingly, the configuration of the sheet conveying device 500 that includes enhanced sheet conveying properties for conveying relatively rigid sheets such as a cardboard recording paper at the turning section of the first conveying path PA can be simple, space-saving, and cost-saving.

Further, the coefficient of friction of the outer circumferential surface of the pulley 83 to the back side of the conveyor belt 82 is set in a range of from approximately 0.8 to approximately 2.6. Accordingly, the conveyor belt 82 can be stably rotated with the grip roller 81 and can stably grip the sheet S.

Second Example Embodiment

Referring now to FIGS. 22, 23, 24A, and 24B, schematic configurations of a copier 1A including a sheet conveying device 510 are described, according to a second example embodiment of the present invention.

As previously described, elements having the same functions and shapes are denoted by the same reference numerals throughout the specification and redundant descriptions are omitted.

The copier 1A including the sheet conveying device 510 is primarily different from the copier 1 shown in FIGS. 2 through 5 and 8 through 10 in the following points and subsequently described characteristics.

Instead of the sheet conveying device 5 including the first conveying unit 6 on the upper side, the second conveying unit 7', the first conveying unit 6 on the lower side, and the second conveying unit 7 in the sheet feeding device 3, the sheet conveying device 510 of the second example embodiment includes a first conveying unit 600 on the upper side, the second conveying unit 7', a first conveying unit 600 on the lower side, and the second conveying unit 7 in the sheet feeding device 3. The sheet conveying device 500 of the first example embodiment of the present invention has similar structure and functions, except the above-described structure.

Figure 22:
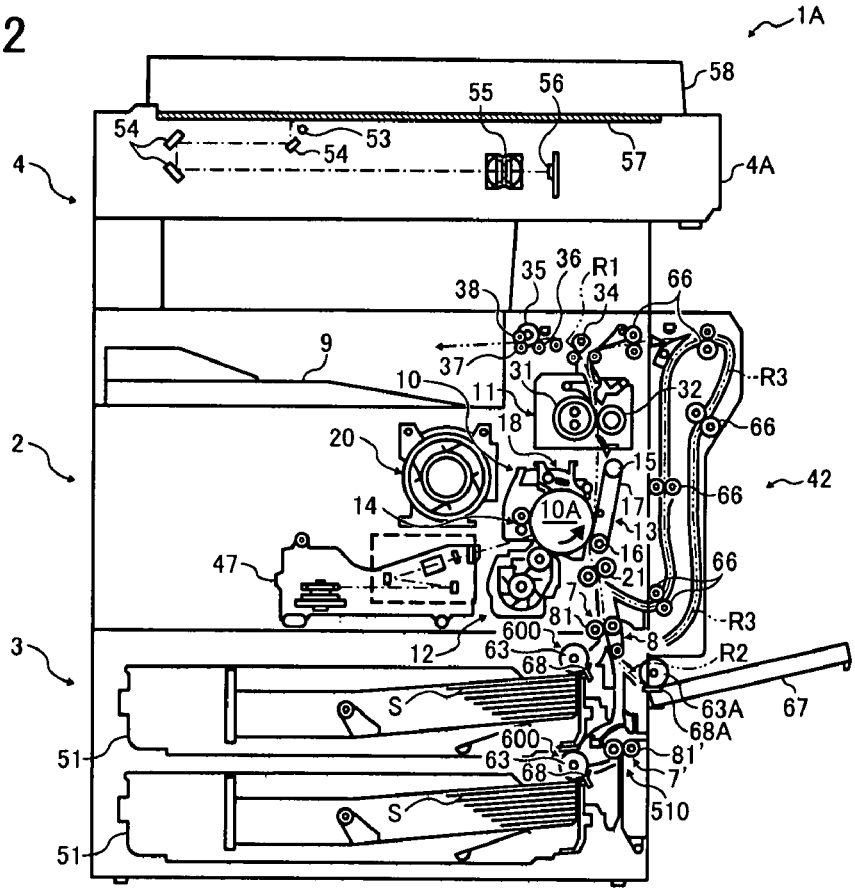
FIG. 22 is an elevation view of a schematic entire configuration of an image forming apparatus including a sheet conveying device according to an example embodiment of the present invention.
Figure 23:
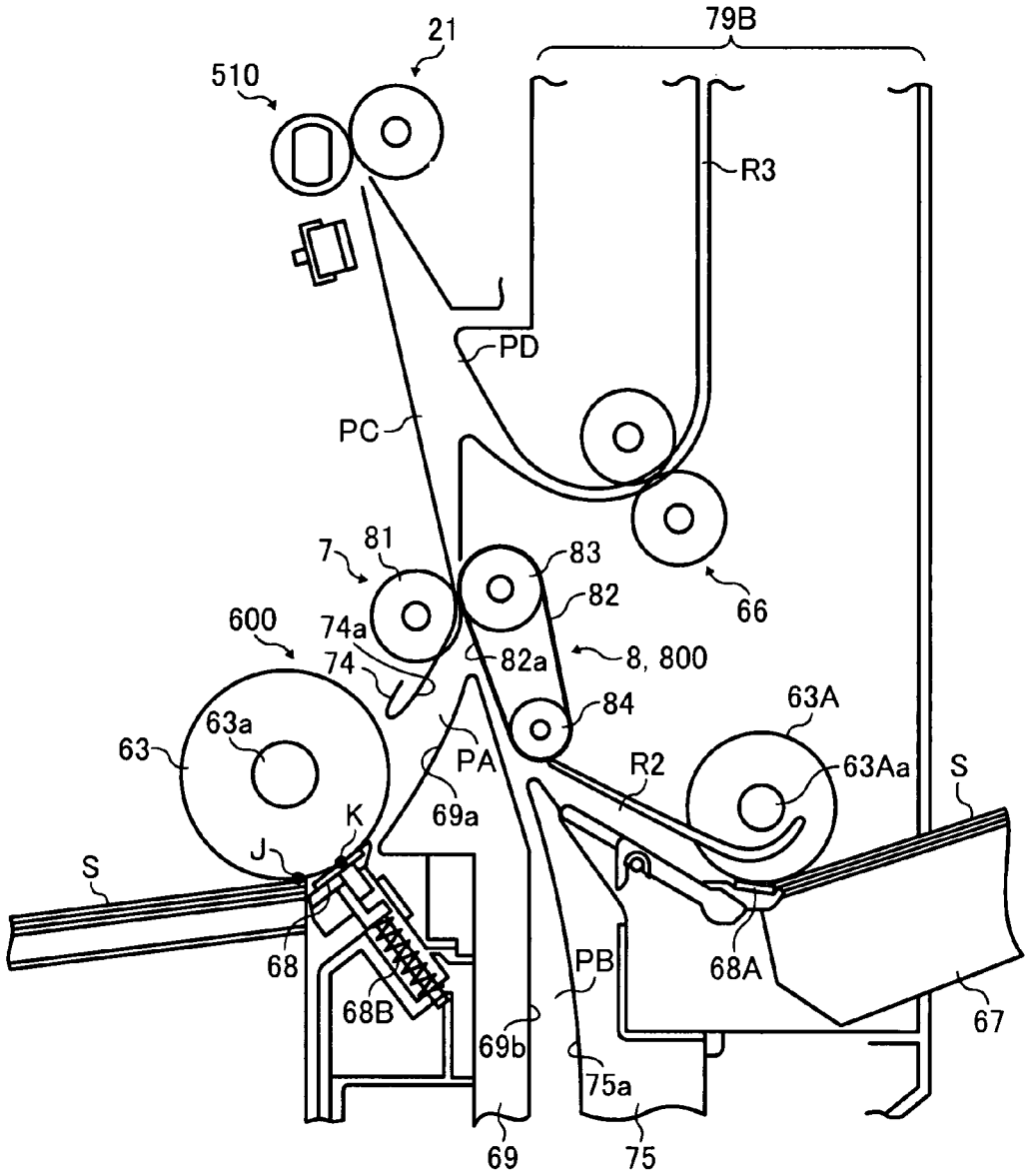
FIG. 23 is a cross-sectional view of a sheet conveying device of the image forming apparatus of FIG. 22.
Figure 24A:
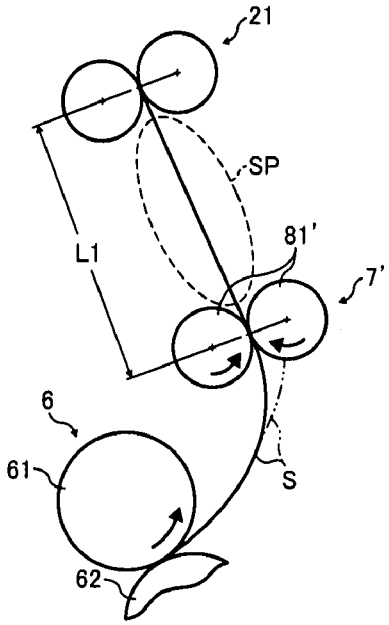
FIG. 24A is a drawing showing a state of a sheet conveying path from a first conveying unit to a pair of registration rollers of the sheet conveying device of FIG. 23.
Figure 24B:
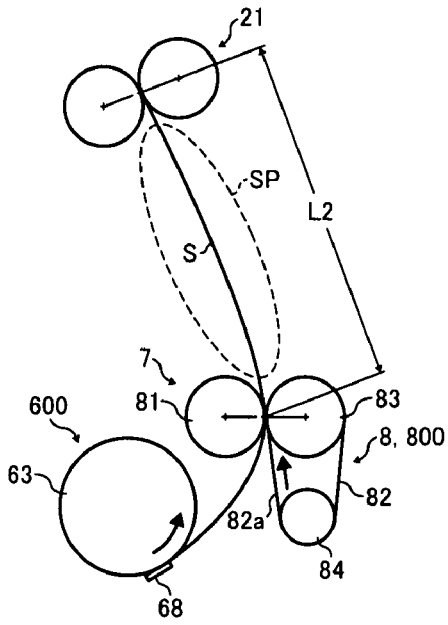
FIG. 24B is a drawing showing another state of the sheet conveying path from a first conveying unit to a pair of registration rollers of the sheet conveying device of FIG. 23.

Specifically, the sheet conveying device 510 of the second example embodiment shown in FIGS. 22, 23, and 24B is primarily different from the sheet conveying devices 5, 5A, and 5B of the first, second, and third examples shown in FIGS. 2 through 5 and 8 through 11 in the following points and subsequently described characteristics.

The sheet conveying device 510 employs the first conveying unit 600 performing a sheet separation method with a friction pad to separate sheets accommodated in the upper and lower sheet feeding cassettes, while the sheet conveying device 5 employs the FRR sheet separation method. This change has reduced the space in the horizontal direction or width direction of the sheet feeding device 3 in FIG. 2.

The manual sheet feeding tray 67 also used the friction pad sheet separation mechanism. This change has shifted the location of the manual sheet feeding tray 67 to the left side of the sheet feeding device 3 in FIG. 2.

The location of the belt conveying unit 8 serving as a moving guide member of the second conveying unit 7) has changed from the lower sheet feeding cassette 51 to the upper sheet feeding cassette 51 so as to feed a relatively rigid sheet S such as a cardboard recording paper from the upper sheet feeding cassette 51 of the sheet feeding device 3.

The entire position of the belt conveying unit 8 (especially, the conveying surface 82*a*) and the sheet S are arranged so as to convey in a left oblique direction, at a position closer to the first conveying unit 600.

According to the above-described change of the belt conveying unit 8, the third conveying path PC, which is a reverse conveying path, from the second conveying unit 7 including the belt conveying unit 8 to the pair of registration rollers 21 has shifted to the left side in FIGS. 22 and 23. Therefore, a fourth conveying path PD serving as a common conveying path that merges with the reverse conveying path R3 of the sheet reversing device 42 is shifted to the left side in FIGS. 22 and 23.

The conveying surface 82*a* of the conveyor belt 82 is disposed along the inner side of the manual sheet feeding path R2 through which the sheet S fed from the manual sheet feeding tray 67 is conveyed.

Regarding a sheet separation mechanism, the feed roller 61 and the reverse roller 62 shown in FIGS. 2 and 21A are removed and a sheet separation mechanism using friction pads is employed for the upper and lower sheet feeding cassettes 51. As shown in FIGS. 20 and 21B, the friction pad sheet separation mechanism for each of the upper and lower sheet feeding cassettes 51 includes a feed roller 63, a friction pad 68, and a spring (compression spring) 68B.

The feed roller 63 serves as a rotary sheet feeding member and is rotatably supported via a shaft 63*a* in a sheet feeding direction.

The friction pad 68 serves as a frictionally resisting member to abut against the feed roller 63. The friction pad 68 is also referred to as a separation pad.

The spring 68B serves as a biasing or pressing member to press the friction pad 68 to the feed roller 63.

The sheet separation mechanism using a friction pad or the friction pad sheet separation mechanism separates a sheet S, which is placed on top of a stack of sheets in the sheet feeding cassette 51, one by one from the other sheets therein and feed the separated sheet by actions of the feed roller 63 in rotation and the friction pad 68. That is, in the friction pad sheet separation mechanism, the spring 68B provides a separation force via a slider, not shown, to the friction pad 68 that abuts against the feed roller 63 at a given separation angle. This abutment of the friction pad 68 against the feed roller 63 forms a nip contact therebetween, so that the sheet S can pass the nip contact when the sheet S is conveyed. Therefore, when two or more sheets are picked up at the same time, the picked-up sheets other than a top sheet may receive the resistance from the friction pad 68 greater than the resistance from the friction with the other picked-up sheets. This can prevent the movement of the picked-up sheets beyond the nip contact. On the other hand, the top sheet may receive the resistance from the feed roller 63 greater than the resistance from the other picked-up sheets and the resistance from the friction pad 68. Accordingly, the top sheet can be conveyed in the sheet conveying direction.

The manual sheet feeding tray 67 of the copier 1A also employs the above-described sheet separation mechanism. That is, instead of the sheet feeding roller 67A and the separating rollers 67B and 67C shown in FIG. 2, the friction pad sheet separation mechanism for the manual sheet feeding tray 67 shown in FIGS. 22 and 23 includes a feed roller 63A, a friction pad 68A, and a spring (compression spring), not shown.

The feed roller 63A serves as a rotary sheet feeding member and is rotatably supported via a shaft 63Aa in a sheet feeding direction.

The friction pad 68A serves as a frictionally resisting member to abut against the feed roller 63A.

The spring, not shown, serves as a biasing or pressing member to press the friction pad 68A to the feed roller 63A.

When the FRR sheet separation mechanism is employed as shown in the sheet conveying device 5 in FIG. 2, the reverse roller (separation roller) 62 is provided for separating and feeding a sheet one by one to the downstream side of the pickup roller 60. Therefore, the space in the sheet conveying device 5 increases in the width direction or the horizontal direction in FIG. 2 and the copier 1 may increase the size.

By contrast, when the friction pad sheet separation mechanism using the friction pad 68 is employed as shown in the sheet conveying device 510 in FIGS. 22, 23, and 24B, the reverse roller 62 may not be necessarily provided and can be removed. Therefore, the space in the sheet conveying device 510 may not increase in the width direction or the horizontal direction and the copier 1A can reduce the size.

However, when compared to the FRR sheet separation mechanism, the conveying force of the friction pad sheet separation mechanism may be smaller. In addition, the conveying path from the feed roller 63 to the grip roller 81 is shorter, a relatively rigid sheet such as a cardboard recording paper can be stopped before the grip roller 63. Further, in the friction pad sheet separating mechanism, the locations of the feed roller 63, the friction pad 68, and a base plate, not shown, are designed so that the feed roller 63 can contact the top sheet S and the friction pad 68 at respective points J and K on the outer circumferential surface of the feed roller 63 as shown in FIG. 23, for example. The points J and K are spaced apart by a given angle of the center angle of the feed roller 63. In the copier 1A of FIG. 22, a cassette type sheet feeding unit such as the sheet feeding cassette 51, in which the base plate thereof moves in an obliquely upward direction with respect to the horizontal surface of the copier 1A and a large amount of sheets, such as some hundreds of sheets, are loaded therein. When such a cassette type sheet feeding unit is used, the leading edge of the top sheet S on the base plate moving obliquely upward and the outer circumferential surface of the feed roller 63 may contact. As a result, the sheet feeding property may deteriorate and the amount of sheet to be loaded in the sheet feeding cassette 51 may be limited.

In FIG. 23, the sheet conveying device 510 includes conveying guide members 69, 74, and 75.

The conveying guide member 64 is disposed at a position to provide the outer side of the first conveying path PA. The conveying guide member 64 includes guide surfaces 69*a* and 69*b*. The guide surface 69*a* is provided to guide the sheet S conveyed by the first conveying unit 600 to the conveying surface 82*a* of the conveyor belt 82 at the downstream side of the first conveying unit 600. The guide surface 69*b* is provided to form the second conveying path PB.

The conveying guide member 74 is disposed at a position to provide the inner side of the first conveying path PA. The conveying guide member 74 includes a guide surface 74*a* that is disposed facing the guide surface 69*a* of the conveying guide member 69 with a given interval. The guide surface 74*a* of the conveying guide member 74 is provided as a curved surface protruding to the conveying guide member 69 across a line connecting the nip contact in the first conveying unit 600 and the nip contact in the second conveying unit 7. The degree of protrusion or curvature of the curved surface 74*a* is determined so that the leading edge of the sheet S can reach the conveying surface 82*a* of the conveyor belt 82.

The conveying guide member 75 is disposed facing the conveying guide member 69 to form the second conveying path PB. The conveying guide member 75 includes a guide surface 75*a* is provided to form the second conveying path PB to convey the sheet S conveyed from the lower sheet feeding cassette 51 to the third conveying path PC via the conveying surface 82*a* of the conveyor belt 82.

As shown in FIG. 23, the conveying surface 82*a* of the conveyor belt 82 in the belt conveying unit 8 is disposed along the outer side of the merged portion serving as a common conveying path, which is located at the upstream side of the second conveying unit at which the first conveying path PA and the second conveying path PB merge. This configuration is same as previously described in the second example.

Further, as previously described in the first and second examples, the belt conveying unit 8 is disposed to contact the conveying surface 82*a* of the conveyor belt 82, except the portions on which the leading edge of the sheet S is held by the pulleys 83 and 84.

Also as previously described in the first and second examples, the belt conveying unit 8 or 800 is disposed so that the leading edge of the sheet S separated and conveyed from the first conveying unit 600 contacts the conveying surface 82*a* of the conveyor belt 82 by an angle θ, not shown.

Further, the pulley 84 serving as the second belt holding and conveying member that supports the conveyor belt 82 of the belt conveying unit 8 is disposed on the outer side of the above-described common conveying path.

An opening and closing guide 79B is attached to the copier 1A so as to freely open and close with respect to a part of the main body of the sheet conveying device 510 and the main body of the copier 1A. The opening and closing guide 79 shown in FIG. 20 has the substantially same function as the opening and closing guide 79 described in the first through fourth examples.

As described above, the second example embodiment applies the above-described belt conveying unit 8. However, the first example embodiment can apply the belt conveying unit 800, alternatively, as shown in FIG. 23.

Further, by shifting the third conveying path PC to the left side of the sheet conveying device 510 in FIG. 23, the fourth conveying path PD serving as the common conveying path merging the reverse conveying path R3 of the sheet reversing device 42 is also shifted to the left side thereof in FIG. 23.

Furthermore, the conveying surface 82*a* of the conveyor belt 82 is disposed on the inner side of the manual sheet feeding path R2 through which the sheet S fed from the manual sheet feeding tray 67 is conveyed.

However, the present invention can apply a configuration in which the sheet reversing device 42 and/or the manual sheet feeding tray 67 are not included. That is, such components are not necessarily provided. Accordingly, a further description of the above-described configuration is omitted.

According to this example embodiment in reference to FIGS. 23 and 24B, the belt conveying unit 8 is disposed so that the relatively rigid sheet S such as a cardboard recording paper can be fed from the upper sheet feeding cassette 51, the conveying surface 82*a* of the conveyor belt 82 is disposed in a left oblique direction, and the second conveying unit 7 including the grip roller 81 and the belt conveying unit 8 is shifted toward the first conveying unit 600 (to the left-sided direction in FIGS. 23 and 24B). Therefore, a distance L2 ranging from the nip contact between the grip roller 81 and the belt conveying unit 8 of the second conveying unit 7 to the nip contact of the pair of registration rollers 21 can be formed longer than a distance L1 ranging from a nip contact of a pair of grip rollers 81' in the sheet conveying unit 7' to the nip contact of the pair of registration rollers 21 shown in FIG. 24A. That is, a relation of the distances L1 and L2 in FIGS. 24A and 24B satisfies "L2>L1." In addition, a space SP for forming a given amount of bend at the leading edge of the sheet S may be increased at the third conveying path PC arranged before the pair of registration rollers 21, as shown in FIGS. 24A and 24B. As a result, skew and/or other defects can be surely corrected.

As described above, the belt conveying units 8 and 800 of the sheet conveying devices 5, 5A, 5B, and 510 each serves as a moving and guiding unit for moving and guiding the sheet S toward the nip contact or sheet holding section formed with the grip roller 81 while keeping the leading edge or a leading edge section (leading edge section has a broad meaning including the leading edge, the face at the leading edge, and the corners and edges at the leading edge) of the sheet S in contact with one member of the pair of rollers of the second conveying unit 7, and gradually increasing the contact surface with the sheet S according to the rigidity of the sheet S. The moving and guiding unit is not limited to the belt conveying units 8 and 800 as long as it has the above-described effects can be achieved.

Figure 25A:
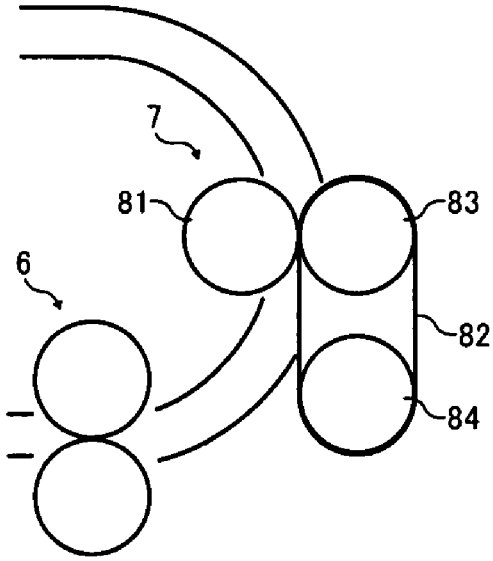
FIG. 25A is a schematic front view of conveying units applicable to the above-described sheet conveying devices.
Figure 25B:
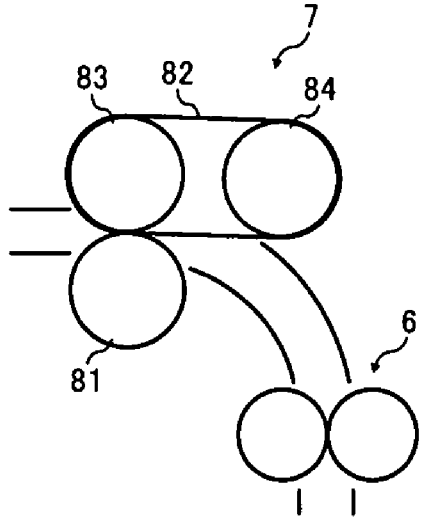
FIG. 25B is a schematic front view of different conveying units applicable to the above-described sheet conveying devices.

In the above-described example embodiments, and modified example embodiments, the present invention is applied to a sheet conveying device for conveying and feeding a sheet from a sheet storing unit (e.g., sheet feeding cassette 51) provided in the copier 1 serving as an image forming apparatus to the main body 2 of the copier 1, as shown in FIG. 2. However, the present invention is not limited thereto. That is, the present invention is applicable to a sheet conveying device in which the leading edge of a sheet S is ejected substantially upward from the top of the fixing device 11 of the main body 2 of the copier 1, and then ejected from the main body 2 to the sheet eject tray 9 in a substantially horizontal direction, as shown in FIG. 25B, for example. The present invention is also applicable to a sheet conveying device in which a sheet S placed on the substantially horizontal manual sheet feeding tray 67 provided outside the main body 2 of the copier 1 by a user is guided inside the main body 2 while maintaining its horizontal direction, and then the sheet S changes its direction upward to be conveyed into a vertical conveying path that extends to the image forming section in the main body 2 of the copier 1.

In the above-described examples, modifications, and example embodiments, the sheet may change its direction from a substantially horizontal direction to a vertically upward direction or substantially directly upward direction. However, the present invention is not limited thereto. That is, the sheet can change its direction from a substantially horizontal direction to a vertically downward direction or substantially directly downward direction, or from a vertically downward or upward direction to a substantially horizontal direction, as shown in FIG. 25A, for example, or from an oblique direction to another oblique direction.

In the above-described example embodiments, and modified example embodiments, both the first conveying unit 6 and the second conveying unit 7 are holding and conveying units. However, depending on the conveying direction of each of the first and second conveying units 6 and 7, if it is only needed to support the bottom face of the conveying object while being conveyed, the first and second conveying units 6 and 7 may not need to have holding and conveying units including nip contacts formed by members facing each other.

The members of the first conveying unit 6, the second conveying unit 7, and the pickup roller 60 are not limited to the above. The members can be a substantially extended cylindrical member with a given length in the axial lengthwise direction of the rotational axis, or a short cylindrical member. Furthermore, plural rollers can be disposed along a single rotational shaft with given equal intervals therebetween.

In the conveying paths according to the above-described example embodiments, several guiding members can be provided along the outer side or the inner side in the spaces in which rollers are not disposed so as to form guiding surfaces. As long as such guiding surfaces are symmetrically arranged in an orderly manner with respect to a conveying center line, the guiding surfaces can be band-like guiding surfaces or substantially linear guiding surfaces or a combination thereof.

In the first through fourth examples and the first example embodiment, a friction pad is used for a sheet separation mechanism. However, the sheet separation method is not limited to the above-described method or mechanism. The present invention can apply any sheet separation method in which, when multiple sheets are picked up from a sheet feeding cassette, one sheet is frictionally separated from the other sheets. For example, a separator or a separating claw can be applied, instead of the friction pad.

The present invention is not limited to the copier 1 having a monochrome printing method. That is, the sheet conveying device according to the present invention is also applicable to a color copier or an image forming apparatus connected to a printer such as a monochrome laser printer, an inkjet printer, or an ink ribbon printer.

The present invention is similarly applicable to a color printer such as a direct transfer type tandem type color image forming apparatus in which images are sequentially transferred and superimposed onto a sheet being conveyed by a transfer member, and a tandem type image forming apparatus in which images are sequentially transferred onto an endless intermediate transfer belt serving as an intermediate transfer member and then transferred onto a sheet at once as a overlaid toner image or a color toner image.

The present invention is also applicable to an image forming apparatus including a single, endless belt type photoconductor.

The present invention is not limited to an image forming apparatus that employs an in-body paper eject type, that is, a sheet eject tray is located within the main body of the image forming apparatus, between an image forming unit and a scanner. Specifically, the present invention is also applicable to an image forming apparatus with a paper eject tray provided on the side of the main body of the image forming apparatus.

The present invention is not limited to a conveying path for conveying a sheet extracted from the sheet feeding device 3 substantially vertically or directly upward toward the top of the main body 2 of the copier 1. That is, the present invention is also applicable to an image forming apparatus in which the conveying path from the sheet feeding device to the sheet eject tray is not substantially vertically or directly upward.

The present invention is also applicable to a sheet conveying device provided in a printing machine including stencil printing machines, for conveying a sheet from a sheet storing unit or sheet feeding cassette to a printing machine main unit.

In the above-described copier 1 serving as the image forming apparatus, an original document to be scanned may be manually set. However, the image forming apparatus can be a copier or a printing machine provided with an automatic document feeder or ADF for automatically scanning plural original documents or sheets, and the sheet conveying device according to the present invention can be provided in the ADF.

The image forming apparatus is not limited to a copier. That is, the image forming apparatus can be a facsimile machine, a printer, an inkjet recording device, or an image scanning device, provided with a scanner for scanning an image from an original document, and a multifunction peripheral combining at least two of the above. In any of the above-described apparatuses or devices, an optimum sheet conveying device can be provided for changing the sheet conveying direction in conveying various types of sheets, while saving space in the sheet conveying path.

The present invention is not limited to providing respective sheet conveying devices to multiple sheet feeding stages. For example, the present invention is applicable to a case in which the top sheet feeding cassette 51 and the sheet conveying device 5' are removed from the sheet feeding device 3 shown in FIG. 2 so that the sheet feeding device 3 can include a single sheet feeding cassette 51 and a single sheet conveying device 5.

That is, the present invention is applicable to an image scanning device provided with the sheet conveying device according to an example embodiment of the present invention, and to an image forming apparatus provided with the sheet conveying device and/or the image scanning device according to an example embodiment of the present invention. The image forming apparatus according to an example embodiment of the present invention can be any one of a copier, a facsimile machine, a printer, a printing machine, and an inkjet recording device, or a multifunction peripheral combining at least two of the above.

As described above, the inventors of the present invention conducted the above-described various tests to evaluate the test results. Based on the test results, the inventors found a simple configuration with a moving and guiding member or a moving guide that can convey various sheets, including a relatively rigid sheet such as a cardboard recording paper and an envelope, without causing conveyance defects or paper jams. Specifically, the inventors made variations of simple belt conveying units to achieve the above-described purposes.

The above-described example embodiments are illustrative, and numerous additional modifications and variations are possible in light of the above teachings. For example, elements and/or features of different illustrative and example embodiments herein may be combined with each other and/or substituted for each other within the scope of this disclosure and appended claims. It is therefore to be understood that within the scope of the appended claims, the disclosure of this patent specification may be practiced otherwise than as specifically described herein.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A sheet conveying device, comprising:

a first conveying unit to convey a sheet in a first sheet conveying direction; and a second conveying unit, disposed on a downstream side of the first conveying unit in the first sheet conveying direction, to convey the sheet conveyed by the first conveying unit in a second sheet conveying direction different from the first sheet conveying direction, the second conveying unit including, a rotary conveyance driving unit to rotate to transmit a driving force and a belt conveying unit, disposed on an outer side of a sheet conveying path provided between the first conveying unit and the second conveying unit and forming a sheet holding section therebetween, to hold and convey the sheet, the belt conveying unit including, a belt, including an elastic member, to rotate with the rotary conveyance member to convey the sheet to the sheet holding section, at least a pair of rotary belt holding members to rotatably hold the belt, and a belt supporting member to rotatably support each of the pair of rotary belt holding members to maintain a constant distance between the pair of rotary belt holding members, wherein the belt has a hardness in a range of from approximately 40 degrees to approximately 80 degrees and a coefficient of friction of a surface of at least one of the two belt holding members to the belt is set to approximately 0.8 to approximately 2.6, and wherein when the belt is spanned around the pair of rotary belt holding members, an extension rate of an extended circumferential length of the belt to a normal circumferential length of the belt is in a range of from approximately 5% to approximately 10%.

2. The sheet conveying device according to claim 1, wherein the belt has a thickness of equal to or greater than 1.5 mm.

3. The sheet conveying device according to claim 1, wherein the belt is made of at least one of ethylene propylene rubber, chloroprene rubber, urethane rubber, silicon rubber, and silicone rubber.

4. The sheet conveying device according to claim 1, further comprising:

a guide member, disposed in a vicinity of the belt in an outer area of the sheet conveying path provided between the first conveying unit and the second conveying unit, to guide the sheet to the belt, wherein the pair of rotary belt holding members includes a first rotary belt holding member disposed facing the rotary conveyance driving unit, and a second rotary belt holding member disposed facing the first rotary belt holding member and disposed at an upstream side of the first rotary belt holding member in a sheet conveying direction of the second conveying unit, the second rotary belt holding member being disposed at a downstream side in the sheet conveying direction of the second conveying unit from an axial center of a rotating member of the first conveying unit disposed on an outer side of the first conveying member and at an upstream side in the sheet conveying direction of the second conveying unit from a downstream end of the guide member.

5. The sheet conveying device according to claim 1, wherein the belt conveying unit is disposed such that a leading edge of the sheet is held in contact with a conveying surface of the belt, except that a portion the leading edge of the sheet is supported by the first and second rotary belt holding members.

6. An image forming apparatus including the sheet conveying device according to claim 1.

7. A sheet conveying device, comprising:

a first conveying unit to convey a sheet in a first sheet conveying direction;

a second conveying unit, disposed on a downstream side of the first conveying unit in the first sheet conveying direction, to convey the sheet conveyed by the first conveying unit in a second sheet conveying direction different from the first sheet conveying direction, the second conveying unit including a rotary conveyance driving unit, to rotate to transmit a driving force, and a belt conveying unit, forming a sheet holding section therebetween to hold and convey the sheet, the belt conveying unit including a belt, including an elastic member, to rotate with the rotary conveyance driving unit to convey the sheet to the sheet holding section, at least a pair of rotary belt holding members to rotatably hold the belt, and a belt supporting member to rotatably support each of the pair of rotary belt holding members to maintain a constant distance between the pair of rotary belt holding members;

a first sheet conveying path provided between the first conveying unit and the second conveying unit;

a second sheet conveying path, different from the first sheet conveying path, provided between an upstream side of the second conveying unit and the second conveying unit; and a common conveying path provided to a position where the first sheet conveying path and the second sheet conveying path merge, on an outer side thereof the belt conveying unit being disposed, wherein the second conveying unit includes a sheet holding section formed by a rotary conveyance driving unit to rotate to transmit a driving force, and a belt conveying unit disposed on an outer side of the common conveying path, the belt conveying unit including a belt, including an elastic member, to rotate with the rotary conveyance driving unit to convey the sheet to the sheet holding section, at least a pair of rotary belt holding members to rotatably hold the belt, and a belt supporting member to rotatably support each of the pair of rotary belt holding members to maintain a constant distance between the pair of rotary belt holding members, the belt including a hardness in a range of from approximately 40 degrees to approximately 80 degrees and a coefficient of friction of a surface of at least one of the two belt holding members to the belt is set to approximately 0.8 to approximately 2.6, wherein when the belt is spanned around the pair of rotary belt holding members, an extension rate of an extended circumferential length of the belt to a normal circumferential length of the belt is in a range of from approximately 5% to approximately 10%.

8. The sheet conveying device according to claim 7, wherein the belt is made of at least one of ethylene propylene rubber, chloroprene rubber, urethane rubber, silicon rubber, and silicone rubber.

9. The sheet conveying device according to claim 7, wherein the belt has a thickness of equal to or greater than 1.5 mm.

10. The sheet conveying device according to claim 7, further comprising:

a guide member, disposed in a vicinity of the belt in an outer area of the sheet conveying path provided between the first conveying unit and the second conveying unit, to guide the sheet to the belt, wherein the pair of rotary belt holding members includes a first rotary belt holding member disposed facing the rotary conveyance driving unit, and a second rotary belt holding member disposed facing the first rotary belt holding member and disposed at an upstream side of the first rotary belt holding member in a sheet conveying direction of the second conveying unit, the second rotary belt holding member being disposed at a downstream side in the sheet conveying direction of the second conveying unit from an axial center of a rotating member of the first conveying unit disposed on an outer side of the first conveying member and at an upstream side in the sheet conveying direction of the second conveying unit from a downstream end of the guide member.

11. The sheet conveying device according to claim 7, wherein the belt conveying unit is disposed so that a leading edge of the sheet is held in contact with a conveying surface of the belt, except that a portion the leading edge of the sheet is supported by the first and second rotary belt holding members.

12. An image forming apparatus comprising the sheet conveying device according to claim 7.

* * * * *